US011780699B2

(12) United States Patent
Borke et al.

(10) Patent No.: US 11,780,699 B2
(45) Date of Patent: Oct. 10, 2023

(54) SHEET PRODUCT DISPENSER WITH SPRING ASSEMBLY

(71) Applicant: GPCP IP Holdings LLC, Atlanta, GA (US)

(72) Inventors: Brian Scott Borke, Appleton, WI (US); Ryan Anthony Goltz, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 17/088,917

(22) Filed: Nov. 4, 2020

(65) Prior Publication Data

US 2021/0061609 A1 Mar. 4, 2021

Related U.S. Application Data

(63) Continuation of application No. 15/886,126, filed on Feb. 1, 2018, now Pat. No. 10,850,938.
(Continued)

(51) Int. Cl.
*B65H 35/00* (2006.01)
*B65H 20/02* (2006.01)
*A47K 10/36* (2006.01)

(52) U.S. Cl.
CPC ..... *B65H 35/0086* (2013.01); *A47K 10/3625* (2013.01); *B65H 20/02* (2013.01);
(Continued)

(58) Field of Classification Search
CPC ..... A47K 2020/3668; A47K 20/3668; B65H 35/0086; B65H 35/0013; B65H 20/02;
(Continued)

(56) References Cited

U.S. PATENT DOCUMENTS 43,692 A 8/1864 Hugunin
119,235 A 9/1871 McDonald
(Continued)

FOREIGN PATENT DOCUMENTS

CA 2495163 A1 7/2005
CA 2988638 A1 12/2016
(Continued)

OTHER PUBLICATIONS http://kennedy-hygiene.com/hand-drying/pod/.
(Continued)

*Primary Examiner* — Evan H MacFarlane
*Assistant Examiner* — Fernando A Ayala

(57) ABSTRACT

A dispenser for dispensing sheet product is provided. The dispenser includes a housing with an outlet through which sheet product is dispensed. A knife drum is rotatable with respect to the housing. A knife is movable between a retracted position within the knife drum and an extended position where the knife protrudes outside of the knife drum to cut the sheet product. A cam follower surface is fixed with respect to the housing. A cam follower is attached to the knife and operable to engage the cam follower surface and travel therealong to transition the knife between the retracted position and the extended position. A spring assembly biases the knife drum during rotation toward a predetermined position. The spring assembly comprises a first spring and a second spring. The spring assembly is attached at a single mount position that is fixed with respect to the housing.

17 Claims, 44 Drawing Sheets

Related U.S. Application Data

(60) Provisional application No. 62/569,742, filed on Oct. 9, 2017.

(52) U.S. Cl.
CPC *A47K 2010/3668* (2013.01); *B65H 2301/415* (2013.01); *B65H 2301/51512* (2013.01); *B65H 2301/515323* (2013.01); *B65H 2403/44* (2013.01); *B65H 2403/92* (2013.01); *B65H 2404/15* (2013.01)

(58) Field of Classification Search
CPC .. B65H 2301/415; B65H 2301/515323; B65H 2403/92; B65H 2403/44; B65H 2404/01
See application file for complete search history.

(56) References Cited

U.S. PATENT DOCUMENTS 1,428,659 A 9/1922 Reese
2,105,928 A 1/1938 Perrin
2,150,817 A 3/1939 Boex
2,193,759 A 3/1940 Birr
2,195,727 A 4/1940 Jensen
2,367,203 A 1/1945 Cooper
2,560,061 A 7/1951 Agamaite, Jr.
2,639,959 A 5/1953 Couden
2,861,856 A * 11/1958 Lawrence ..... A47K 10/36 312/34.13
2,930,664 A * 3/1960 Liebisch ..... A47K 10/3656 242/564.2
3,124,268 A 3/1964 Krueger
3,288,387 A 11/1966 Craven, Jr.
3,389,610 A 6/1968 Knudson
3,628,473 A 12/1971 Maille
3,645,157 A 2/1972 Di Giulio et al.
3,685,416 A 8/1972 Coughlan
3,841,466 A 10/1974 Hoffman et al.
3,917,191 A 11/1975 Graham, Jr. et al.
3,998,120 A 12/1976 Granger et al.
4,010,909 A 3/1977 Bastian
4,067,509 A 1/1978 Graham, Jr. et al.
4,106,135 A 8/1978 Mannheim
4,148,442 A 4/1979 Baumann et al.
4,165,138 A 8/1979 Hedge et al.
4,192,442 A 3/1980 Bastian et al.
4,203,562 A 5/1980 DeLuca et al.
4,206,858 A 6/1980 DeLuca et al.
4,286,489 A 9/1981 DeLuca
4,317,547 A 3/1982 Graham, Jr. et al.
4,358,169 A 11/1982 Filipowicz et al.
4,367,666 A 1/1983 Toth
4,378,912 A 4/1983 Perrin et al.
4,396,163 A 8/1983 Graham, Jr. et al.
4,403,748 A 9/1983 Cornell
4,487,375 A 12/1984 Rasmussen et al.
4,526,198 A 7/1985 Scott
4,546,898 A 10/1985 Ekuan
4,569,467 A 2/1986 Kaminstein
4,611,768 A 9/1986 Voss et al.
4,662,664 A 5/1987 Wendt et al.
4,694,714 A 9/1987 Focke et al.
4,712,461 A 12/1987 Rasmussen
4,723,637 A 2/1988 Thompson, Sr.
4,756,485 A 7/1988 Bastian et al.
4,807,824 A 2/1989 Gains et al.
4,846,412 A 7/1989 Borand
4,856,724 A 8/1989 Jespersen
4,926,505 A 5/1990 Higuchi et al.
4,944,466 A 7/1990 Jespersen
5,048,386 A * 9/1991 DeLuca ..... A47K 10/3643 83/37
5,078,033 A 1/1992 Formon
5,129,294 A 7/1992 Boldrini et al.
5,161,723 A 11/1992 Wirtz-Odenthal
5,183,140 A 2/1993 Nicholl
5,257,711 A * 11/1993 Wirtz-Odenthal ..... A47K 10/3687 225/72
5,273,184 A 12/1993 Rizzuto
5,294,192 A 3/1994 Omdoll et al.
5,295,272 A 3/1994 Juushi
5,302,167 A 4/1994 Kley et al.
5,375,785 A 12/1994 Boone et al.
5,400,982 A 3/1995 Collins
5,441,109 A 8/1995 Gupta
5,441,189 A 8/1995 Formon et al.
5,443,224 A 8/1995 Patterson et al.
5,526,973 A 6/1996 Boone et al.
5,549,218 A 8/1996 Asmussen
5,685,180 A 11/1997 Qualters
5,690,299 A 11/1997 Perrin et al.
5,772,291 A 6/1998 Byrd et al.
5,799,895 A 9/1998 Michaud et al.
5,850,729 A 12/1998 Irmen
5,857,642 A 1/1999 Zinnbauer
5,873,542 A 2/1999 Perrin et al.
5,901,921 A 5/1999 Perlsweig
5,924,617 A 7/1999 LaCount et al.
5,950,863 A 9/1999 Schutz et al.
5,979,821 A 11/1999 LaCount et al.
5,979,822 A 11/1999 Morand et al.
5,996,990 A 12/1999 Kawashima
6,003,723 A 12/1999 Morand
6,027,002 A 2/2000 Granger
6,032,898 A 3/2000 LaCount et al.
6,059,281 A 5/2000 Nakamura et al.
6,079,305 A 6/2000 Bloch et al.
6,145,779 A 11/2000 Johnson et al.
6,224,010 B1 5/2001 Morand
6,237,871 B1 5/2001 Morand et al.
6,250,530 B1 6/2001 LaCount et al.
6,302,351 B1 10/2001 Omdoll et al.
6,314,850 B1 * 11/2001 Morand ..... A47K 10/3643 83/322
6,315,155 B1 11/2001 Hubanks et al.
6,354,533 B1 3/2002 Jepersen
6,363,825 B1 4/2002 Hagleitner
6,378,725 B1 * 4/2002 Granger ..... A47K 10/3643 83/337
6,390,410 B1 5/2002 LaCount et al.
6,431,493 B1 8/2002 Stauner
6,446,901 B1 9/2002 Haen et al.
6,460,798 B1 10/2002 Haen et al.
6,474,209 B1 * 11/2002 Granger ..... A47K 10/3643 83/649
6,499,724 B1 12/2002 Dobmeier et al.
6,508,432 B2 1/2003 Krivulin
6,543,641 B2 4/2003 Hubanks et al.
6,543,737 B2 4/2003 Decker et al.
6,553,879 B2 4/2003 Morand
6,581,500 B1 6/2003 Kietaibl
6,619,504 B2 9/2003 Ozimec
6,684,751 B2 2/2004 Kapiloff et al.
6,695,246 B1 2/2004 Elliott et al.
6,749,149 B1 6/2004 Friesen
6,826,985 B2 12/2004 Broehl
6,826,991 B1 12/2004 Rasmussen
6,913,257 B2 7/2005 Takaki et al.
6,981,938 B2 1/2006 Ruthenberg et al.
6,988,437 B2 1/2006 Granger
7,014,140 B2 3/2006 Elliott et al.
7,036,815 B2 5/2006 Yamamoto
7,044,421 B1 5/2006 Omdoll et al.
7,114,676 B2 10/2006 Elliott et al.
7,168,602 B2 1/2007 Broehl
7,191,979 B2 3/2007 Paukov
7,234,381 B2 6/2007 Granger
7,270,292 B2 9/2007 Rasmussen
7,316,369 B2 1/2008 Phelps
7,357,348 B2 4/2008 Kananen
D568,655 S 5/2008 Friesen et al.
7,398,944 B2 7/2008 Lewis et al.
7,461,758 B2 12/2008 Serfaty

(56) References Cited

U.S. PATENT DOCUMENTS 7,490,733 B2 2/2009 Tagliareni
7,500,420 B2 3/2009 Cvjetkovic et al.
7,568,652 B2 8/2009 Cittadino et al.
7,571,670 B2 * 8/2009 Formon ..... A47K 10/3643 225/96
7,641,143 B2 1/2010 Omdoll et al.
7,735,770 B2 6/2010 Conner
7,841,556 B2 11/2010 Elliott et al.
7,866,593 B2 1/2011 Friesen et al.
7,878,444 B2 2/2011 Friesen et al.
7,878,445 B2 2/2011 Granger
7,878,446 B2 2/2011 Reinsel et al.
7,887,005 B2 2/2011 Troutman et al.
7,887,042 B2 2/2011 Sheng et al.
7,896,285 B2 3/2011 Wruck, Jr. et al.
7,905,441 B2 3/2011 Scherzinger et al.
7,913,945 B2 3/2011 Friesen et al.
7,931,228 B2 4/2011 Omdoll et al.
7,984,872 B2 7/2011 Keuhneman et al.
7,987,756 B2 8/2011 Lewis et al.
8,061,645 B2 11/2011 Granger
8,082,827 B2 12/2011 Friesen et al.
8,146,471 B2 4/2012 Hansen et al.
8,157,258 B2 4/2012 Lin
8,161,849 B2 4/2012 Stark
8,162,252 B2 4/2012 Cittadino et al.
8,165,716 B1 4/2012 Goeking et al.
8,220,684 B1 7/2012 Keily et al.
8,240,594 B2 8/2012 Troutman et al.
8,256,700 B2 9/2012 Billman et al.
8,282,033 B2 10/2012 Achton
8,297,160 B2 10/2012 Friesen et al.
8,332,568 B2 12/2012 Okada
8,365,949 B2 2/2013 Serfaty
8,371,193 B2 2/2013 Huang
8,382,026 B2 2/2013 Keily et al.
8,402,872 B2 3/2013 Friesen et al.
8,424,431 B1 4/2013 Jackman et al.
8,464,976 B2 6/2013 Mok et al.
8,496,198 B2 7/2013 Cittadino et al.
8,511,599 B2 8/2013 Lalau et al.
8,528,851 B2 9/2013 Friesen et al.
8,544,785 B2 10/2013 Pelland et al.
8,555,761 B2 10/2013 Keily et al.
8,573,715 B1 11/2013 Jackman et al.
8,578,826 B2 11/2013 Hansen et al.
8,616,489 B2 12/2013 Goeking et al.
8,632,030 B2 1/2014 Troutman et al.
8,695,969 B2 4/2014 Aoyama et al.
8,733,218 B2 5/2014 Hansen et al.
8,741,410 B2 6/2014 Cattacin et al.
8,763,946 B1 7/2014 Keily
8,763,947 B2 7/2014 Keily et al.
8,777,147 B2 7/2014 Maemura et al.
8,777,149 B2 7/2014 Goeking et al.
8,802,211 B2 8/2014 Cattacin et al.
8,833,691 B1 9/2014 Zosimadis
8,860,347 B2 10/2014 Keily et al.
8,882,021 B2 11/2014 Cittadino et al.
8,919,688 B2 12/2014 Kuehneman et al.
8,943,938 B2 * 2/2015 Sahlberg ..... B26D 1/1435 83/295
8,950,628 B2 2/2015 Muderlak et al.
8,967,004 B2 3/2015 Palfai et al.
9,027,871 B2 5/2015 Keuhneman et al.
9,066,638 B2 6/2015 Lowery et al.
9,144,352 B2 9/2015 Cittadino et al.
9,241,601 B2 1/2016 Case et al.
9,248,988 B2 2/2016 Keily et al.
9,326,648 B2 5/2016 Trampolski
9,345,367 B2 5/2016 Keily et al.
9,370,283 B2 6/2016 Fellhoelter
9,370,284 B2 6/2016 Moller et al.
9,408,507 B2 8/2016 Brannan, Jr.
9,446,924 B2 9/2016 Omdoll
D784,786 S 4/2017 Omdoll
9,629,509 B1 4/2017 Keily et al.
9,655,478 B2 5/2017 Muderlak et al.
9,687,120 B2 6/2017 Muderlak et al.
9,730,559 B2 8/2017 Keily et al.
9,854,948 B1 * 1/2018 Paal ..... A47K 10/3643
10,422,616 B2 * 9/2019 Orsini ..... F03G 1/02
10,850,938 B2 * 12/2020 Borke ..... B65H 16/005
11,154,166 B2 * 10/2021 Osborne, Jr. ..... A47K 10/36
2002/0056526 A1 5/2002 Kelders et al.
2002/0096028 A1 7/2002 Morand
2002/0096596 A1 7/2002 Adelakun
2002/0117034 A1 8/2002 Granger
2004/0108406 A1 6/2004 Friesen
2005/0218581 A1 10/2005 Kitasawa
2006/0108467 A1 5/2006 Elliott et al.
2006/0157496 A1 7/2006 Tagliareni
2006/0236836 A1 10/2006 Cassia
2006/0266873 A1 11/2006 Friesen et al.
2007/0079676 A1 4/2007 Friesen et al.
2007/0176041 A1 8/2007 Friesen et al.
2008/0223975 A1 9/2008 Planeta et al.
2008/0245922 A1 10/2008 Fellhoelter
2008/0302810 A1 12/2008 Friesen
2009/0039099 A1 2/2009 Friesen et al.
2009/0177315 A1 7/2009 Goeking et al.
2009/0256022 A1 10/2009 Maurer
2009/0278425 A1 11/2009 Cittadino et al.
2009/0322017 A1 12/2009 Bokelman
2010/0102101 A1 4/2010 Keily et al.
2010/0243696 A1 9/2010 Friesen et al.
2010/0286818 A1 11/2010 Goeking et al.
2010/0319508 A1 12/2010 Hagleitner
2011/0068129 A1 3/2011 Maurer
2011/0133019 A1 6/2011 Keily et al.
2012/0018483 A1 1/2012 Matsumura
2012/0138723 A1 6/2012 Lewis et al.
2012/0167734 A1 * 7/2012 Hansen ..... A47K 10/3643 83/337
2012/0181371 A1 7/2012 Omdoll et al.
2013/0026282 A1 1/2013 Friesen et al.
2013/0197707 A1 8/2013 Keily et al.
2014/0291437 A1 10/2014 Corley et al.
2014/0312158 A1 10/2014 Hlushchenko et al.
2014/0367507 A1 12/2014 Trampolski
2015/0082960 A1 3/2015 Niada
2015/0083847 A1 3/2015 Cittadino
2015/0150422 A1 6/2015 Ochoa, Sr. et al.
2015/0196174 A1 7/2015 Goltz et al.
2015/0289730 A1 10/2015 Keily et al.
2015/0305578 A1 10/2015 Keily et al.
2016/0037979 A1 2/2016 Mattheeussen et al.
2016/0157682 A1 6/2016 Keily et al.
2016/0198911 A1 7/2016 Ruiz et al.
2016/0242603 A1 8/2016 Cvjetkovic
2016/0353946 A1 12/2016 Osborne, Jr.
2016/0359345 A1 12/2016 Uesugi
2017/0105588 A1 4/2017 Keily et al.
2017/0245699 A1 8/2017 Keily et al.
2018/0263433 A1 9/2018 Osborne, Jr.
2019/0106287 A1 4/2019 Borke et al.
2020/0029751 A1 1/2020 Osborne, Jr.

FOREIGN PATENT DOCUMENTS

CH 635296 A5 3/1983
EP 0099602 A1 2/1984
EP 1230886 A1 8/2002
EP 0967908 B1 5/2003
EP 1559356 A2 8/2005
EP 2410897 B1 4/2017
FR 2667854 A1 4/1992
GB 653297 A 5/1951
JP H07-37591 Y2 8/1995
WO WO 2008/145496 A2 12/2008
WO WO 2009/072055 A1 6/2009
WO WO 2010/046662 A1 4/2010
WO WO 2014/091247 A2 6/2014
WO WO 2019/098260 A1 5/2019

(56) References Cited

FOREIGN PATENT DOCUMENTS

OTHER PUBLICATIONS

AmeraProducts, Inc.; Snub Roll Transfer System; http://ameraproducts.com/Stub-Roll-Paper-Towel Dispensers.htm; website visited Oct. 24, 2016.
Bobrick Washroom Equipment, Inc.; Technical Data; ClassisSeries® Convertible Universal Roll Towel Module; Model 3961-50.
Tork US; Tork Hand Towel Roll Dispenser, Lever Auto Transfer; https://torkusa.com/product/84tr/dispenser/hand_towel; website visited Oct. 24, 2016.
Kimberly-Clark Professional; MOD* SLIMROLL Compact Hard Roll Towel Dispenser; http://kcprofessional.com/products/dispensers/hand-towel/manual-hard-roll/36034- . . . ; website visited Oct. 24, 2016.
Georgia-Pacific Consumer Products LP; GP Max 3000® Black Single Roll Towel Dispenser (Y-Series); Mfg. 58443; http://catalog.gppro.com/catalog/6359/7605?filter=full.

* cited by examiner

SHEET PRODUCT DISPENSER WITH SPRING ASSEMBLY

RELATED APPLICATION

This application is a continuation of U.S. Non-provisional application Ser. No. 15/886,126, filed Feb. 1, 2018, entitled "Mechanical Sheet Product Dispenser", which claims priority to U.S. Provisional Application No. 62/569,742, filed Oct. 9, 2017, entitled "Mechanical Sheet Product Dispenser"; the contents of each being hereby incorporated by reference in their entireties.

FIELD

Embodiments of the present invention relate to sheet product dispensers and, more particularly, to mechanical sheet product dispensers.

BACKGROUND

Sheet product dispensers, such as paper towel dispensers or tissue dispensers, provide on-demand sheet product to a user from a supply of sheet product stored within the dispenser, such as in roll form. The sheet product is dispensed from the roll, such as by passing one end of the sheet product through a pair of rollers.

Depending on the type of dispenser, dispensing may be accomplished automatically (e.g. with a motor) or manually (e.g. using the force a user applies). Further, depending on the various components of the sheet product dispenser, different features may be utilized.

Some configurations of the sheet product dispensers can be prone to cause various undesirable scenarios. For example, some dispensers may include component configurations that are prone to jamming and/or misfeeding of the sheet product. Some dispensers require a relatively high pull force over a long pull period to cause dispensing of the dispensed portion of sheet product. Other dispensers may include a feed wheel or other mechanism to allow for manual feeding of sheet product. However, these feed wheels or other mechanisms may be susceptible to over-torqueing by a user, which may cause damage to the internal components of the dispenser.

As such, it is desirable to provide for efficient and user-friendly operation of sheet product dispensers. For example, it is desirable to avoid jamming scenarios, prevent noisy or undesirable operation, provide for low pull force requirements for manual dispensing, prevent damage to the dispenser, and provide other various improvements.

SUMMARY OF THE INVENTION

In light of the foregoing background, some embodiments of the present invention provide example sheet product dispensers that seek to fix or prevent such undesirable scenarios. For example, in some example embodiments, the dispenser may include one or more components configured to ensure proper feeding of sheet product from a source roll to the outlet to prevent jamming, ripping, or misfeeds. In another example embodiment, the dispensers may include a torque limiter, or mechanical fuse, to limit or prevent over-torqueing of internal components. Additionally, some example dispensers may include a spring assembly configured to reduce the pull force and/or time of a pull actuation for dispensing a sheet, which may result in easier operation of the dispenser.

In an example embodiment, a dispenser for dispensing sheet product is provided. The dispenser comprises a housing that defines an interior configured to accommodate at least one source of sheet product. The housing further defines an outlet through which sheet product is dispensed. The dispenser comprises a first roller that is rotatable and disposed in the housing. A portion of the sheet product is designed to be in contact with the first roller. The dispenser also includes a knife drum that is rotatable and configured to cooperate with the first roller to dispense the sheet product. The knife drum comprises a knife configured to cut the sheet product into individual sheets. The dispenser further includes a spring assembly configured to bias the knife drum during rotation of the knife drum toward a predetermined position. The spring assembly comprises a crank arm, a floater link, a rocker link, and at least one biasing element.

In some embodiments, the crank arm is operably coupled to a center axis point of the knife drum at a first end and to a first end of the floater link at a second end. The second end of the floater link is operably coupled to a first end of the rocker link. The second end of the rocker link is operably coupled to a pivot point on the housing.

In some embodiments, the at least one biasing element comprises a torsion spring disposed about a pivot point on the housing that defines a rotatable connection between the housing and the rocker link. The torsion spring is operably coupled to the housing and the rocker link. In some embodiments, the torsion spring is configured to charge during rotation of the knife drum in a feed direction in response to a user pulling on a free end of the sheet product. The torsion spring may be configured to discharge to cause the knife drum to rotate to the predetermined position.

In some embodiments, the at least one biasing element comprises a torsion spring disposed about a rotatable connection point between the rocker link and the floater link. A first arm of the torsion spring is attached to the rocker link and a second arm of the torsion spring is attached to the floater link.

In some embodiments, the at least one biasing element comprises a first torsion spring and a second torsion spring. The first torsion spring is disposed about a pivot point on the housing that defines a rotatable connection between the housing and the rocker link, and the second torsion spring is disposed about a rotatable connection point between the rocker link and the floater link. The first torsion spring is operably coupled to the housing and the rocker link. A first arm of the second torsion spring is attached to the rocker link and a second arm of the second torsion spring is attached to the floater link. The first torsion spring and the second torsion spring are each configured to charge when the knife drum rotates in a feed direction in response to a user pulling on a free end of the sheet product. The first torsion spring and second torsion spring are each configured to discharge to cause the knife drum to rotate to the predetermined position.

In some embodiments, a second roller is disposed at the outlet and spaced from the knife drum such that there is a defined space between an outer periphery of the second roller and an outer periphery of the knife drum.

In some embodiments, the dispenser further comprises a pair of roll holders positioned within the housing and configured to hold the at least one source of sheet product. The housing defines a cover and a back housing, and the cover includes at least one tab that extends into the housing. The at least one tab is configured to, when the cover is in a closed position, push at least one of the pair of roll holders into the housing such that the at least one of the pair of roll holders provides an increased surface force against a surface of the at least one source of sheet product.

In another example embodiment, a dispenser for dispensing sheet product is provided. The dispenser comprises a housing that defines an interior configured to accommodate at least one source of sheet product. The housing further defines an outlet through which sheet product is dispensed. The dispenser includes a first roller that is rotatable and disposed in the housing. A portion of the sheet product is designed to be in contact with the first roller. The dispenser also includes a knife drum that is rotatable and configured to cooperate with the first roller to dispense the sheet product. The knife drum comprises a knife configured to cut the sheet product into individual sheets. The dispenser further includes a spring assembly configured to bias the knife drum during rotation of the knife drum toward a predetermined position. The spring assembly comprises a crank arm, a biasing element, and a slide mechanism.

In some embodiments, the slide mechanism comprises a bar link, and wherein the bar link comprises a slot configured to translate about a slot pin.

In some embodiments, the slot pin is operably coupled to the housing.

In some embodiments, the slot pin is operably coupled to a distal end of the crank arm.

In some embodiments, the slot is substantially straight.

In some embodiments, the slot comprises a curve.

In some embodiments, the crank arm is operably coupled to a center axis point of the knife drum at a first end and the slide mechanism at a second end.

In some embodiments, the bar link includes an end tab extending from a distal end of the bar link and the biasing element is operably coupled to the end tab.

In some embodiments, the bar link is pivotably connected to the housing at a pivot point.

In some embodiments, the biasing element comprises a torsion spring, and the torsion spring is operably coupled to the housing at a first end and to the bar link at a second end.

In some embodiments, the bar link is configured to pivot to charge the torsion spring when the knife drum rotates in a feed direction in response to a user pulling on a free end of the sheet product. The torsion spring discharges to cause the knife drum to rotate to the predetermined position.

In some embodiments, the torsion spring is disposed about the pivot point.

In some embodiments, the biasing element comprises a tension spring.

In some embodiments, a second roller is disposed at the outlet and spaced from the knife drum such that there is a defined space between an outer periphery of the second roller and an outer periphery of the knife drum.

In some embodiments, the dispenser further comprises a pair of roll holders positioned within the housing and configured to hold the at least one source of sheet product. The housing defines a cover and a back housing, and the cover includes at least one tab that extends into the housing. The at least one tab is configured to, when the cover is in a closed position, push at least one of the pair of roll holders into the housing such that the at least one of the pair of roll holders provides an increased surface force against a surface of the at least one source of sheet product.

BRIEF DESCRIPTION OF THE SEVERAL VIEWS OF THE DRAWINGS

Figure 1:
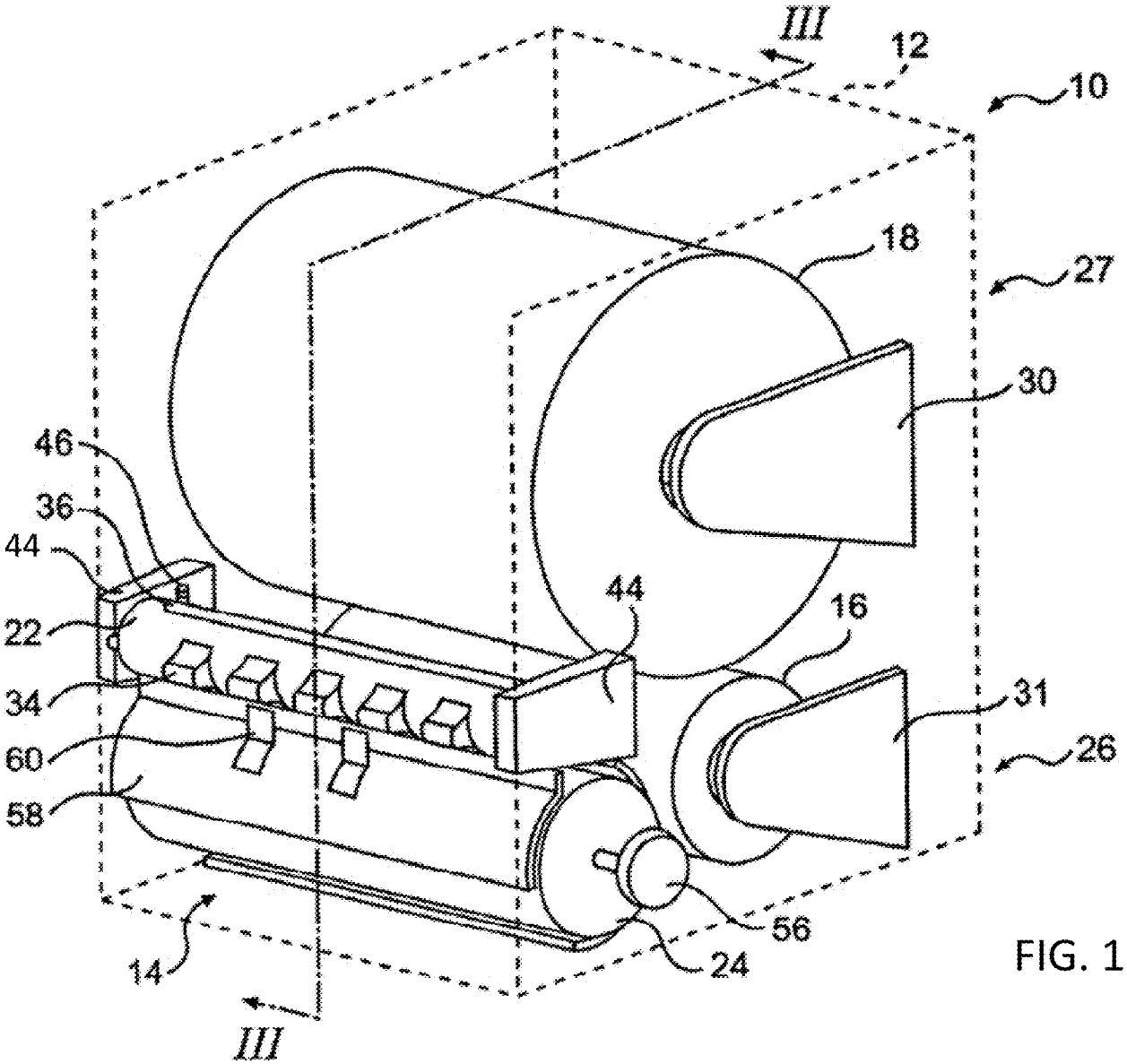
Figure 2:
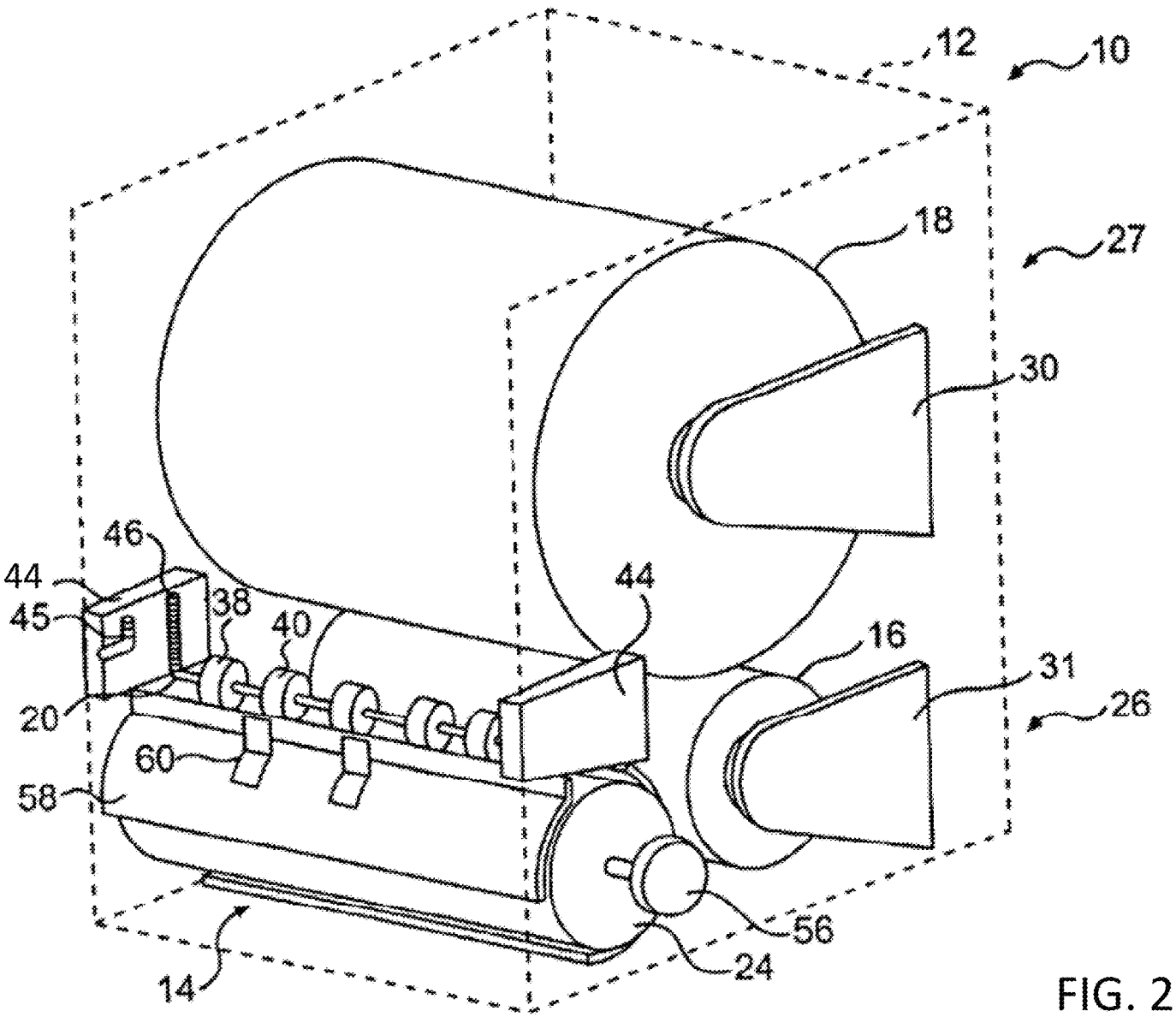
Figure 3:
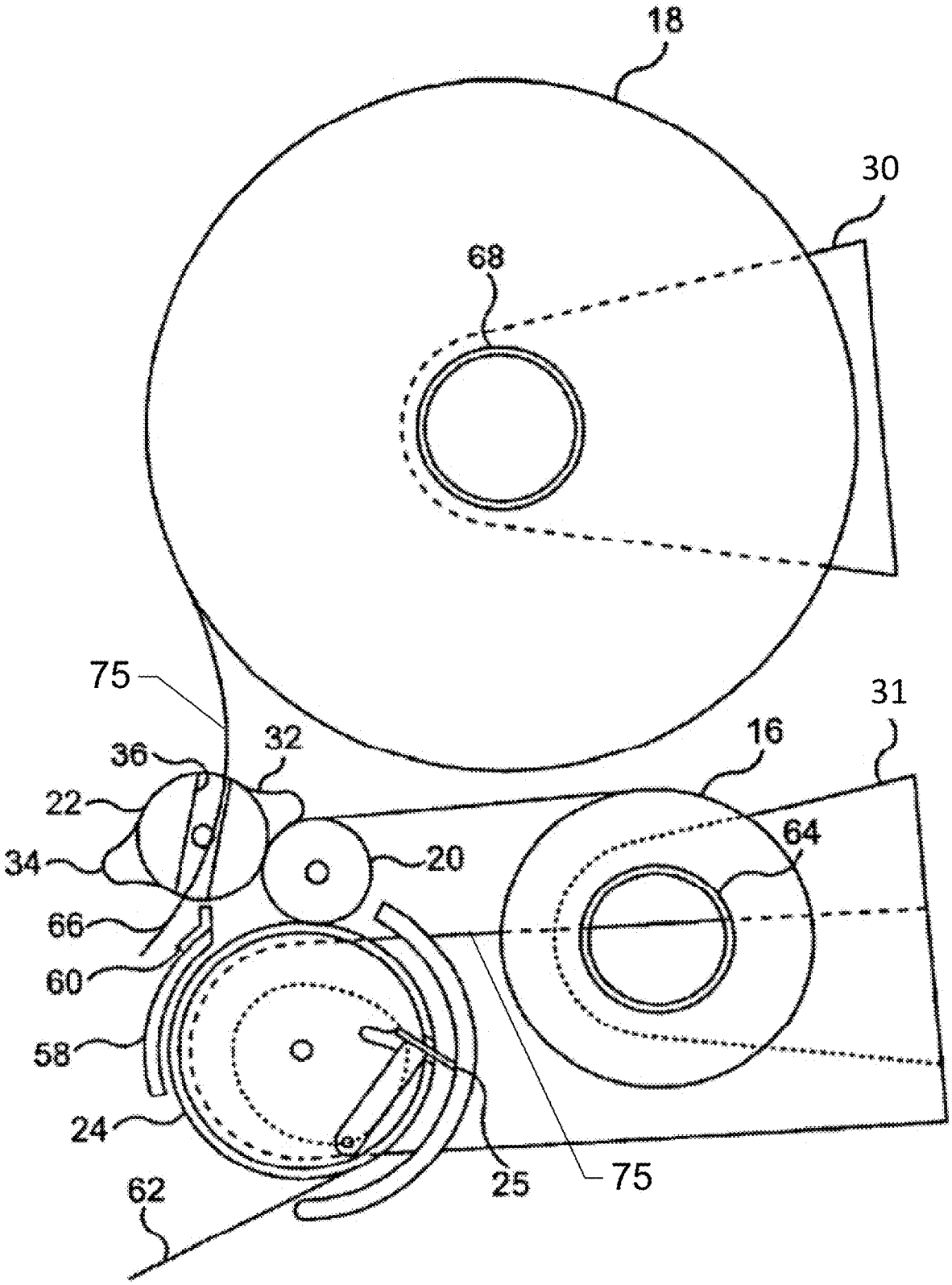
Figure 3A:
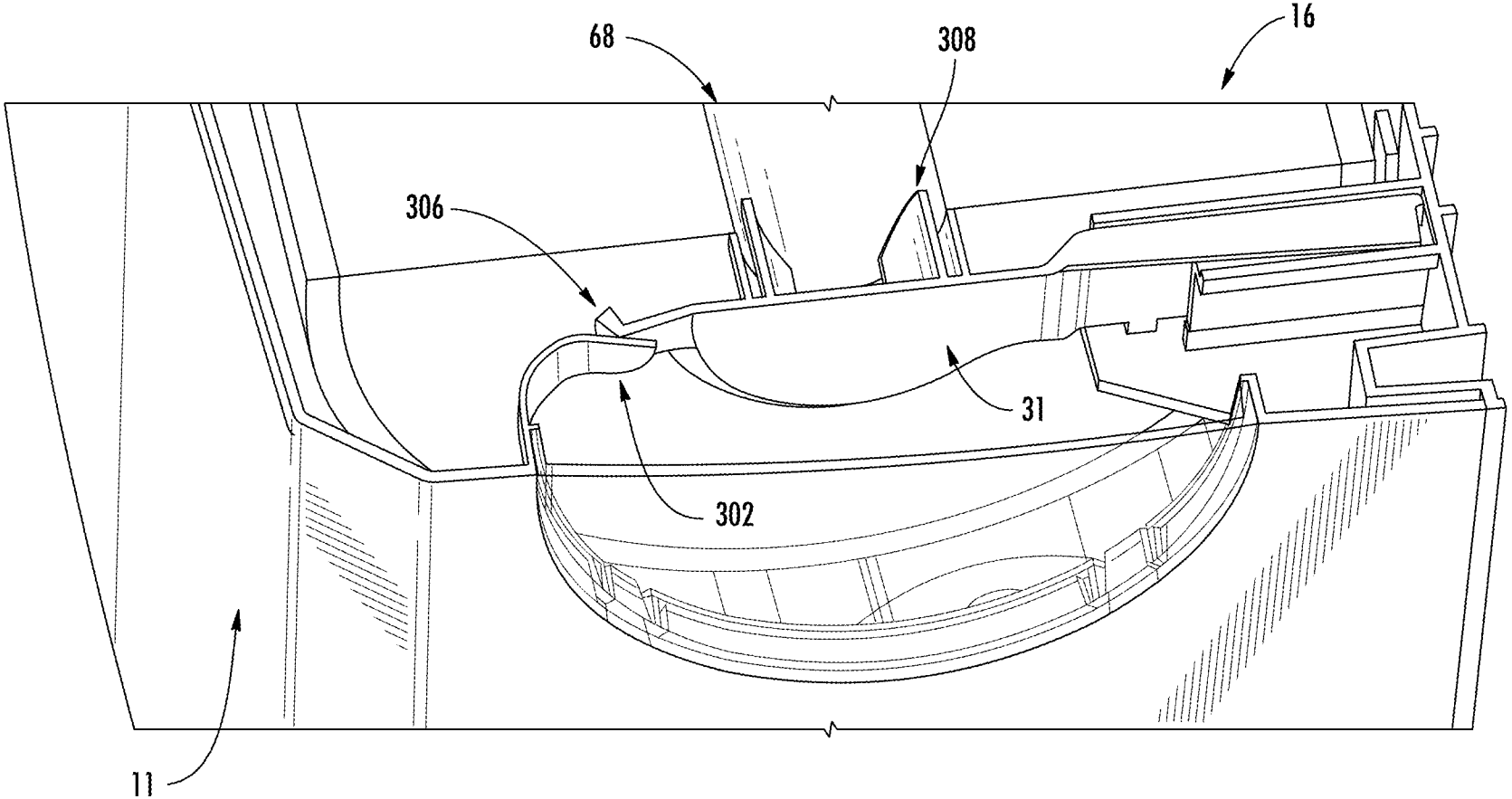
Figure 4:
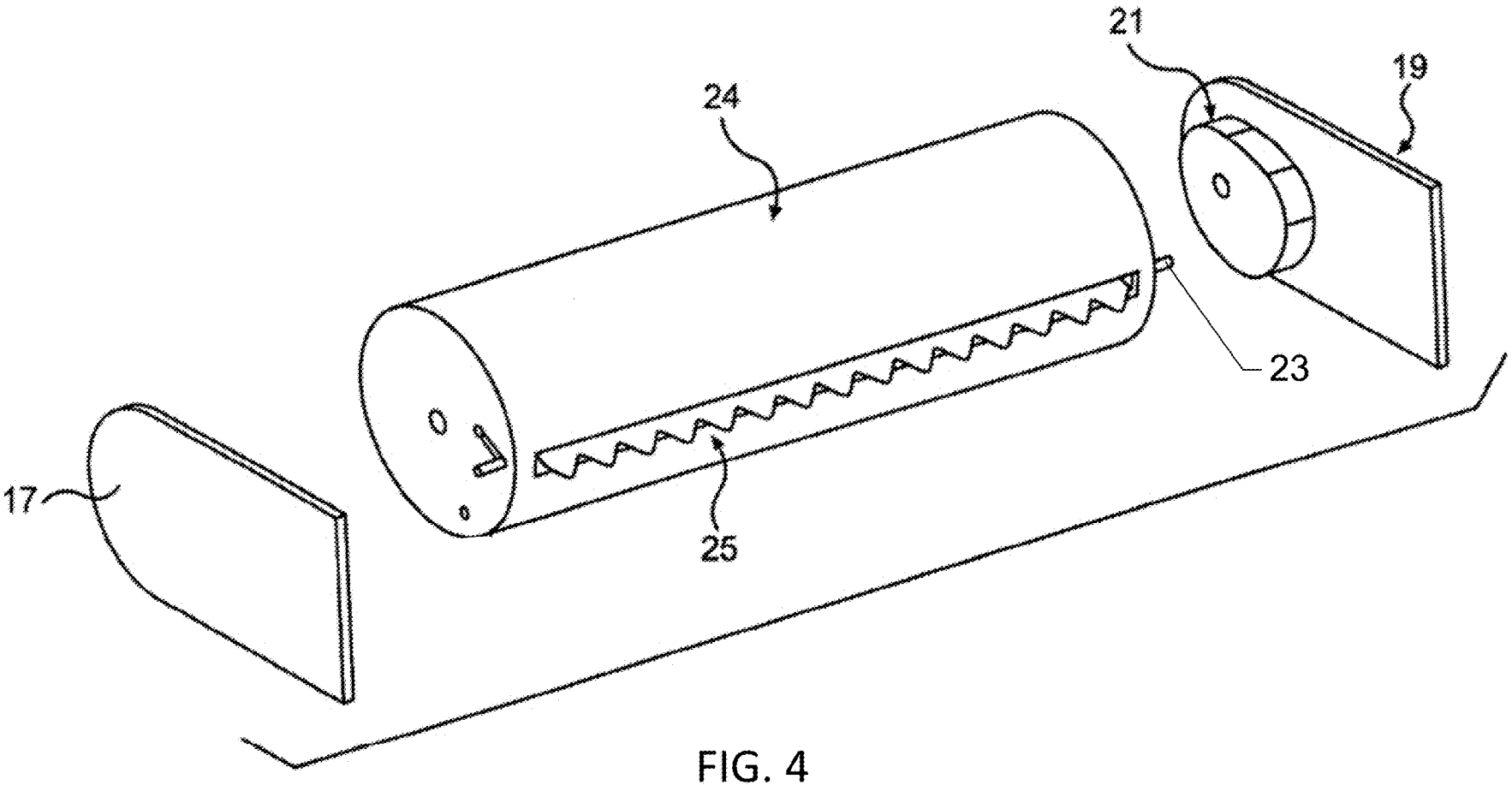
Figure 5:
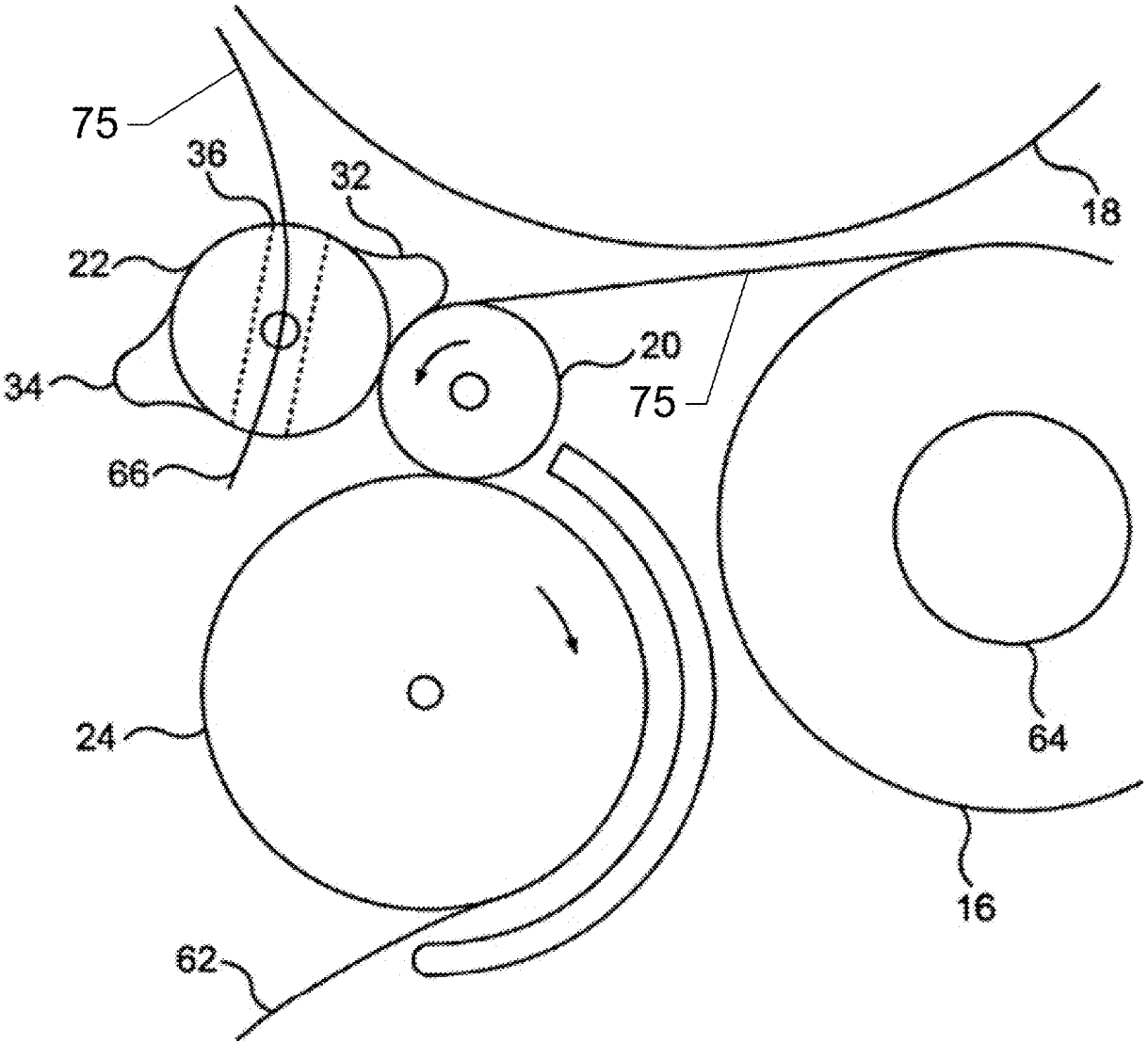
Figure 6:
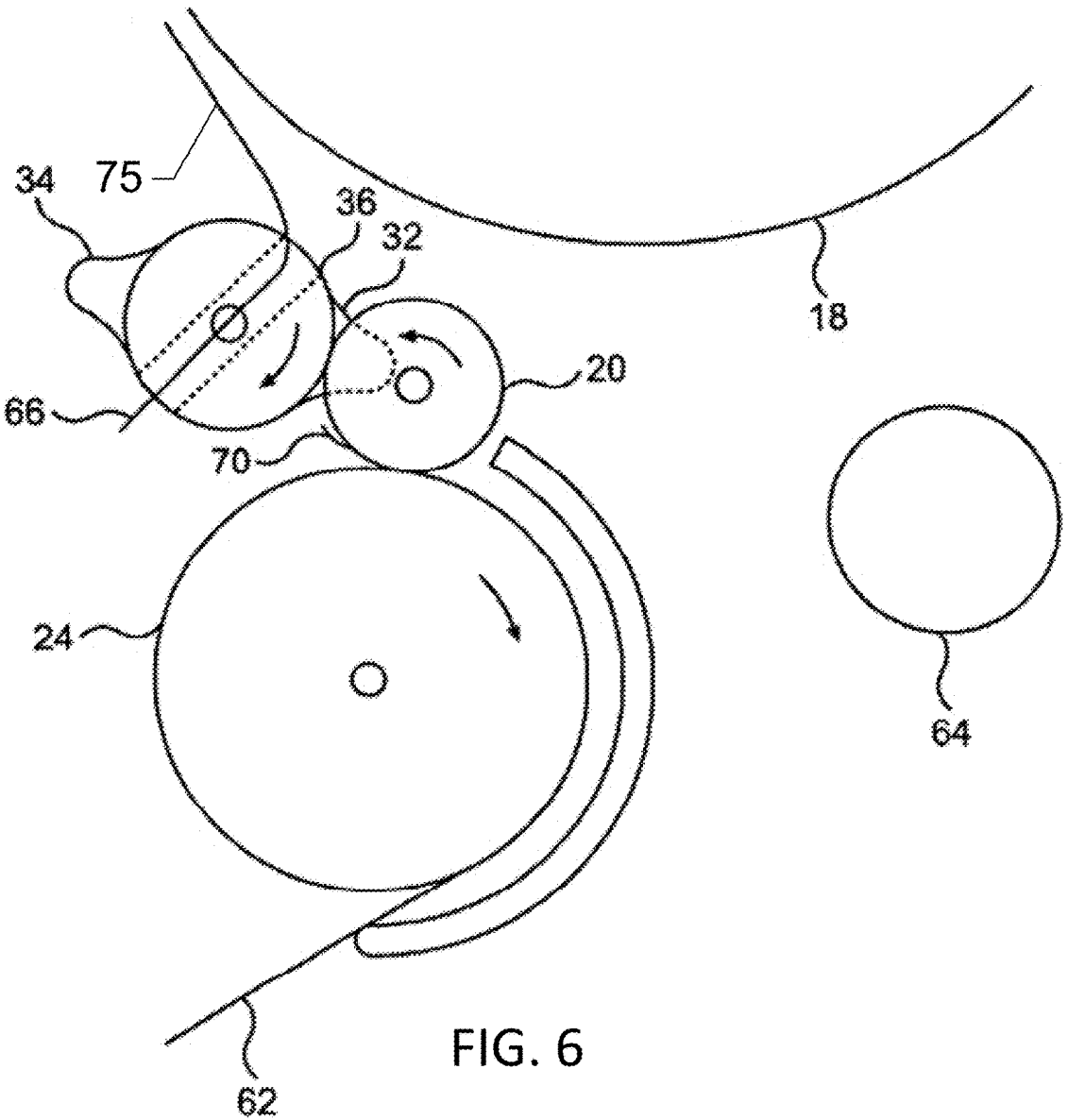
Figure 7:
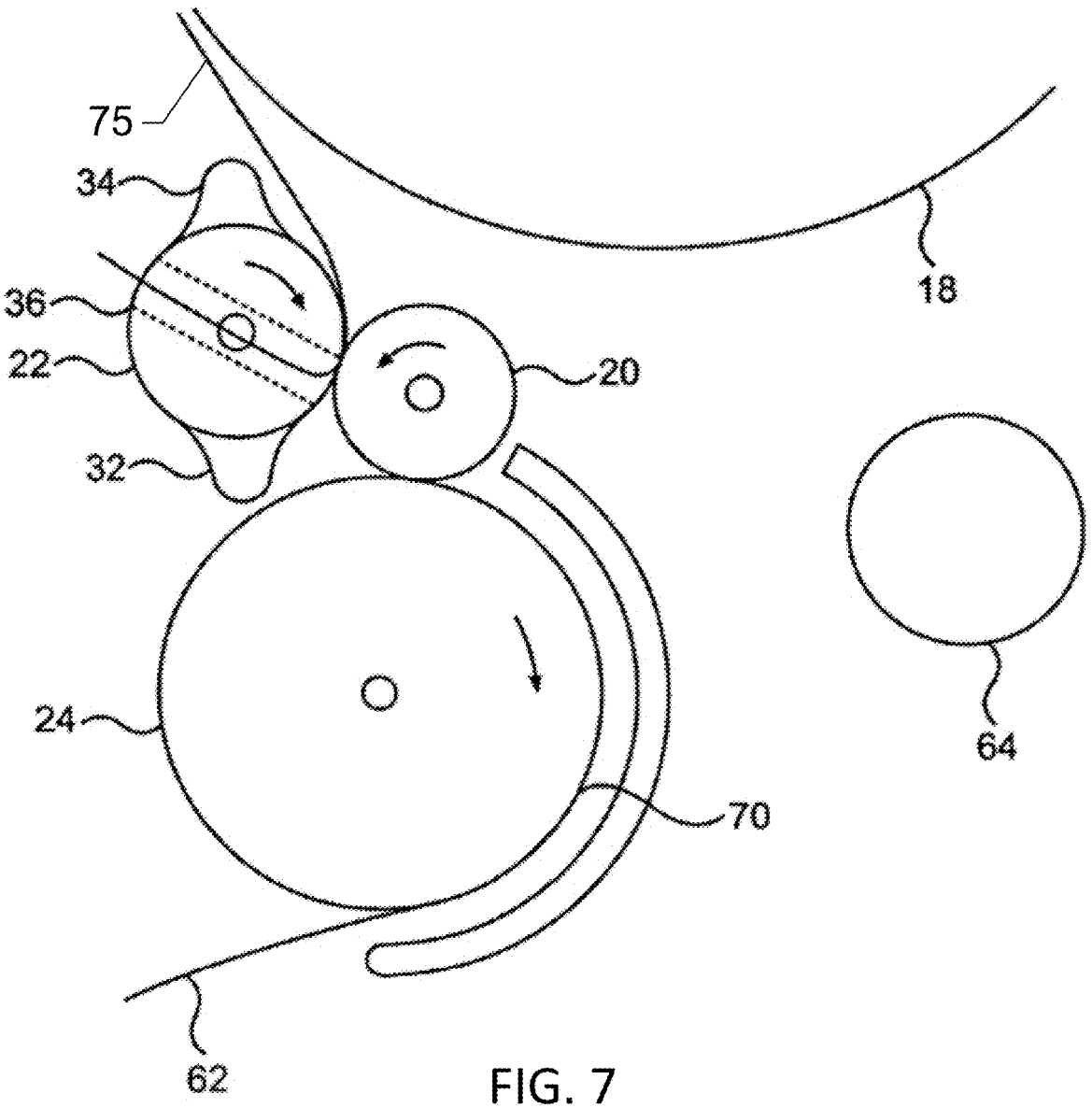
Figure 8:
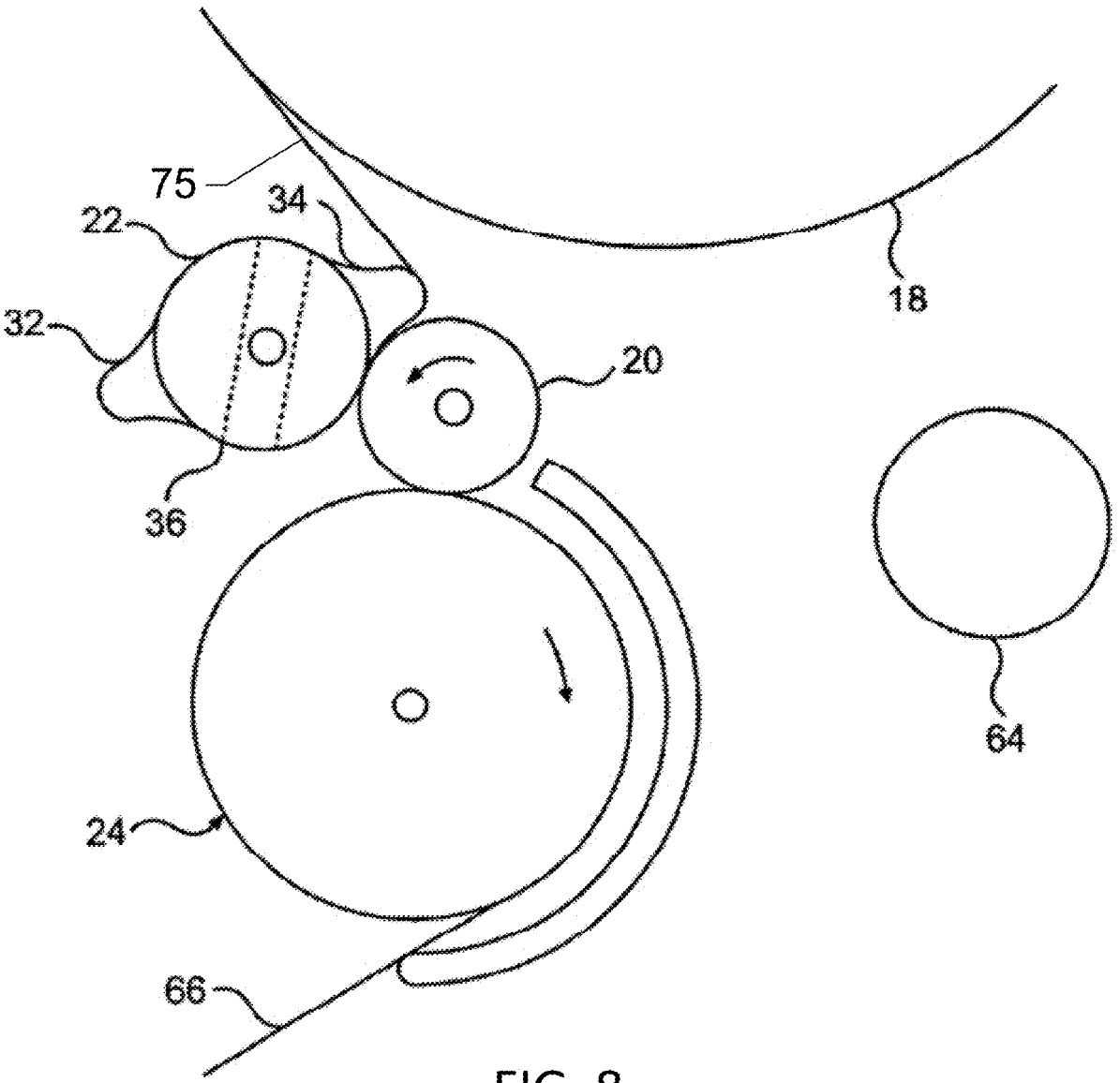
Figure 9:
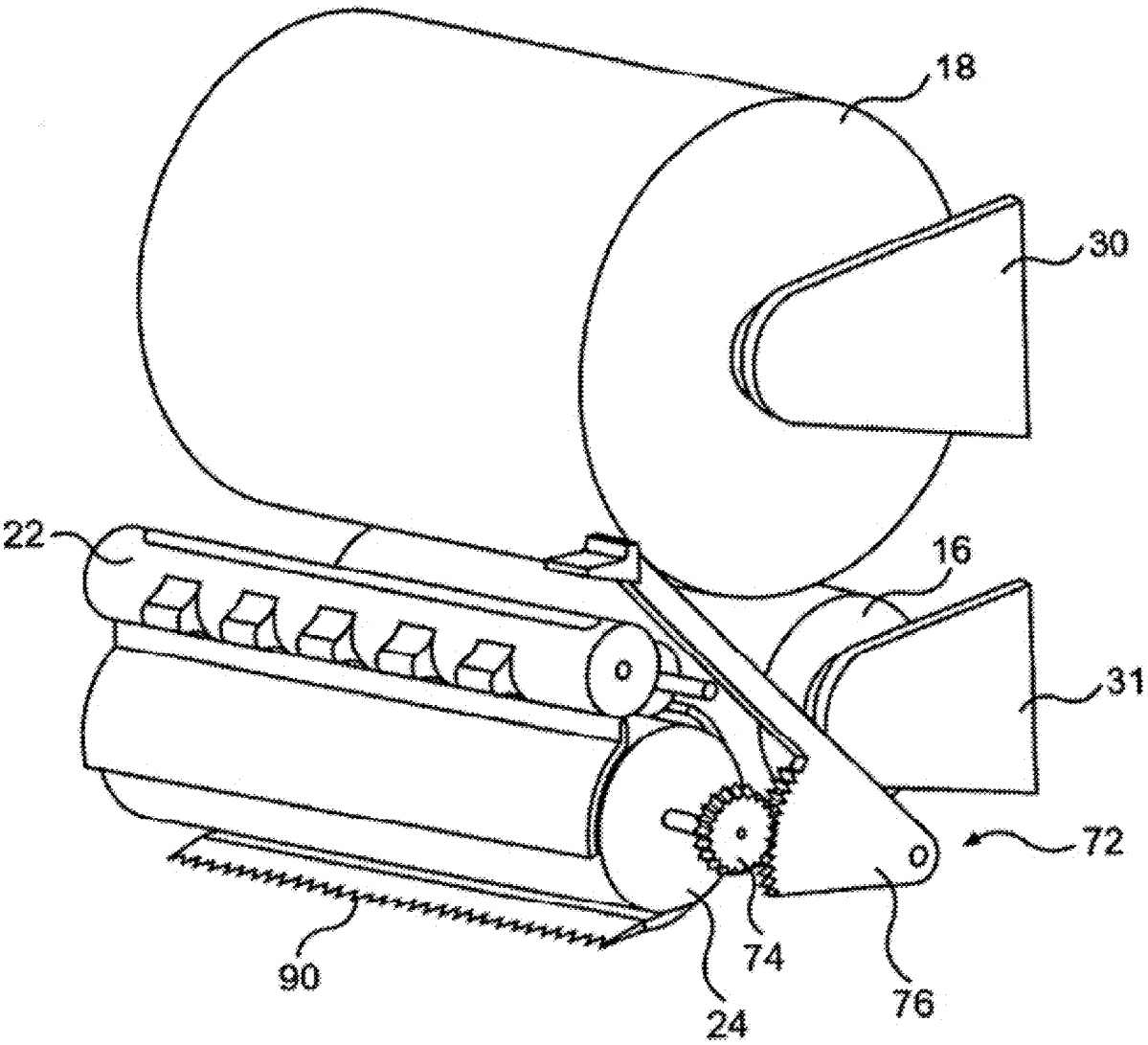
Figure 10:
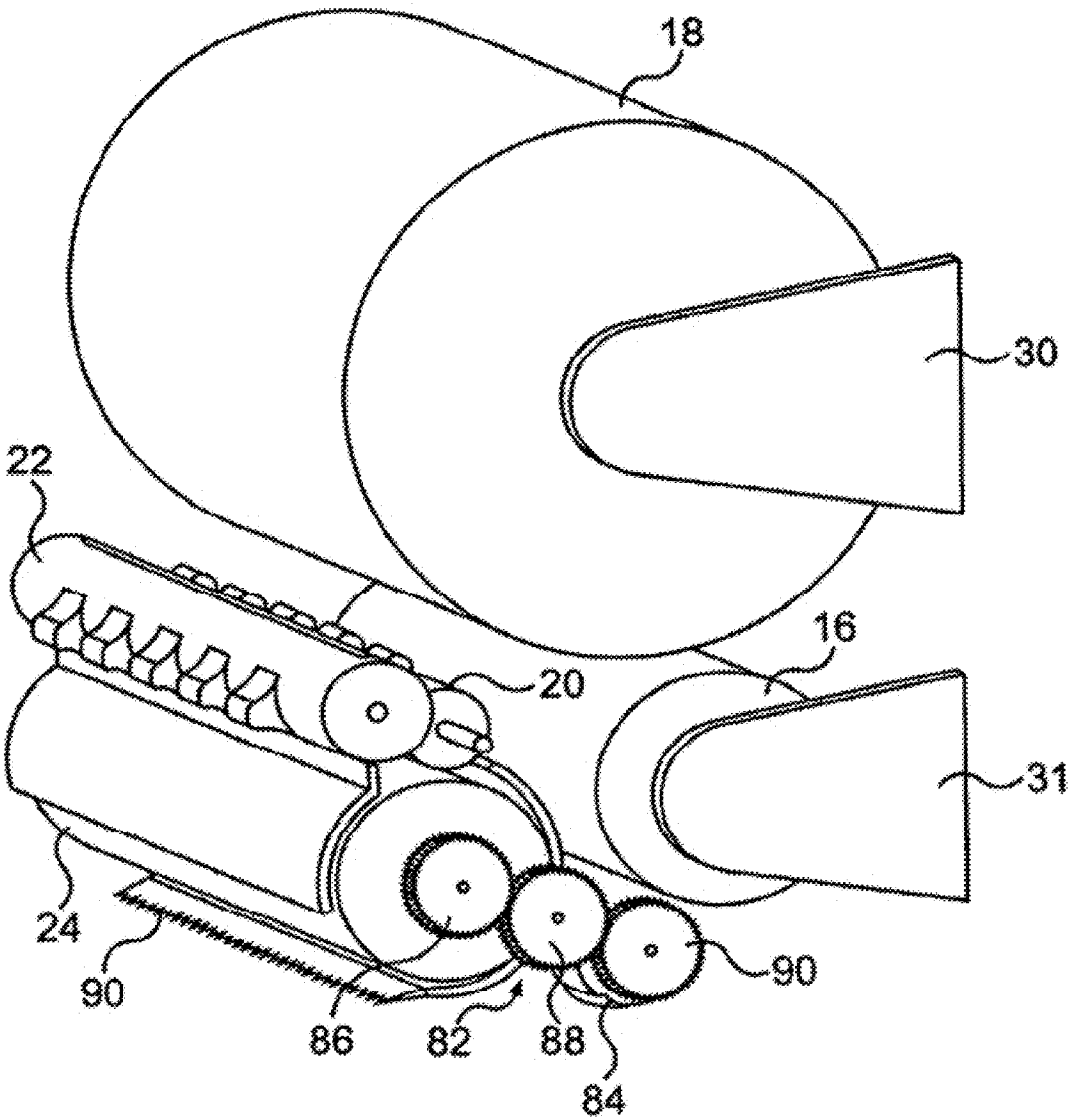
Figure 11A:
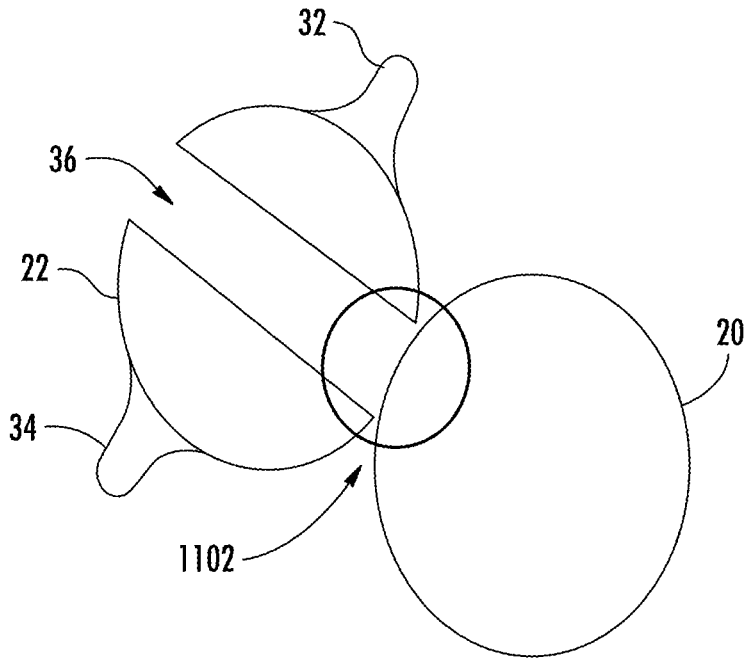
Figure 11B:
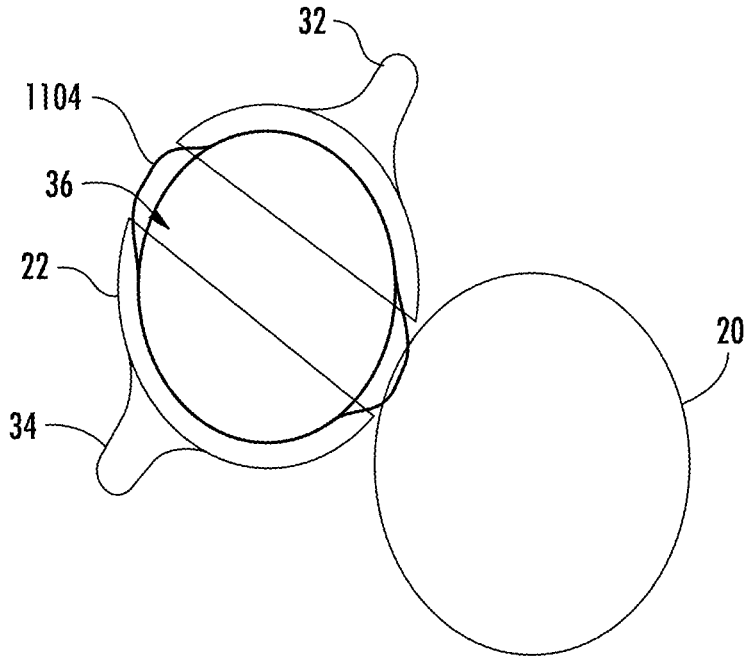
Figure 11C:
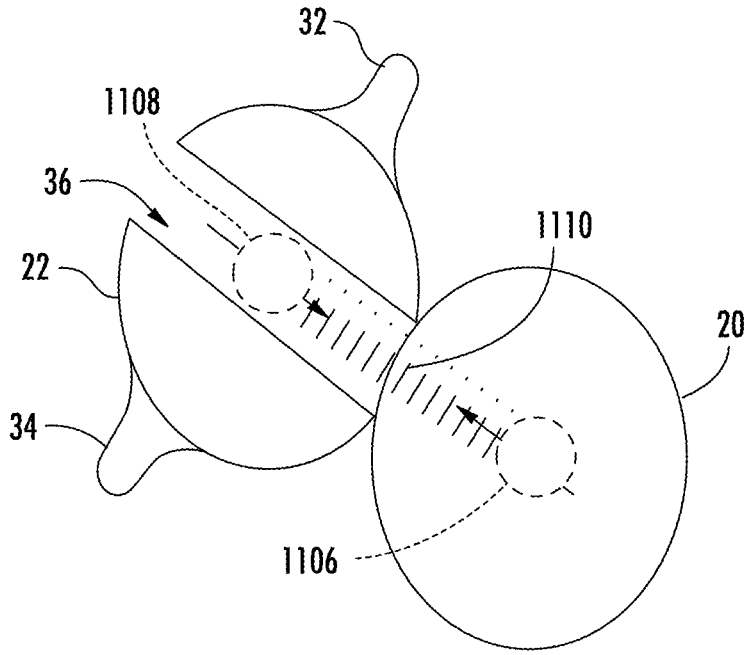
Figure 11D:
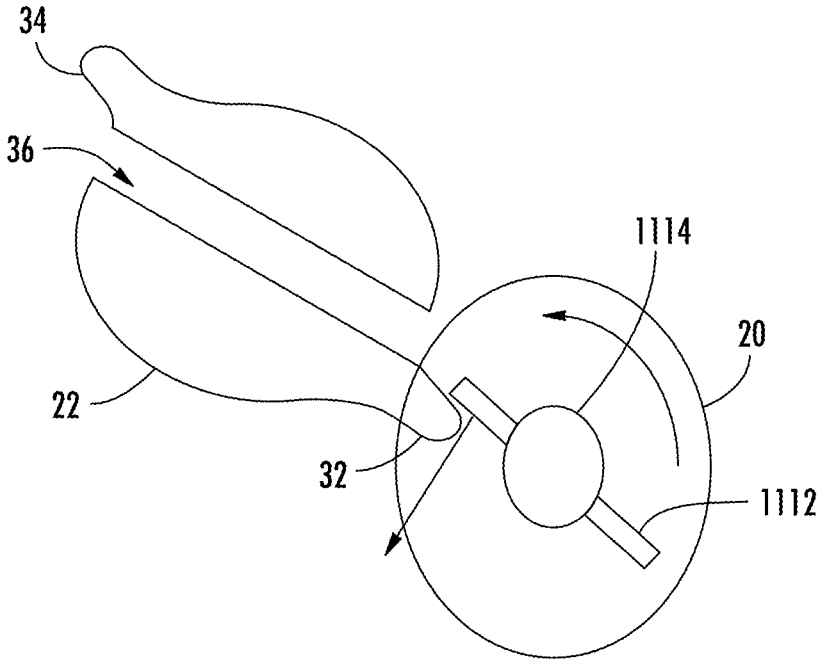
Figure 12:
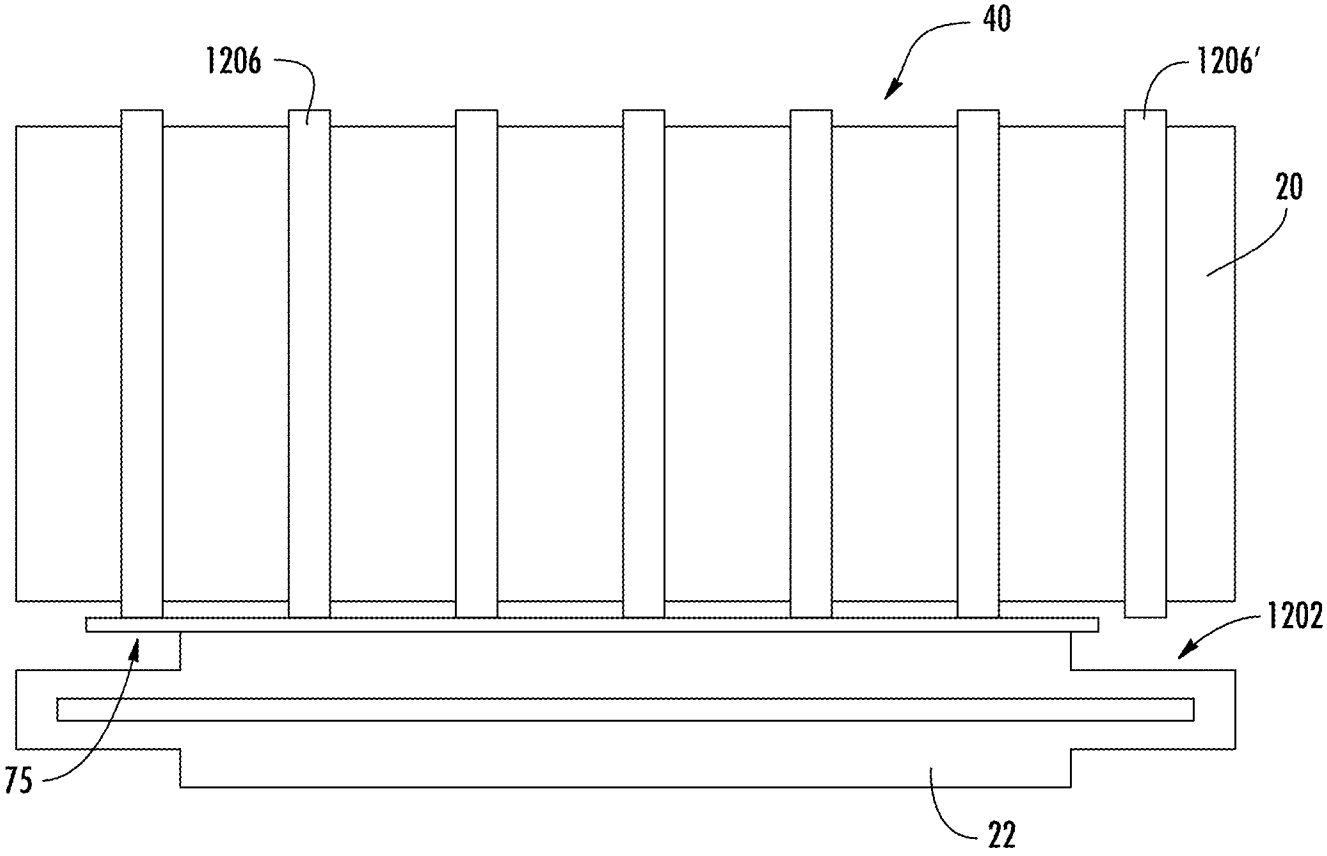
Figure 13:
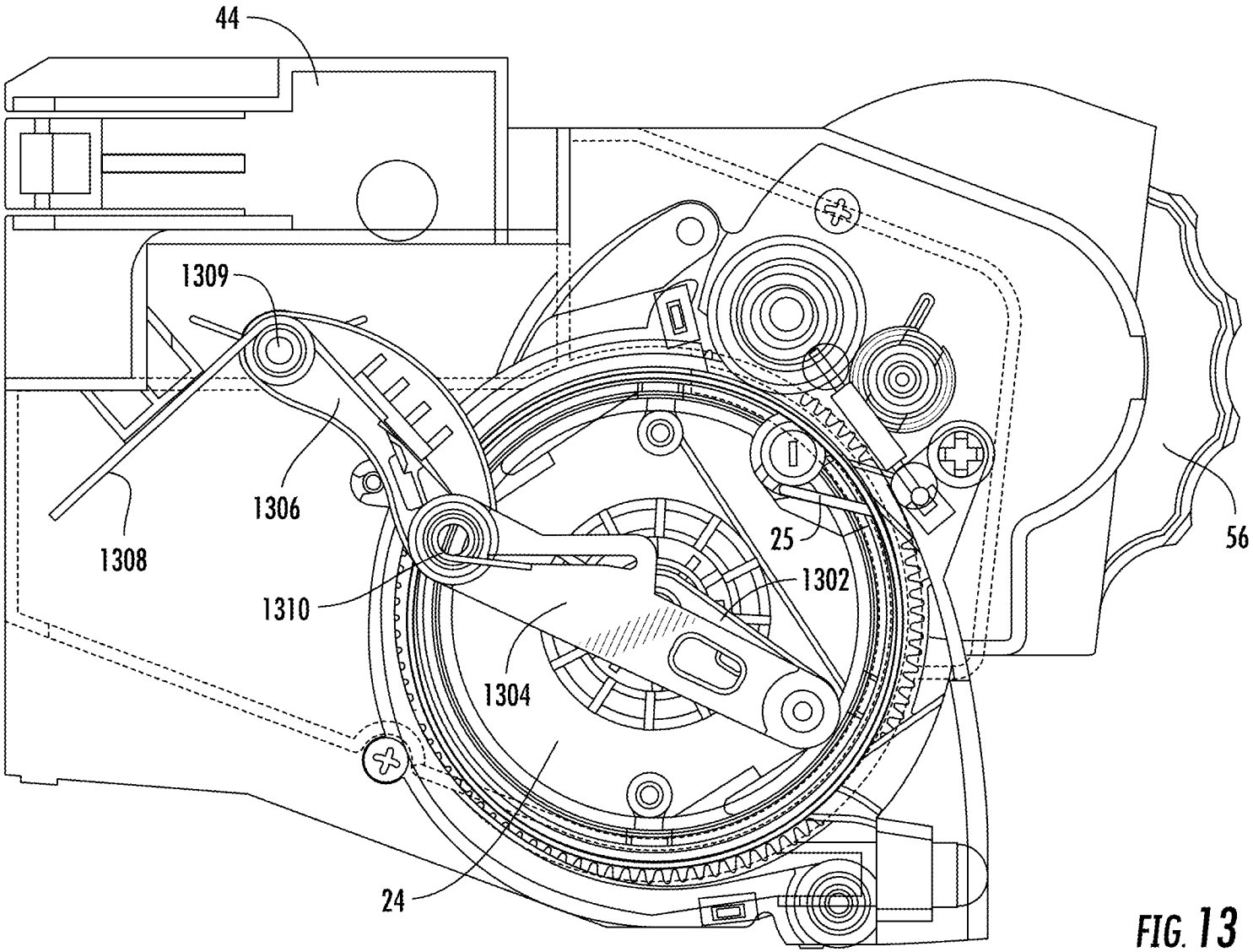
Figure 14:
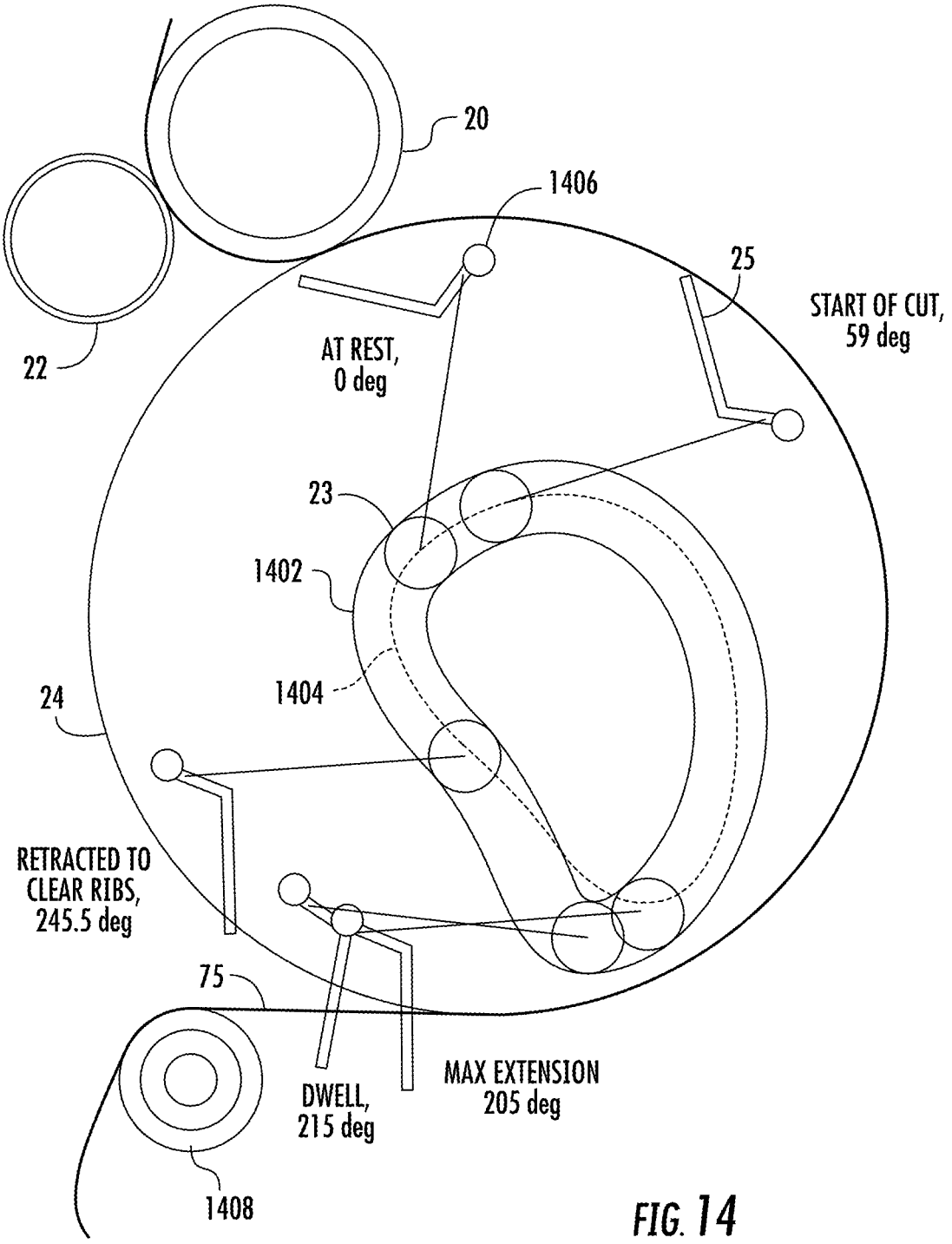
Figure 15A:
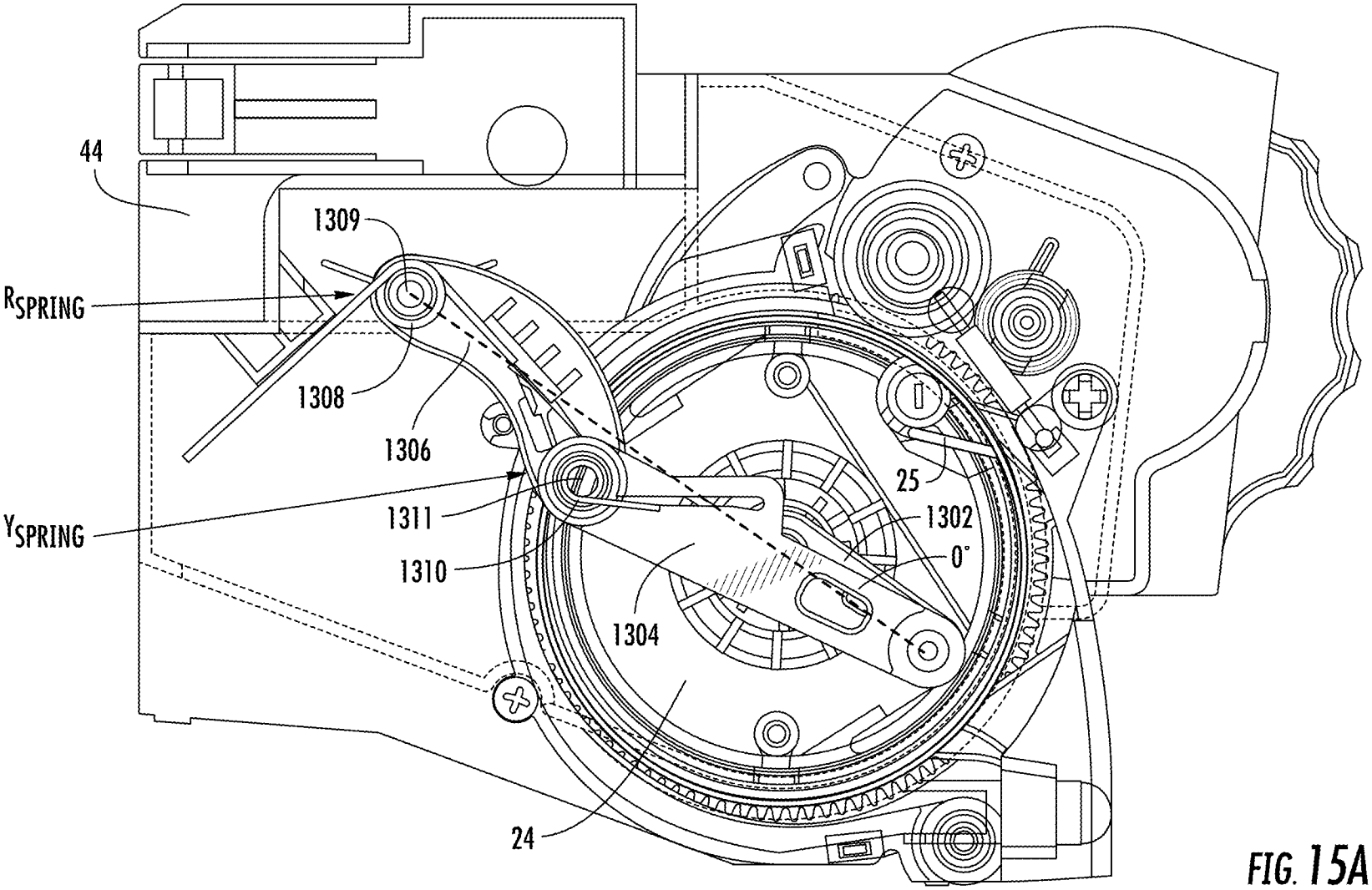
Figure 15B:
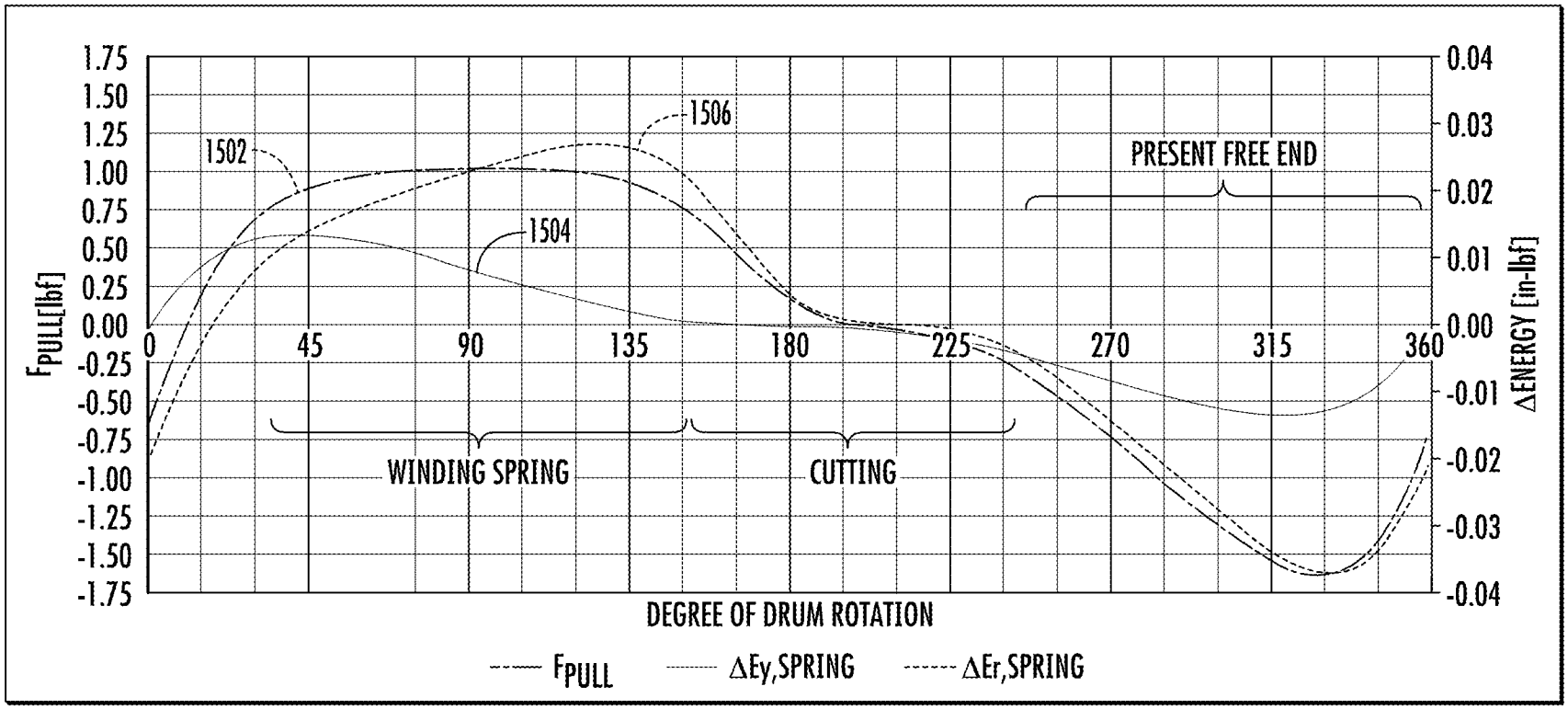
Figure 22:
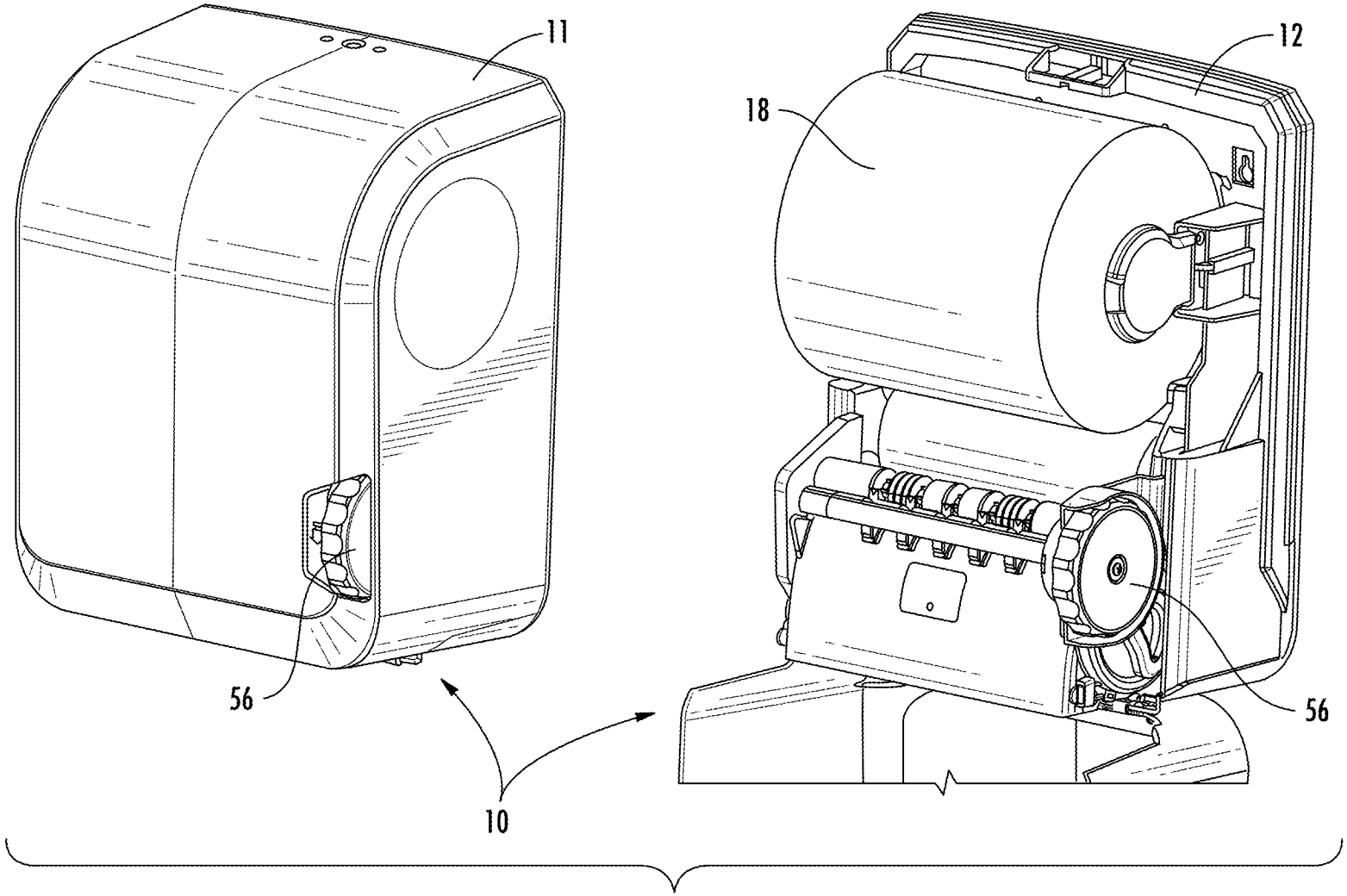
Figure 23:
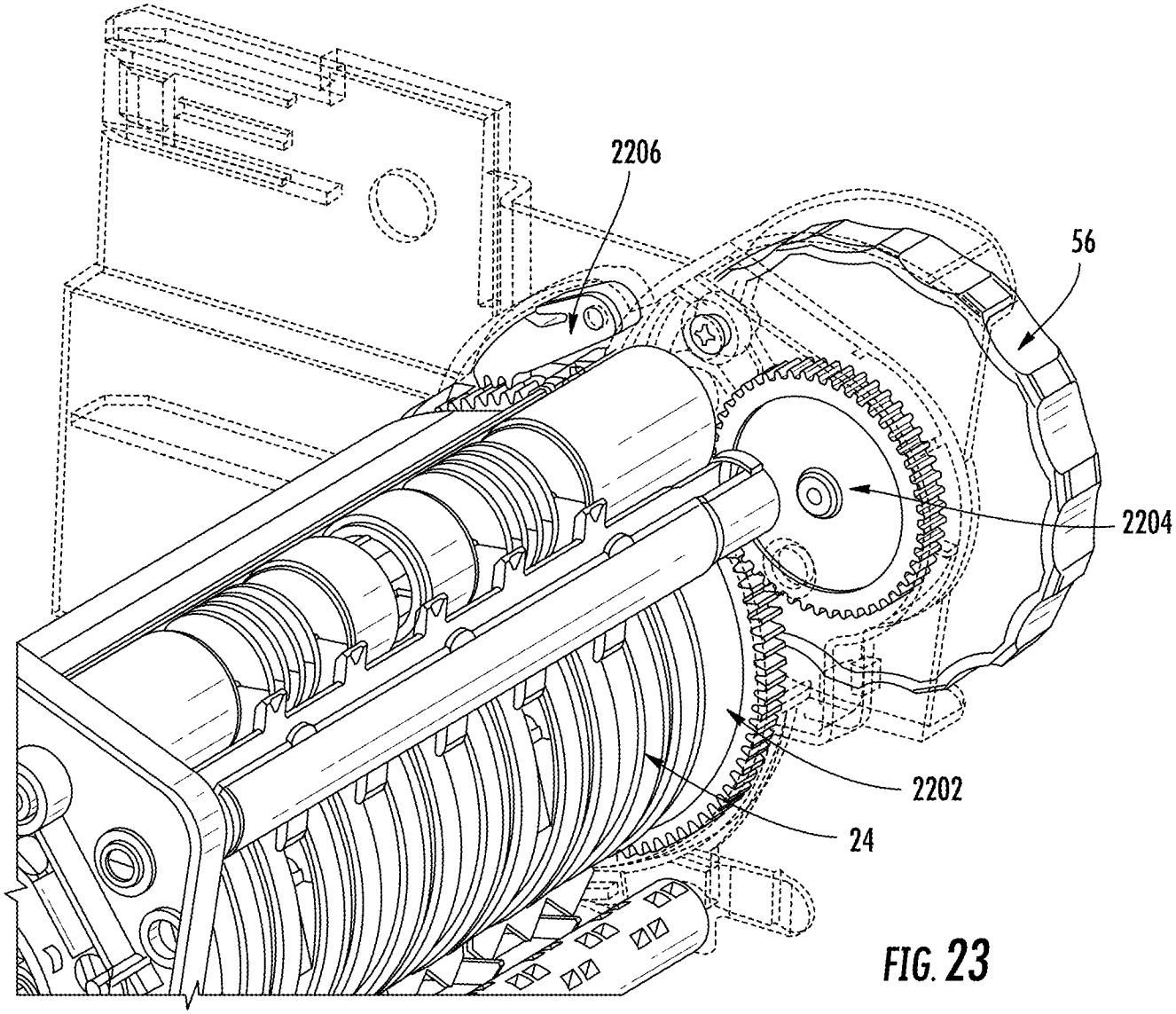
Figure 24:
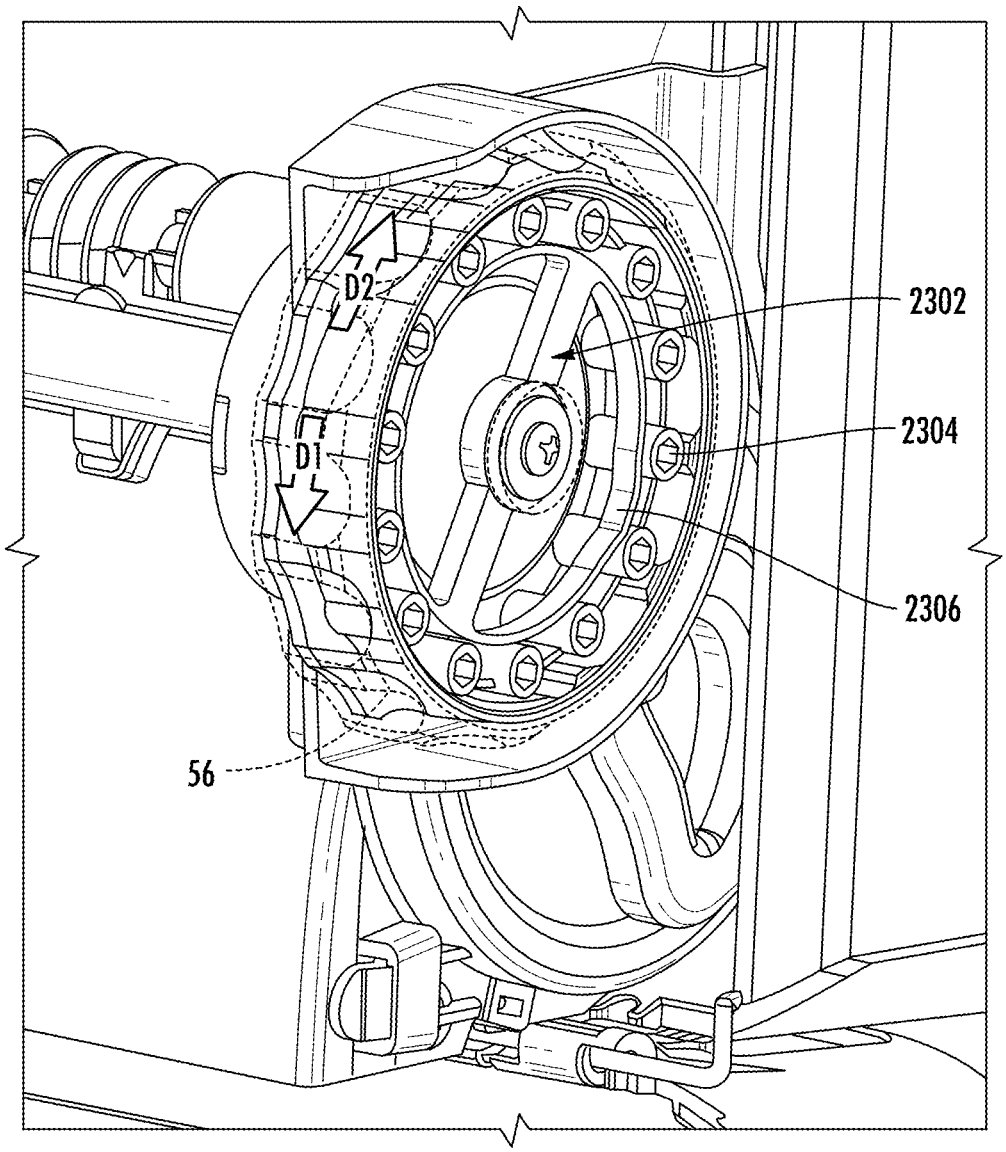
Figure 26:
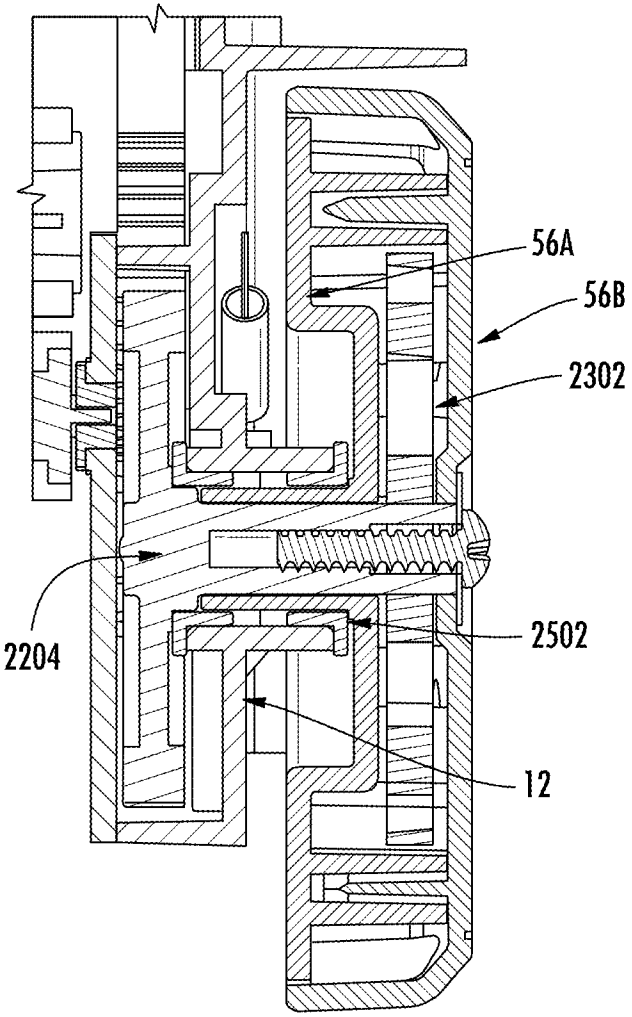
Figure 25:
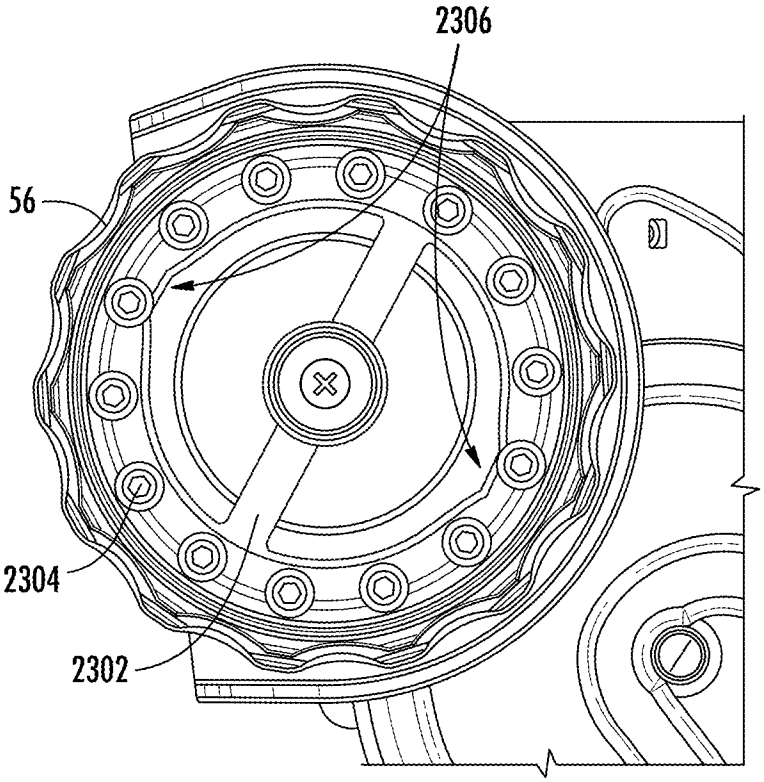
Figure 27:
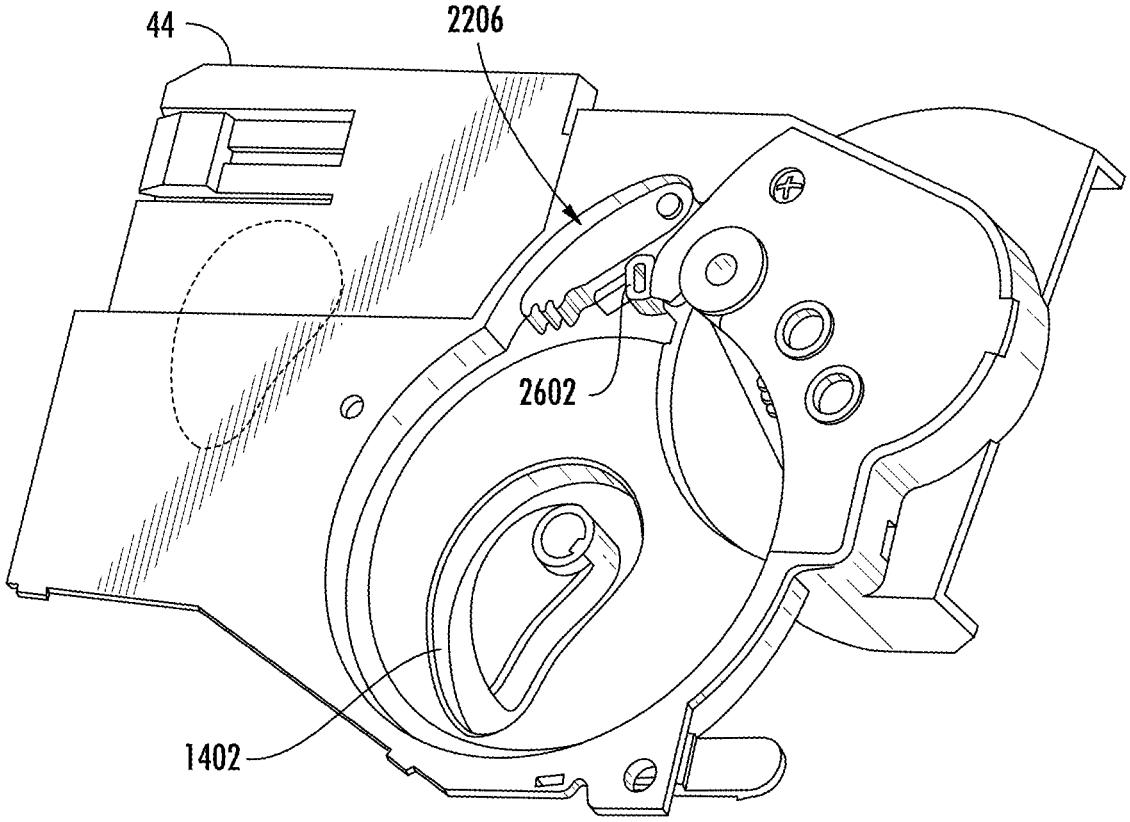
Figure 28:
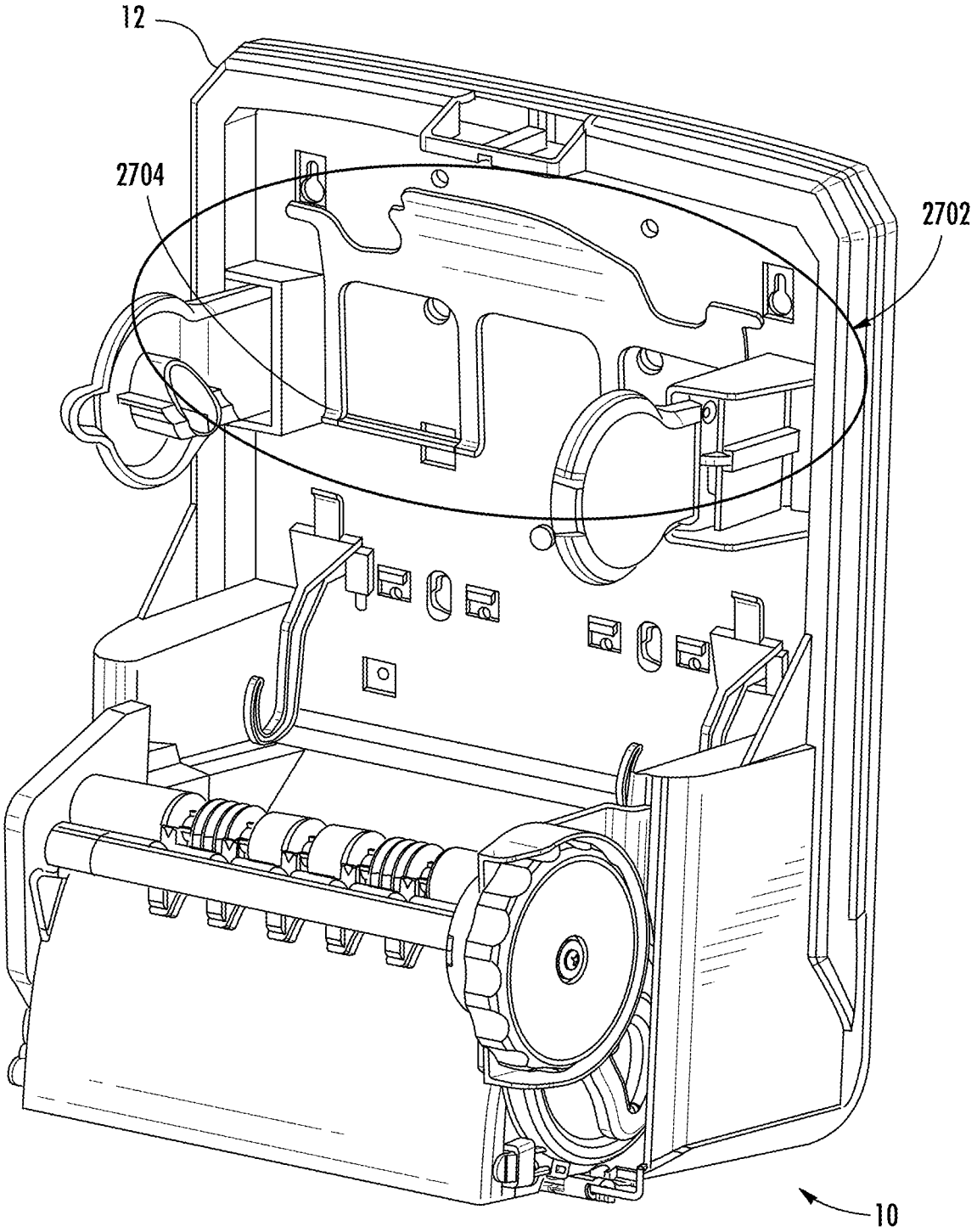
Figure 29:
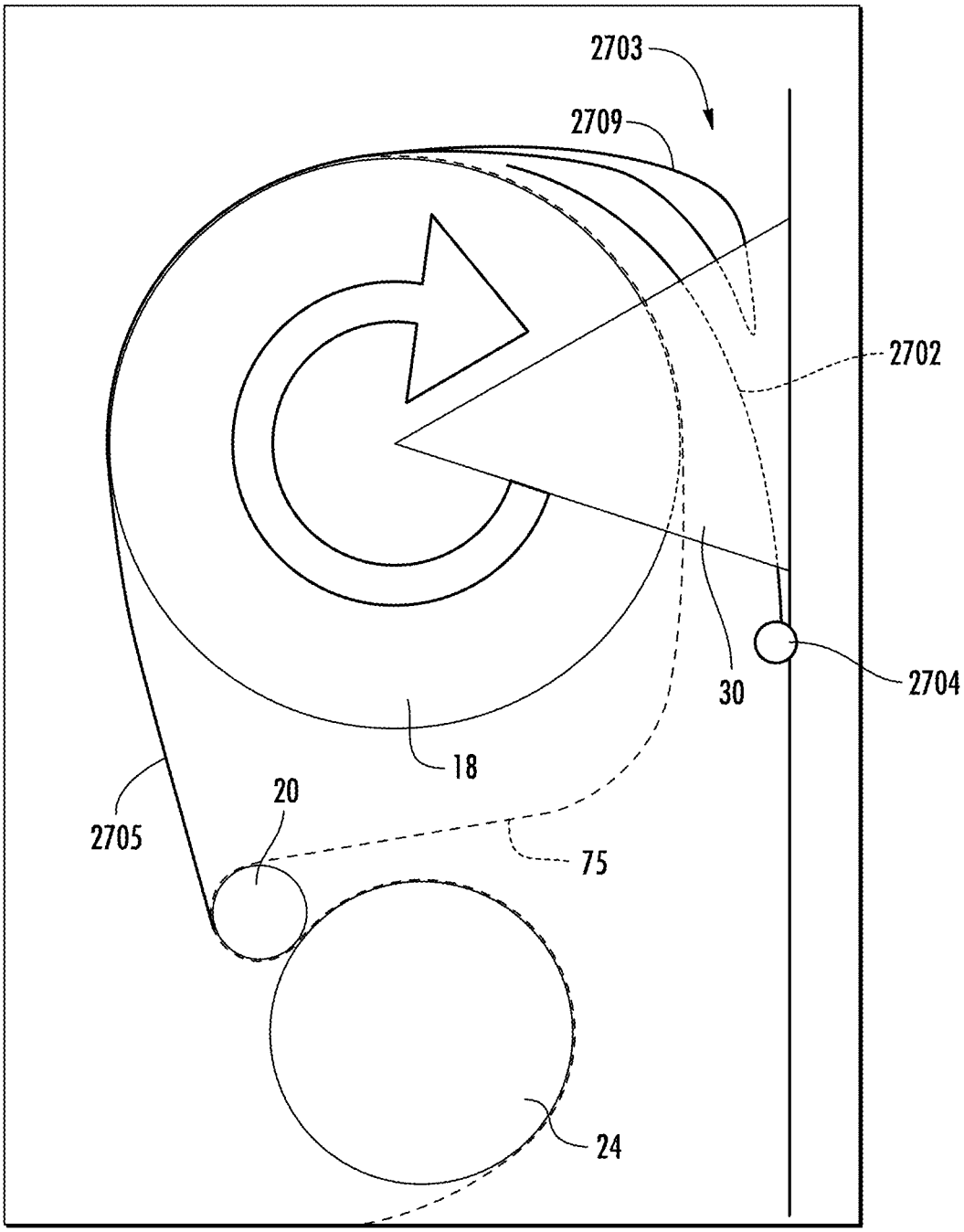
Figure 30:
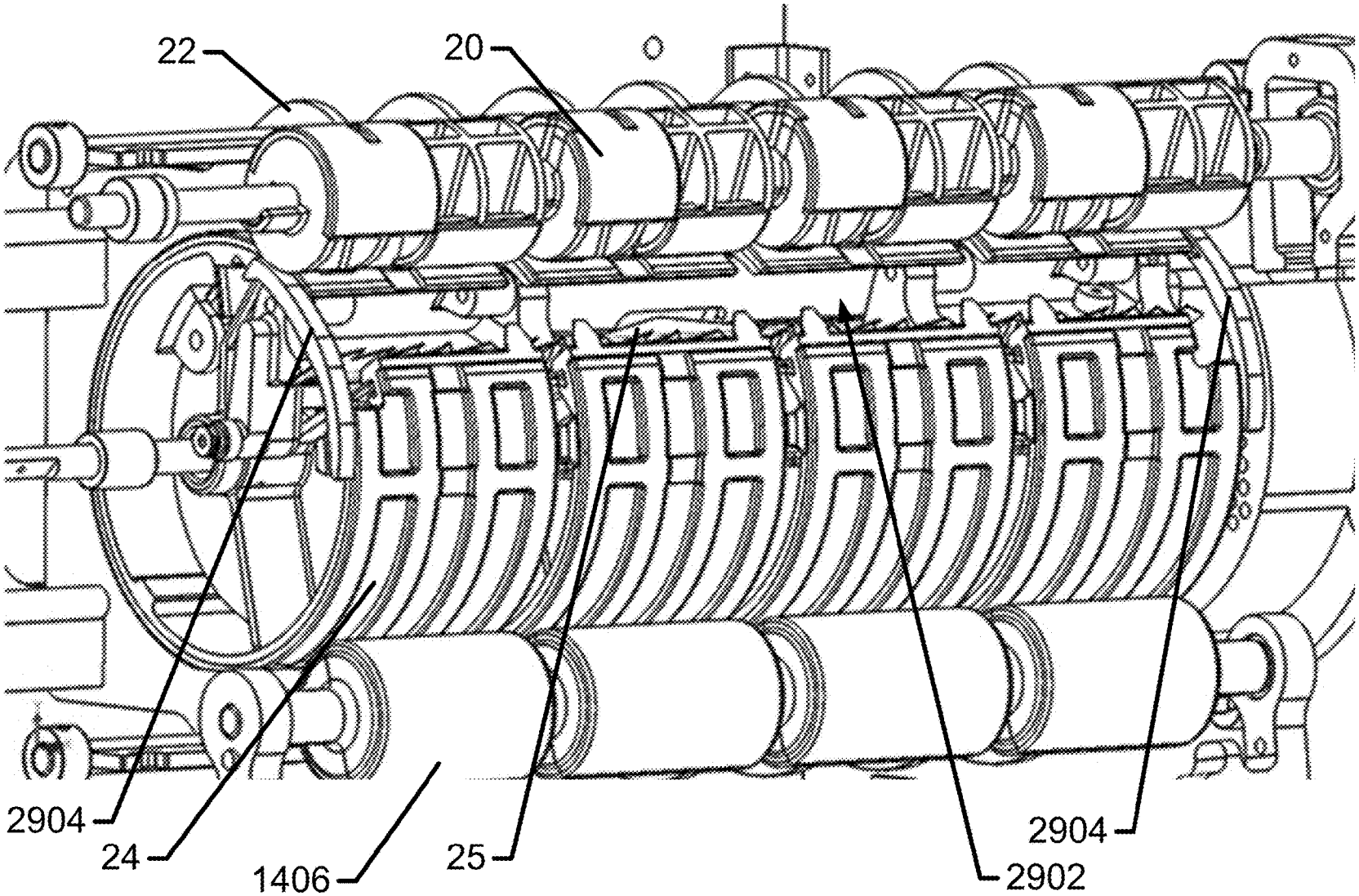
Figure 31:
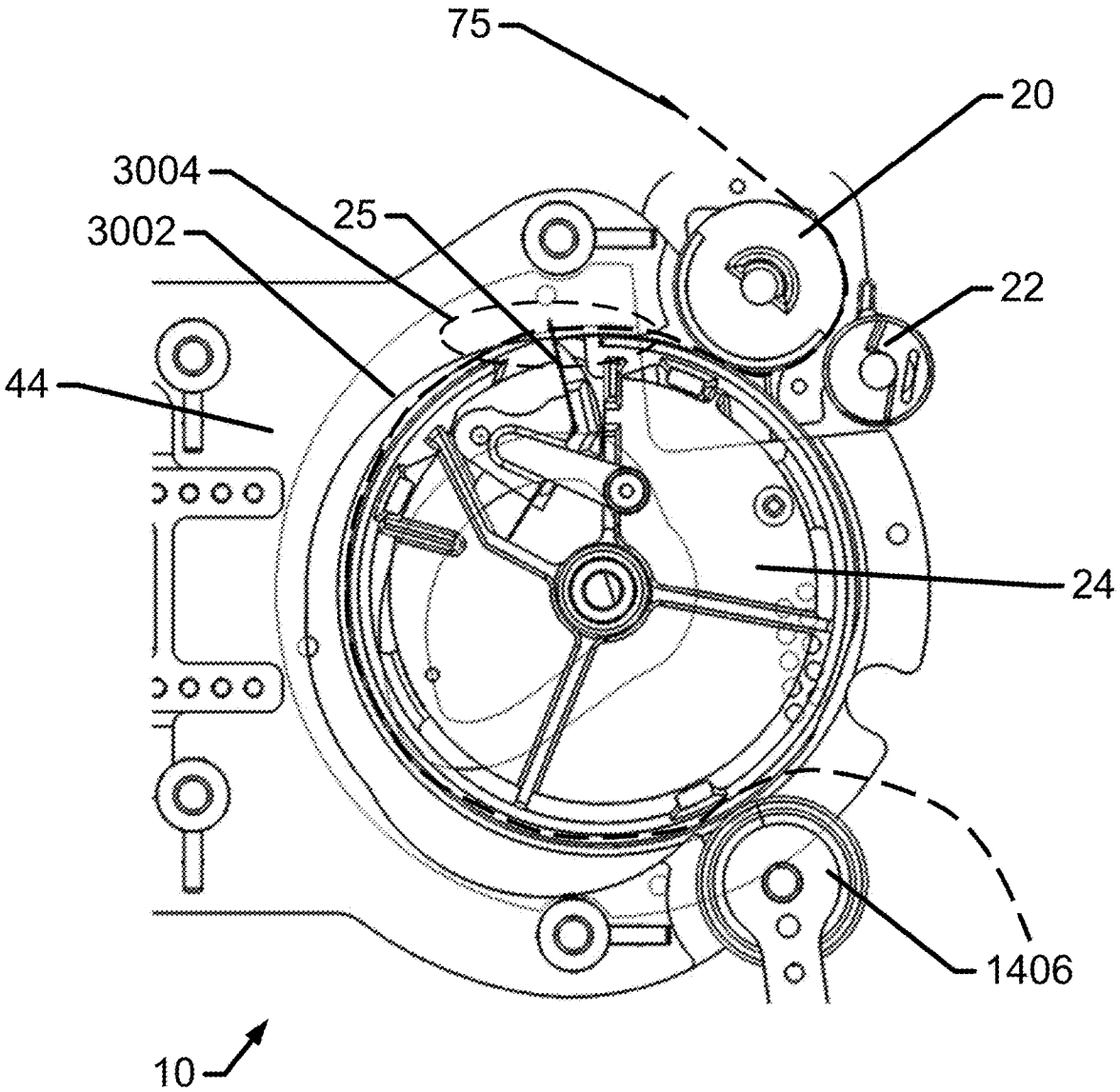
Figure 32:
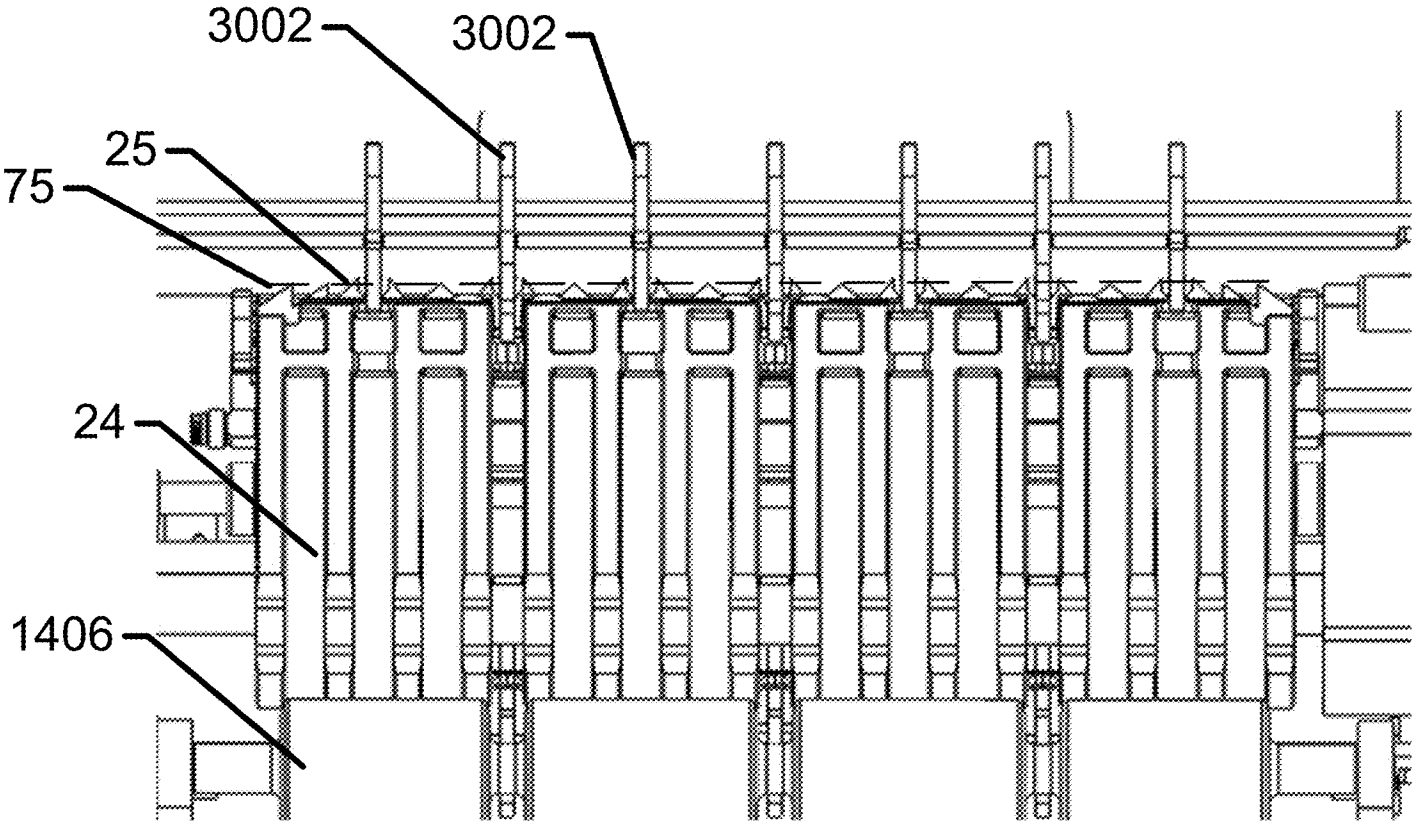
Figure 33:
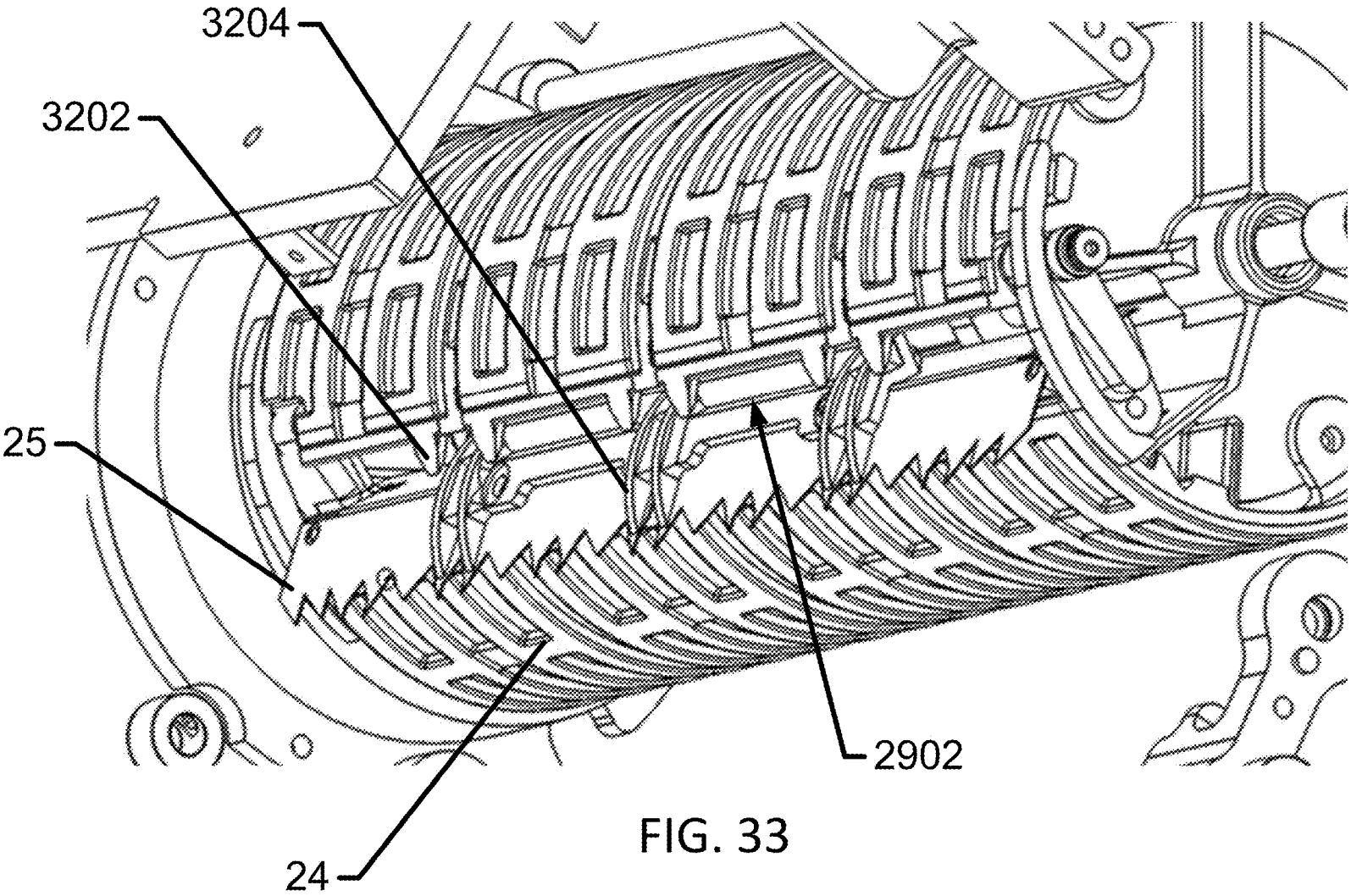
Figure 34:
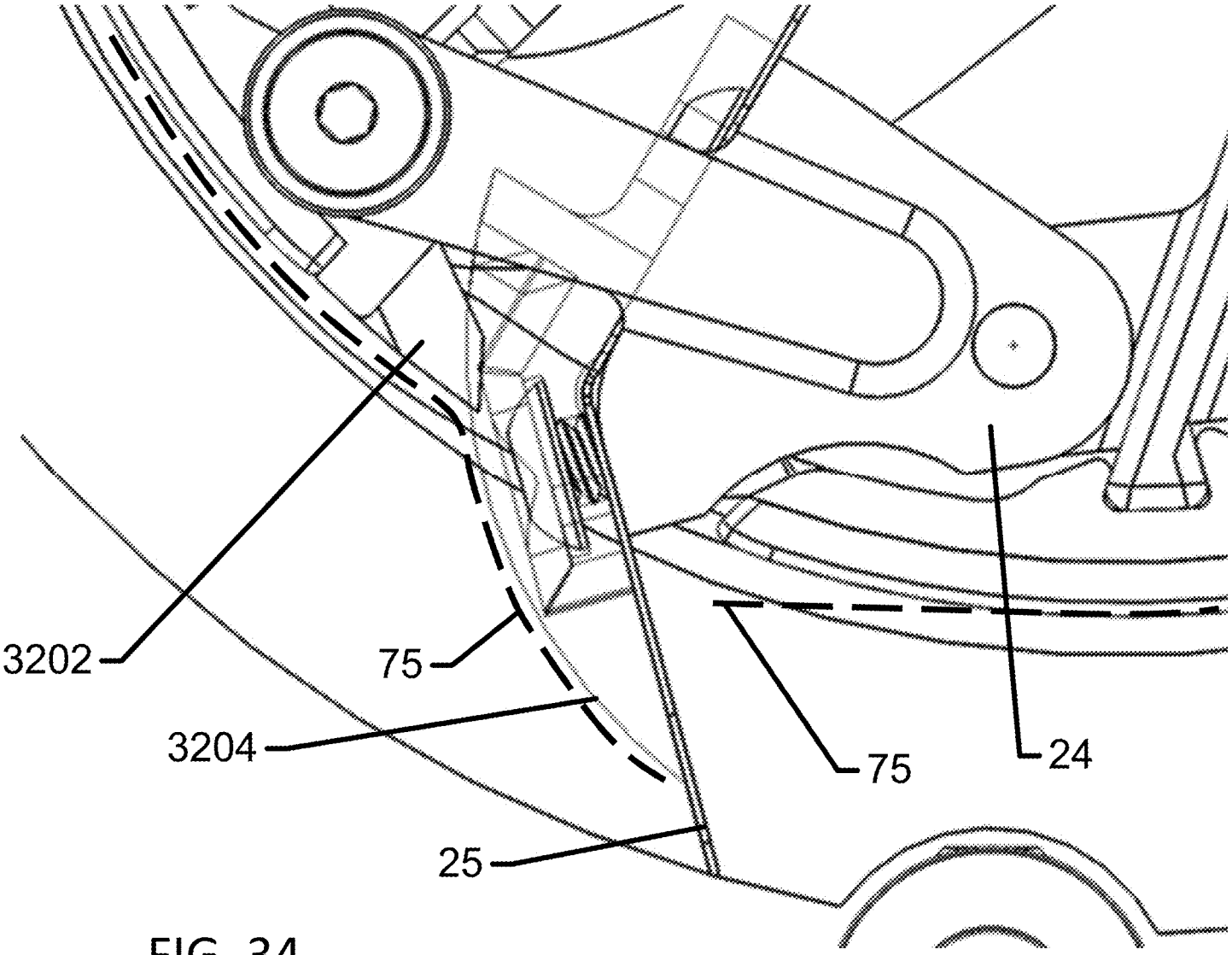
Figure 35:
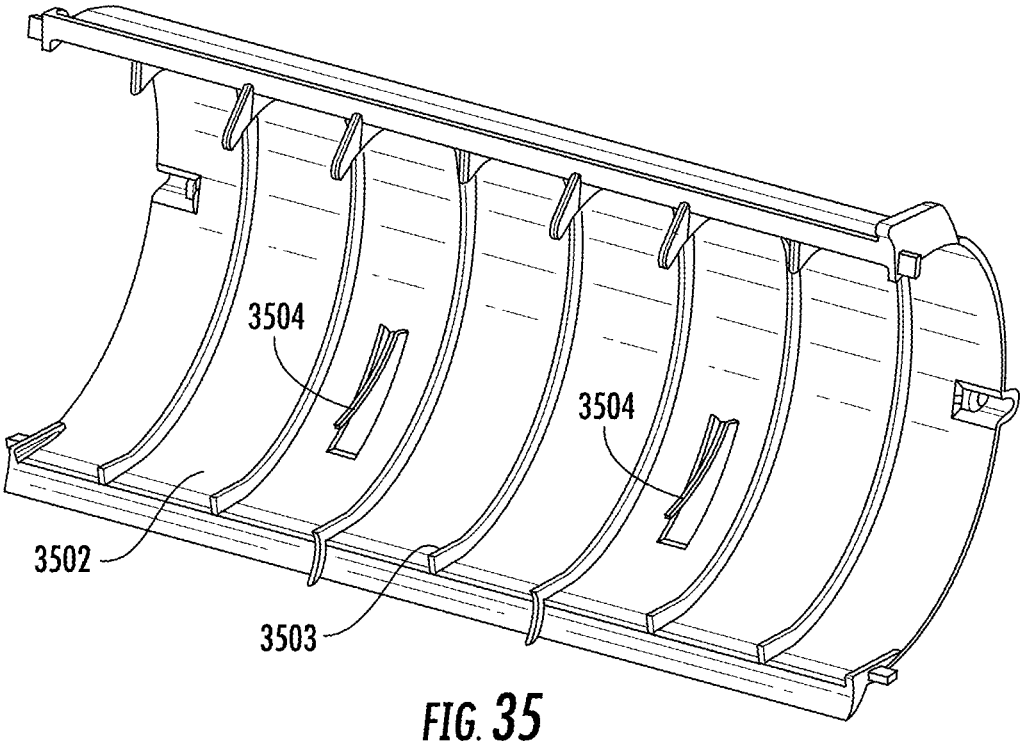
Figure 36:
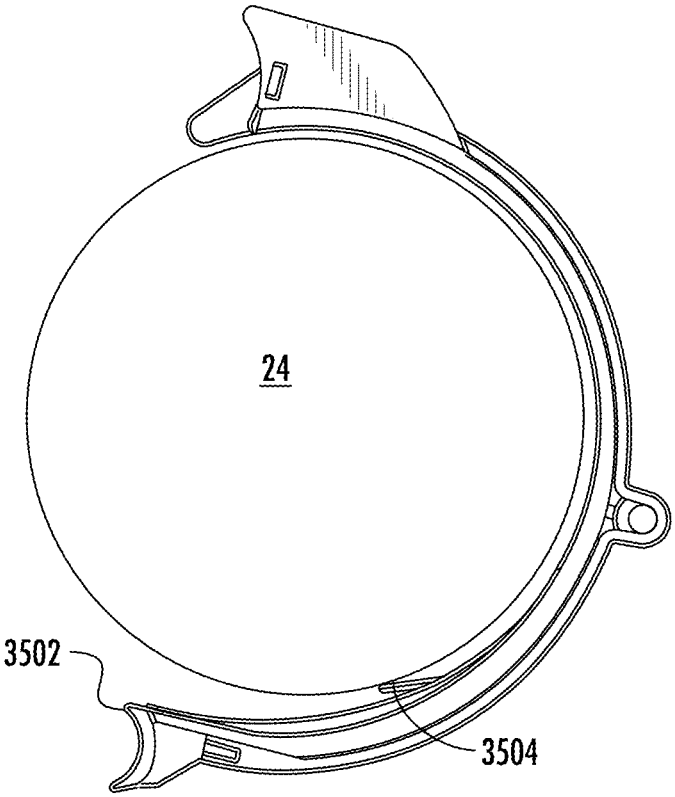

Having thus described the invention in general terms, reference will now be made to the accompanying drawings, which are not necessarily drawn to scale, and wherein:

FIG. 1 is an isometric view of components of a dispenser according to various example embodiments;

FIG. 2 is a view similar to FIG. 1 with a transfer roller removed to show a dispensing roller and a knife drum according to various example embodiments;

FIG. 3 is a schematic cross-section view taken along line of FIG. 1 having the housing removed according to various example embodiments;

FIG. 3A is a perspective, section view of an example roll retention element according to various example embodiments;

FIG. 4 is an exploded view of the knife drum of FIG. 1 according to various example embodiments;

FIG. 5 is a detailed view of a portion of FIG. 3 showing dispensing from a first source according to various example embodiments;

FIG. 6 is a view similar to FIG. 5 showing initial rotation of a transfer roller when sheet product from the first source becomes exhausted according to various example embodiments;

FIG. 7 is a view similar to FIG. 6 showing sheet product from a second source being fed onto a dispensing roller according to various example embodiments;

FIG. 8 is a view similar to FIG. 7 showing dispensing from the second source according to various example embodiments;

FIG. 9 is an isometric view of another example embodiment of a dispenser including a lever actuating system according to various example embodiments;

FIG. 10 is an isometric view of a further example embodiment of the invention including a motor driven system according to various example embodiments;

FIG. 11A illustrates a cross-sectional view of the dispensing roller and the transfer roller according to various example embodiments;

FIGS. 11B-11D illustrate example traction elements applied to the dispensing roller or transfer roller according to various example embodiments;

FIG. 12 illustrates a view of the transfer roller and knife drum according to various example embodiments;

FIG. 13 illustrates an example spring assembly for the knife drum according to various example embodiments;

FIG. 14 illustrates a cross-sectional view of the knife drum, transfer roller, dispensing roller, and a knife cam track according to various example embodiments;

FIGS. 15A-20B illustrate example movement of various components of the spring assembly through a cutting cycle according to various example embodiments;

FIGS. 21A-21F illustrate example embodiments of a bar and slider spring assembly according to various example embodiments;

FIG. 22 illustrates the dispenser with a cover open and closed according to various example embodiments;

FIG. 23 illustrates a perspective view of an example feed wheel assembly according to various example embodiments;

FIG. 24 illustrates a perspective view of an example feed wheel and torque limiter according to various example embodiments;

FIG. 25 illustrates a side view of an example feed wheel, wherein the feed wheel is partially transparent, according to various example embodiments;

FIG. 26 illustrates another cross-sectional view of an example feed wheel and feed wheel gear according to various example embodiments;

FIG. 27 illustrates a perspective view of a support block according to various example embodiments;

FIGS. 28 and 29 illustrate an example dispenser including an overspin bar according to various example embodiments;

FIG. 30 illustrates the knife drum with a knife slot bridge according to various example embodiments;

FIGS. 31 and 32 illustrate a dispenser including knife cutting ribs according to various example embodiments;

FIGS. 33 and 34 illustrate an example knife drum including slot guards and knife guards according to various example embodiments; and FIGS. 35 and 36 illustrate an example knife drum shroud according to various example embodiments.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other. Furthermore, as used herein, the term "or" is to be interpreted as a logical operator that results in true whenever one or more of its operands are true.

FIGS. 1-3 show an example embodiment of a sheet product dispenser 10. The dispenser 10 may include a housing 12 having an outlet 14 and a cover 11, as depicted in FIG. 21. A first sheet product source 16 and a second sheet product source 18 may be stored within the housing 12. A first roller, e.g. pinch roller, nip roller, or dispensing roller 20, and a knife drum 24 may cooperate to dispense sheet product 75 from either the first source 16 or second source 18 through the outlet 14. A second roller, e.g. transfer roller 22, may cooperate with the dispensing roller 20 to transfer dispensing from the first source 16 to the second source 18, upon depletion of the first source 16.

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation or tearing. In some such embodiments, the lines of perforations may extend along the width of the sheet product to define individual sheets that can be torn off by a user.

In the embodiment shown in FIGS. 1-3, the sheet product 75 may be formed into individual sheets as the sheet product 75 passes over the knife drum 24 and is cut by a cutter 25 (e.g. a knife) disposed in the knife drum 24. FIG. 4 depicts one example arrangement for the cutter 25, and will be discussed below. The cutter 25 may also be arranged in a number of other places on the dispenser 10. Alternatively, the dispenser 10 may lack a cutter 25 and the sheet product 75 may include spaced apart zones of weakness, such as perforation lines, that permit tearing off of separate sheets when the sheets are dispensed.

The first source 16 may be supported in a lower portion 26 of the housing 12 by spaced support members, e.g. lower roll holders 31. Alternatively, the lower roll holders 31 can be eliminated, allowing the first source 16 to be supported on the floor in the lower portion 26. The second source 18 may be rotatably supported by spaced support members, e.g. upper roll holders 30. The upper roll holders 30 may be mounted in an upper portion 27 of the housing 12.

As depicted in FIG. 3A the support members, such as upper roll holders 30, may be retained in engagement with the core 64, 68 of the first or second sources 16, 18, by a roll retention element 302. In the depicted embodiment, the roll retention element 302 is a protrusion projected from the cover 11. The roll retention element 302 may engage an outside edge of the upper roll holders 30, when the cover is in a closed position. This engagement is designed to prevent or limit the support arm from disengaging the core 68 of the second source 18. In this regard, without the engagement between the roll retention element 302 and the upper roll holder 30, the upper roll holder 30 may be prone to deflect away from the core 68 of the second source 18, which could allow the core 68 and the second source 18 to fall off of a support arm projection 308 extending at least partially into the core 68. In some example embodiments, the upper roll holders 30 may include a roll retention projection 306 configured to engage the roll retention element 302. In the depicted example, the roll retention element 302 includes a curve projection or "tab" extending inwardly, away from the cover 11 toward the upper roll holders 30. The roll retention projection 306 includes a projection extending forward toward the front of the dispenser 10 and outward toward the cover 11. A curved portion of the roll retention element 302 engages the roll retention projection 306 and causes the upper roll holders 30 to maintain engagement of the core 68. In some example embodiments, the curve of the roll retention element 302 may allow for bending of the roll retention element 302. Due to the rigidity of the roll retention element 302, this bending may bias the roll retention element 302 toward the roll retention projection 306 when engaged with the roll retention projection 306. Additionally or alternatively, the roll retention element 302 may also be disposed to engage upper roll holders 30. In some embodiments, one or more roll retention elements or projections may be applied to the lower roll holders 31.

In some embodiments, in addition to maintaining engagement between the upper roll holders 30 and the second source 18, the interaction of the roll retention element 302 and the upper roll holders 30 may cause (such as due to the bias) the upper roll holders 30 to abut or apply a drag force to a side of the second source 18 during dispensing. Such a drag force may help prevent various undesirable effects, such as overspin due to dispensing momentum thereby reducing a chance of a jamming scenario due to loose sheet product within the dispenser).

The transfer roller 22 may be located below the second source 18. The transfer roller 22 may be rotatably supported by a support block 44. The transfer roller 22 may have a smooth outer surface and be formed of plastic. Transfer roller 22 may have one or more first raised portions 32, e.g.

tabs, which are spaced from each other. Opposite the first raised portions 32 the transfer roller 22 may include one or more second raised portions 34, e.g. tabs. A slot 36 may extend completely through the transfer roller 22 between the first raised portions 32 and the second raised portions 34. The slot 36 may have a width that is at least as large as the width of the sheet product 75 of the second source 18 so that a free end 66 of the sheet product 75 of the second source 18 may be retained in the slot 36, as shown in FIG. 3, by passing through the slot 36. Although the depicted slot 36, passing through the transfer roller 22, is configured to releasably retain the free end 66 of sheet product 75, other retention systems may be utilized.

The dispensing roller 20 may be disposed adjacent to the transfer roller 22. The dispensing roller 20 may include a plurality of spaced roller sections 38. Each roller section 38 may include a surface 40 formed of rubber or some other material having a coefficient of friction greater than that of an outer surface of transfer roller 22. The roller sections 38 may be formed from wood, plastic, or metal. Adjacent pairs of the roller sections 38 may be spaced from one another. Each space between the roller sections 38 may be aligned with (and at least as wide as) corresponding first raised portions 32 and second raised portions 34. The dispensing roller 20 may be rotatably supported by the support block 44. The dispensing roller 20 may be biased against the knife drum 24 by springs 46 which are operably coupled between the support block 44 and dispensing roller 20. Similarly, the transfer roller 22 may be biased against the dispensing roller 20 by springs 45 which are operably coupled between the support block 44 and transfer roller 22. Alternatively, the weight of the transfer roller 22 may be used to bias the transfer roller 22 against the dispensing roller 20, thereby eliminating the springs 45.

The knife drum 24 may be rotatably supported in the housing 12, such as shown in FIG. 4. In an example embodiment, the knife drum 24 is supported by support arms 17 and 19 of supporting block 44. A cutter 25 is provided on the knife drum 24 to cut sheet product 75 into sheet segments as sheet product 75 is dispensed. Support arm 19 of supporting block 44 may include a cam plate 21. The knife 25 is attached to a cam follower 23 which follows the surface of the cam plate 21. As the knife drum 24 rotates, the knife 25 is extended and retracted as the cam follower 23 moves around the cam plate 21. In some example embodiments, the cam plate 21 may include a cam track that the cam follower propagates to extend and retract the knife 25, as described below with respect to FIG. 14.

In an example embodiment, the knife drum 24 may rotate as the sheet is pulled from the dispenser 10, as it is desirable that the driving force for activation of the mechanism be provided by the tension exerted on the sheet as the user draws the sheet from the dispenser 10. Dispensers so configured may be referred to as "manual" or "mechanical". An optional driving mechanism, e.g. feed wheel 56, may be provided to rotate the knife drum 24. In the embodiment shown in FIGS. 1-3, the feed wheel 56 is a rotatable knob, which may serve as an emergency feed. Alternatively, the driving mechanism could be a push lever, or an electric motor, which will be described below.

A shield 58 may be arranged to prevent sheet product 75 from the second source 18 from coming into contact with the knife drum 24 before the transfer roller 22 transfers dispensing to the second source 18. A plurality of fingers 60 may be mounted to the shield 58, which may assist in preventing sheet product 75 from the second source 18 from contacting the knife drum 24 before the transfer roller 22 transfers dispensing to the second source 18.

To load the dispenser 10, a user first opens the cover to expose the lower portion 26 and upper portion 27. The first source 16 may be placed in the lower portion 26 of the housing 12. A free end 62 of the sheet product 75 of the first supply source 16 may be placed over the rubberized surfaces 40 of the dispensing roller 20, and then fed into the nip between the dispensing roller 20 and the knife drum 24. The feed wheel 56 may be activated to advance the free end 62 through the outlet 14 of the housing 12. Then, the second source 18 may be placed in the upper roll holders 30. The free end 66 of sheet product 75 from the second source 18 may be unwound and passed through the slot 36 of the transfer roller 22. A few inches of the free end 66 of sheet product 75 may extend beyond the slot 36. Finally, the cover may be closed, placing the dispenser 10 in a condition ready for use.

If the dispenser 10 had been loaded previously, then reloading may include additional steps. For example, if the first source 16 has been depleted and the dispenser 10 is dispensing sheet product 75 from the second source 18, after the cover 11 is initially opened, the second source 18 may be removed from the upper roll holders 30. The empty core 64 from the first source 16 may then be removed. Then, the second source 18 may be placed in the lower portion 26 of the housing 12, essentially replacing the first source 16. A new second source 18 may then be loaded as described above.

The sheet product 75 may be dispensed from the dispenser 10 in a plurality of methods. For example, a user may remove sheet product 75 from the dispenser 10 by pulling an end portion of sheet product 75 that extends from the dispenser outlet 14, or by actuating a proximity sensor that interacts with a dispensing motor for rotating the dispensing roller 20 and knife drum 24. Additionally or alternatively, the user may dispense sheet product 75 by actuating a manually operated driving mechanism, such as the feed wheel 56.

An example of transfer of dispensing from the first source 16 to the second source 18 is depicted in FIGS. 5-8. FIG. 5 depicts the dispenser 10 dispensing sheet product 75 from the first source 16. As the knife drum 24 rotates (for example due to a user pulling the free end 62) the knife drum 24 dispenses sheet product 75 and the first source 16 unwinds. The advancing sheet product 75 may also grip the high coefficient of friction of the rubberized surfaces 40 of the dispensing roller 20, thereby causing the dispensing roller 20 to rotate. The transfer roller 22 may be prevented from rotating, however, by the first raised portions 32 coming in contact against the sheet product 75 that is supported by the dispensing roller 20. The smooth surface of the transfer roller 22 and the low coefficient of friction of the sheet product 75 may allow the dispensing of the sheet product 75, without hindrance. Even though springs 45 may bias the transfer roller 22 against the advancing sheet product 75 that is supported by the dispensing roller 20, the transfer roller 22 may not rotate during dispensing, as long as sheet product 75 from the first source 16 covers the spaces between the segments of the sections 38 of dispensing roller 20.

Once the sheet product 75 from the first source 16 is depleted, a tail end 70 of the sheet product 75 may pass through an area between the dispensing roller 20 and the first raised portions 32, as shown in FIG. 6, such that the transfer roller 22 contacts the rubberized surface 40 of the dispensing roller 20. Without any sheet product 75 between the dispensing roller 20 and the transfer roller 22, the dispensing roller 20 and transfer roller 22 may become rotationally engaged and the rotation of the dispensing roller 20 may cause the transfer roller 22 to rotate. The free end 66 of sheet product 75 from the second source 18 may contact the dispensing roller 20, as the transfer roller 22 rotates. As seen in FIG. 7, the free end 66 of sheet product 75 may be pulled from the slot 36 in the transfer roller 22. The rubberized surface 40 of the dispensing roller 20 may engage or "grab" the free end 66 of sheet product 75 and pull the free end 66 of sheet product 75 into the nip formed between the dispensing roller 20 and the knife drum 24. As seen in FIG. 8, the second raised surfaces 34 may then contact the sheet product 75 on the dispensing roller 20, thereby preventing further rotation of the transfer roller 22. The dispenser 10 may dispense sheet product 75 from the second source 18. In this configuration, the transfer roller 22 may be set up for the next source to be loaded.

An example embodiment of the dispenser 10 has many advantages, including complete use of sheet product 75. The transfer roller 22 may allow easy loading of sheet product 75, defeating the need of maintenance personnel to bypass the transfer system. Fewer maintenance checks may be required because of the transfer system. In addition, the dispenser 10 may be more economical to use because the sheet product from each source will be entirely used.

In another example embodiment of the invention, as seen in FIG. 9, the knob roller of the feed wheel 56 may be replaced with a lever actuation device 72. The lever actuation device 72 may include a toothed wheel 74 and a pivot arm 76. The toothed wheel 74 may be operatively coupled to the knife drum 24. The pivot arm 76 can be attached to the housing 12 and engages the toothed wheel 74 to rotate the knife drum 24. The lever actuation device 72 may serve as an emergency feed option when there is no available tail portion of the sheet product extended from the outlet for a user to grab.

A tear bar 90 may be provided to allow a user to tear off a sheet from the roll of sheet product 75. The tear bar 90 can be arranged in several different orientations at or near the opening 14 of the housing 12, In addition, the knife drum 24 may be replaced with any suitable tensioning roller when the tear bar 90 is provided.

In a further example embodiment of the invention, as seen in FIG. 10, the knob roller of the feed wheel 56 may be replaced with a motor activation device. The motor activation device may include a gear train 82 and motor 84. The gear train 82 may include a first gear 86, a second gear 88, and a drive gear 90. The drive gear 90 may be operatively coupled to the motor 84 and engage the second gear 88. The second gear 88 may engage the first gear 86, which may be operatively coupled to the knife drum 24. In an example embodiment, the motor 84 may be activated by the user by a switch, such as a push button. In some example embodiments, the motor 84 may be activated by a proximity sensor, thus providing "touchless" dispensing. The motor 84 may rotate the drive gear 90, which in turn rotates the second gear 88, which in turn rotates the first gear 86, which in turn causes the knife drum 24 to rotate.

Example Traction Element for Transfer Roller

In an example embodiment, in some cases, the transfer roll 22 may become disengaged from, e.g. lose traction with, the dispensing roller, such as depicted in FIG. 11A. An alignment 1102 of the slot 36 of the transfer roller 22 and the dispensing roller 20 may cause a loss of friction contact between the transfer roller 22 and the dispensing roller 20, due to a reduced diameter of the outer circumference of the transfer roller 22 at the first and second openings of the slot 36. In various example embodiments described herein, one or more traction elements may be used to maintain contact between the transfer roller 22 and the dispensing roller 20.

FIGS. 11B-11D illustrate example traction elements according to various example embodiments. The traction element may include at least one of: one or more bridge projections extending axially away from the second roller at a first end and a second end of the slot; at least one biasing element operably coupled to the first roller and the second roller and configured to bias the first roller or second roller toward the other of the first roller or the second roller; and a tab and projection system that includes a first tab proximate to a first end of the slot of the second roller, and a first projection rib and a second projection rib that are disposed on opposite sides of the first roller. In some embodiments, the tab and projection system may include a second tab proximate to the second end of the slot of the second roller.

FIG. 11B illustrates an example traction element including bridge projections 1104 disposed at the first and second ends of slot 36. The bridge projections 1104 may extend axially away from the transfer roller and maintain contact between the transfer roller 22 and the dispensing roller 20 in the reduced diameter area associated with the openings of the slot 36. The bridge projections 1104 may extend to about the outer periphery of the transfer roller 22, thus maintaining a uniform or near uniform diameter about the circumference of the transfer roller 22. The bridge projections 1104 may be formed of any suitable (e.g., resilient, partially rigid, among others) material, such as plastic, metal, rubber, of the like. The bridge projections 1104 may be disposed at a first end of the transfer roller 22, at a second end of the transfer roller 22, or both.

In the example embodiment depicted in FIG. 11C, the traction element may include at least one biasing element 1110 configured to bias the transfer roller 22 and/or the dispensing roller 20 toward the other of the transfer roller 22 and the dispensing roller 20. The biasing element 1110 may be a spring, such as a coil spring, a torsion spring, or the like. The biasing element 1110 may be operatively coupled to an axle 1106 of the dispensing roller 20 at a first end and the biasing element may be operably coupled to an axle 1108 of the transfer roller 22 at a second end. In an example embodiment, the biasing element 1110 may be disposed at the first end of the transfer roller 22 and/or the dispensing roller 20, the second end of the transfer roller 22 and/or the dispensing roller 20, or both.

In the example embodiment depicted in FIG. 11D, the traction element may include first raised portions 32 and second raised portions 34 disposed proximate to the first end and second end of slot 36, respectively. The dispensing roller 20 may include projection ribs 1112 disposed on an axle 1114 on opposite sides of the dispensing roller 20. As the dispensing roller 20 rotates the projection ribs 1112 may engage the first raised portions 32 or the second raised portions 34 to cause the transfer roller 22 to rotate past the alignment 1102 of the slot 36 and the dispensing roller 20. In some example embodiments, tabs may be provided at a first end and second end of the transfer roller 22 in addition to, or instead of the first raised portions 32 and second raised portions 34. The projection ribs 1112 may engage the tabs to cause the dispensing roller to rotate past the alignment 1102 of the slot 36 and the dispensing roller 20.

FIG. 12 illustrates a view of the dispensing roller 20 and the transfer roller 22 with the sheet product 75 sandwiched therebetween. In some example embodiments, rubber 1206 or other gripping material may be disposed on the surface 40 of the dispensing roller 20 to grip the sheet product 75. In an instance in which the sheet product 75 is misaligned the rubber 1206 may contact the transfer roller 22. For example, FIG. 12 shows that rubber section 1206' is not covered with sheet product 75. Rotation of the dispensing roller 20 may thereafter cause the transfer roller 22 to turn (as the rubber is now directly contacting the transfer roller), causing premature insertion of the sheet product from the second source 18 into the dispensing nip and/or causing the rubber to strongly urge the raised portions 32, 34 to rotate into the sheet product 75 and cause friction that impedes dispensing. To help avoid such a scenario, in some example embodiments, the transfer roller 22 may include a step down 1202 for a contact surface, e.g. the outer diameter of the transfer roller 22 may be reduced near the ends. The step down 1202 in the contact surface of the transfer roller 22 may cause the contact surface of the transfer roller 22 to be smaller than the surface 40 of the dispensing roller 20 and/or than the surface of the sheet product 75, such that a misalignment of the sheet product 75 would not result in the rubber 1206' from the dispensing roller 20 contacting the transfer roller 22 (e.g. the misalignment and step down are shown in FIG. 12). The prevention of the rubber 1206' from contacting the transfer roller 22 may limit or prevent premature rotation of the transfer roller 22 and ensure reliable dispensing without excessive friction.

Example Spring Assembly

FIG. 13 illustrates a spring assembly for the knife drum 24. The components of the spring assembly may be configured to rotate with the knife drum 24 during one rotation cycle of the knife drum 24, such as due to a pull on the sheet product 75 by a user. The spring assembly may bias the knife drum 24 toward a predetermined position, such as a start position of a cutting cycle. The spring assembly may include a crank arm 1302, a floater link 1304, a rocker link 1306, and one or more biasing elements.

A first end of the crank arm 1302 may be operably coupled to (e.g. rotatable about) a center axis point 1301 (FIG. 16A) of an end of the knife drum 24. The crank arm 1302 may be fixed in relationship to the knife drum 24, e.g. the crank arm rotates with the rotation of the knife drum 24. The second end of the crank arm 1302 may extend away from the center axis point 1301 of the knife drum 24. The second end of the crank arm 1302, e.g. a distal end, may be disposed proximate an outer periphery of the knife drum 24.

The floater link 1304 may be operably coupled at (e.g. rotatable about) a first end thereof to the second end of the crank arm 1302. Additionally, the floater link 1304 may be operably coupled at (e.g. rotatable about) a second end thereof to a first end of the rocker link 1306. A second end of the rocker link 1306 may be operably coupled to (e.g. rotatable about) the housing about a pivot point 1309. The pivot point 1309 may be connected (e.g. molded) to, for example, the support block 44.

The one or more biasing elements of the spring assembly may include a first torsion spring 1308 disposed about, or alternatively, in proximity to, the pivot point 1309. The first torsion spring 1308 may be operably coupled, such as by a retention tab, weld, adhesive, or the like, to the housing 12 on a first end and the rocker link 1306 at a second end. Additionally or alternatively, the spring assembly may include a second torsion spring 1310 disposed about, or alternatively, in proximity to, a pivot connection 1311 between the rocker link 1306 and the floater link 1304. The second torsion spring 1310 may be operably coupled, such as by a retention tab, weld, adhesive, or the like, to the rocker link 1306 at a first end and to the floater link 1304 at a second end.

In an example embodiment, the spring assembly may operate as a crank and slider mechanism, similar to locomotive wheels and drive pistons. The spring assembly may enable a substantially linear force to be converted to a rotational force applied to the knife drum 24.

In some example embodiments, the extension of the crank arm 1302 may be affixed at a predetermined distance from a pivot of the knife 25. To explain, in such example embodiments, both the knife 25 and the crank arm may be at a fixed position relative to the knife drum 24, such that as the knife drum 24 rotates, the pivot of the knife 25 and the crank arm 1302 may rotate synchronously.

FIG. 14 illustrates a cross-sectional view of the knife drum 24, transfer roller 22, dispensing roller 20 and a knife cam track 1402. The knife 25 may pivot about pivot 1406, which may be operably coupled to the knife drum 24. The cam follower 23 may follow a cam track 1402, which is disposed, such as by molding, in the support block 44. As the knife drum 24 rotates the cam follower 23 is guided through the cam track 1402 causing the knife 25 to extend and retract relative to the knife drum 24. In the depicted example, a cutting cycle may include the knife 25 at rest, e.g. fully retracted, at 0 degrees; the knife 25 starting to extend, e.g. start of cut, at 59 degrees; and the knife 25 reaching maximum extension at 205 degrees. The knife 25 may remain at the maximum extension, e.g. dwell, to approximately 215 degrees and be fully retracted at 245.5 degrees.

In an example embodiment, the knife 25 may fully retract within the knife drum 24 when in a retracted position. Alternatively, the knife 25 may only partially retract, such that at least a portion of the knife 25 extends from the knife drum 24 throughout the cutting cycle.

In an example embodiment, the dispenser 10 may include a discharge roller 1408, e.g. a bottom pinch roller. The discharge roller 1408 may be disposed at or proximate to the outlet 14 of the dispenser and spaced from the knife drum 24. In some embodiments, the discharge roller 1408 may be fixed relative to the knife roller 24, such that the discharge roller 1408 is prevented from moving toward or away from the knife drum 24. In some example embodiments, the cam track 1402 may be configured to cause the knife 25 to finish cutting or substantially cutting the sheet product 75 at a point between the knife drum 24 and the discharge roller 1408, such as at a dwell point near the bottom of the cam track. In an example embodiment, the cam track 1402 may be configured to cause the knife 25 to retract prior to passing the discharge roller 1408 in the feed direction. In some example embodiments, the discharge roller 1408 may provide a barrier or buffer for the knife 25, as the knife 25 retracts, which may prevent injury to a user reaching into the outlet 14. Additionally, since the discharge roller 1408 does not contact the knife drum 24, the knife drum 24 may experience less drag than a traditional dispenser, and therefore the dispenser 10 requires a reduced force to pull a sheet of sheet product 75.

In an alternative embodiment, the cam track may be shifted, as depicted by dotted line 1404. The shifted cam track 1404 may cause the knife 25 to begin extending later in the cutting cycle and begin retracting earlier in the cutting cycle, thereby shortening the period over which the knife 25 is cutting. Additionally, the shifted cam track 1404 may remove the dwell period in which the knife is fully extended. Removing the dwell period may reduce the amount of time that force is applied to cause a rotation of the knife drum 24. Alternatively, removing the dwell period may allow a pull force to be applied over a longer portion of the dispense cycle, which may reduce the pull force required for a user to provide a certain amount of energy to the dispenser.

FIGS. 15A-20B illustrate the movement of the spring assembly through a cutting cycle. The cutting cycle may include three portions: 1) winding the first and second torsion springs 1308, 1310; 2) cutting the sheet product 75; and 3) presenting the free end 62, 66 of the sheet product 75, as depicted in FIG. 15B. The first and second torsion springs 1308, 1310 may be charged during portions of the cutting cycle as the crank arm 1302 turns in the feed direction (counter clockwise as depicted) pushing the floater link 1304 toward the pivot point 1309 of the rocker link 1306. The rotation of the knife drum 24 during spring charging may be caused by a user pulling on the free end 62, 64 of the sheet product 75 and/or rotation of the feed wheel 56. The first and second torsion springs 1308, 1310 may be discharged during portions of the cutting cycle by causing the floater link 1304 to push the crank arm 1302 in the feed direction and away from the pivot point 1309 of the rocker link 1306.

Figure 16A:
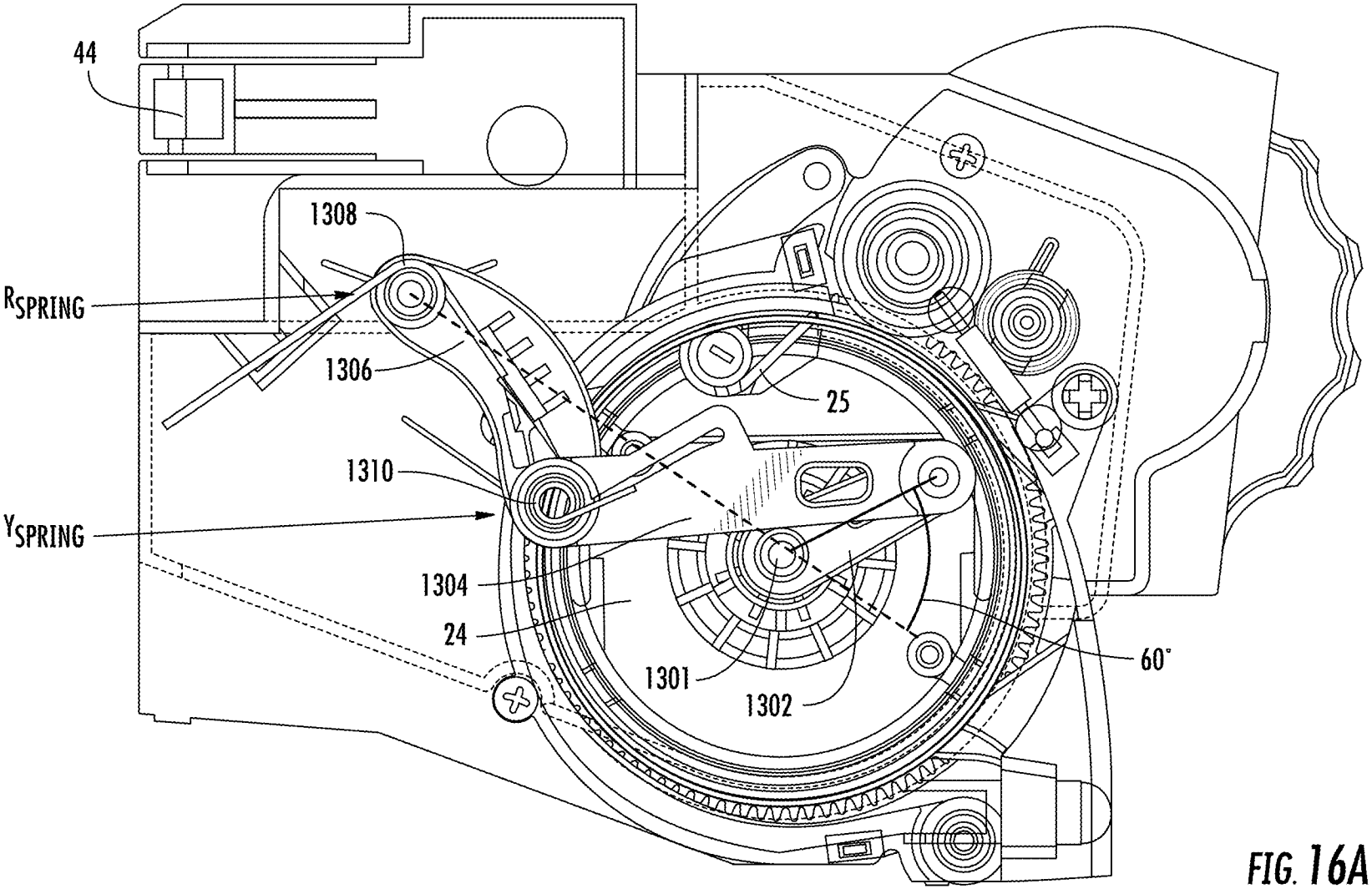
Figure 16B:
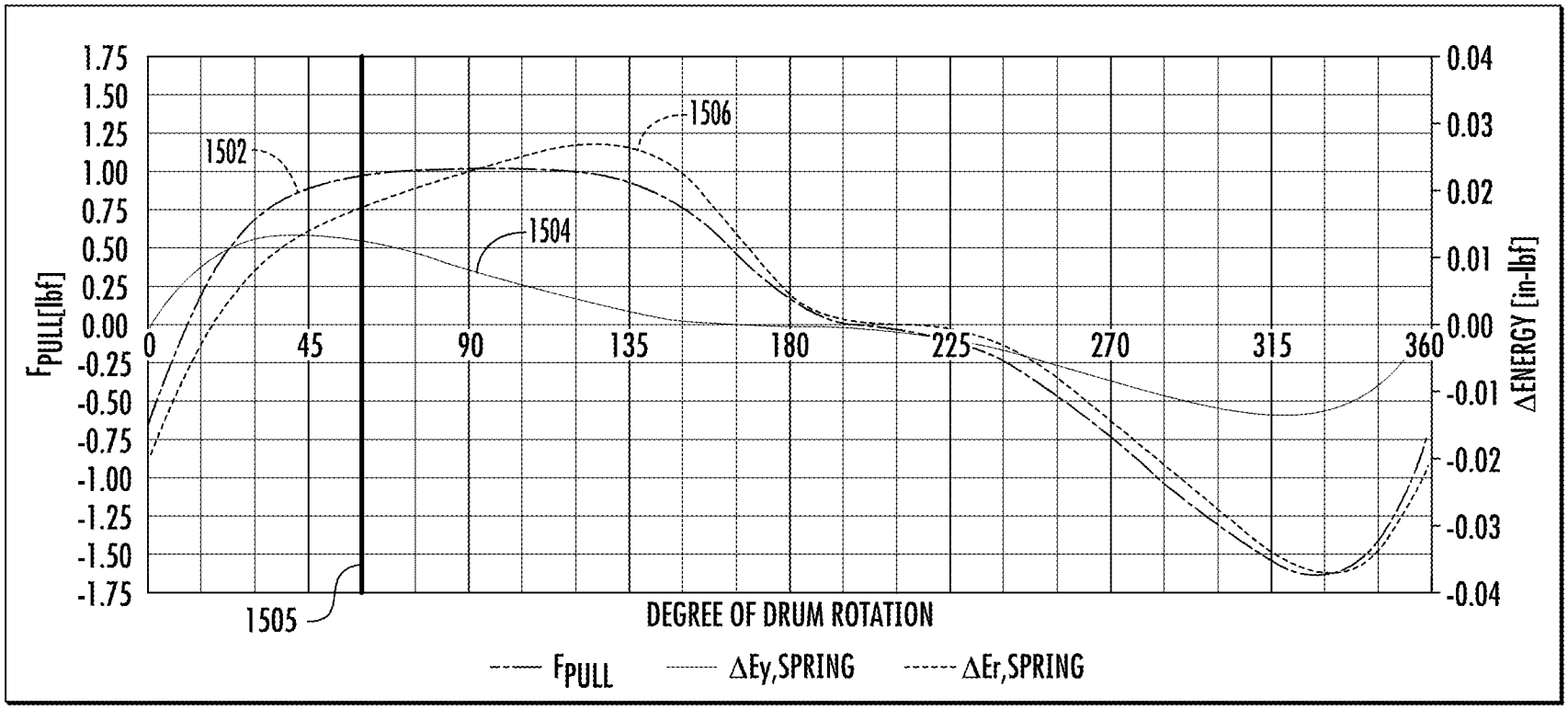

The force to pull (Fpull) 1502 the knife drum 24 and spring assembly may be positive (e.g., requiring a user to input energy). Notably, the depicted Fpull represents the force due to the torsion springs 1308, 1310, and, thus, the Fpull 1502 may be negative (e.g., does not require user effort because the torsion springs 1308, 1310 are providing the energy). In this regard, additional force may be applied (or required) to overcome component friction and/or resistance to the knife 25 cutting the sheet product 75. The Fpull 1502 may start at approximately −0.6 lbf with the knife at 0 degrees. Both the change in energy 1506, e.g. ΔErspring, of the first torsion spring 1308 and the change in energy 1504, e.g. ΔEyspring, of the second torsion spring 1310 may increase as rotational force is applied to the knife drum 24. The change in energy 1504, 1506 is the amount of energy charged or discharged during 1 degree of rotation of the knife drum 24. The change in energy 1504, 1506 is used to calculate the pull force due to the torsion springs 1308, 1310 during each 1 degree of rotation of the knife drum 24. As the knife drum 24 rotates to 60 degrees, as shown in FIGS. 16A and 16B, the change in energy 1504 of the second torsion spring 1310 may be a value of approximately 0.012 in-lbf of stored energy per 1 degree of rotation of the knife drum 24 and may begin to decrease as the second torsion spring 1310 is compressed (note that even though the change in energy 1504 is decreasing at the knife drum 24 position of 60 degrees, the change in energy 1504 is still positive, which means that the second torsion spring 1310 continues to compress and store energy). The change in energy 1506 of the first torsion spring 1308 may increase to approximately 0.016 in-lbf of stored energy per 1 degree of rotation of the knife drum 24. Due to the designed curves of the change in energy 1504, 1506, the Fpull may increase and stabilize at approximately 1.0 lbf. The line 1505 along the graph of FIG. 16B indicates the position of the spring assembly as depicted in FIG. 16A along the cutting cycle.

Figure 17A:
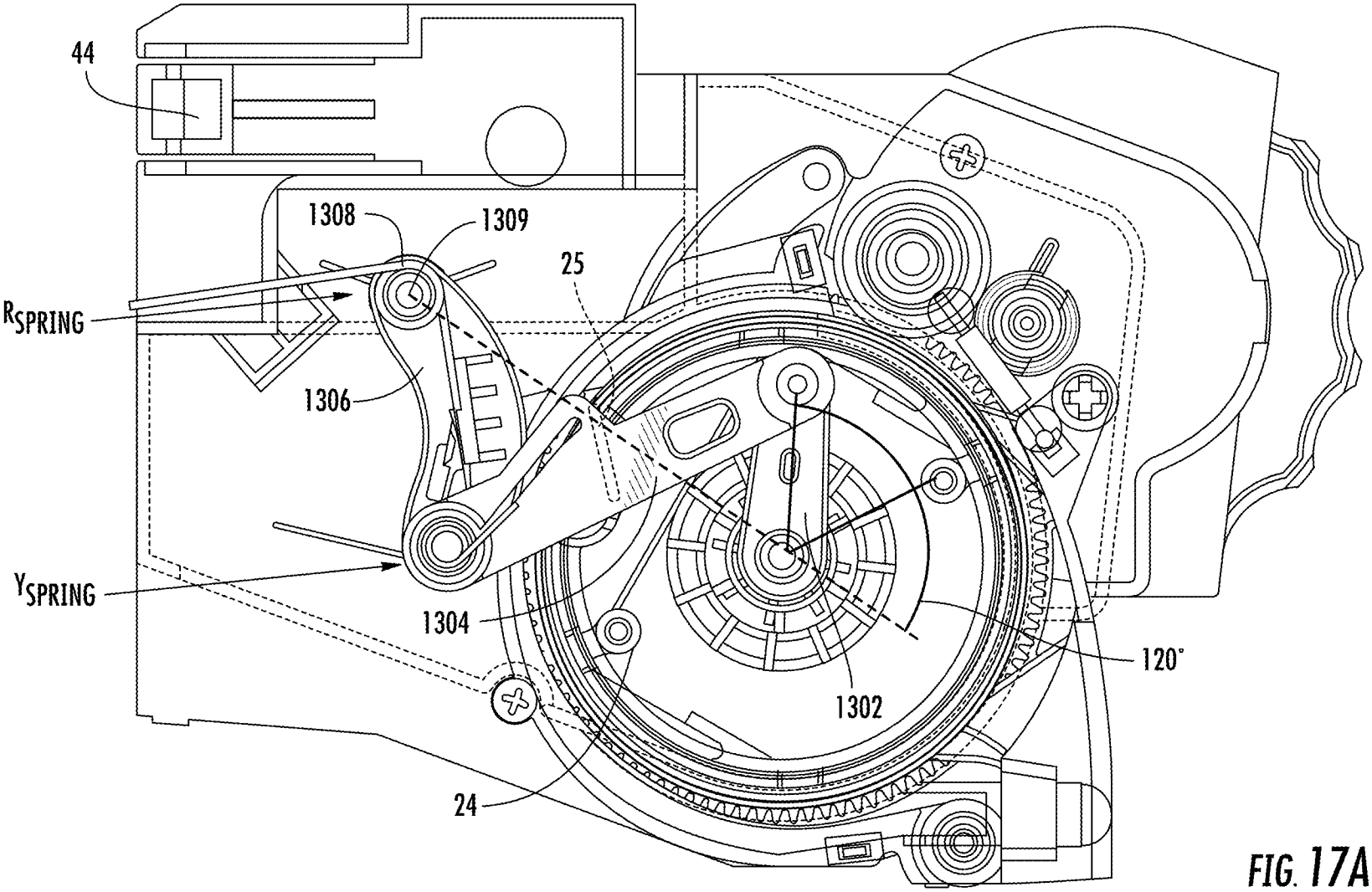
Figure 17B:
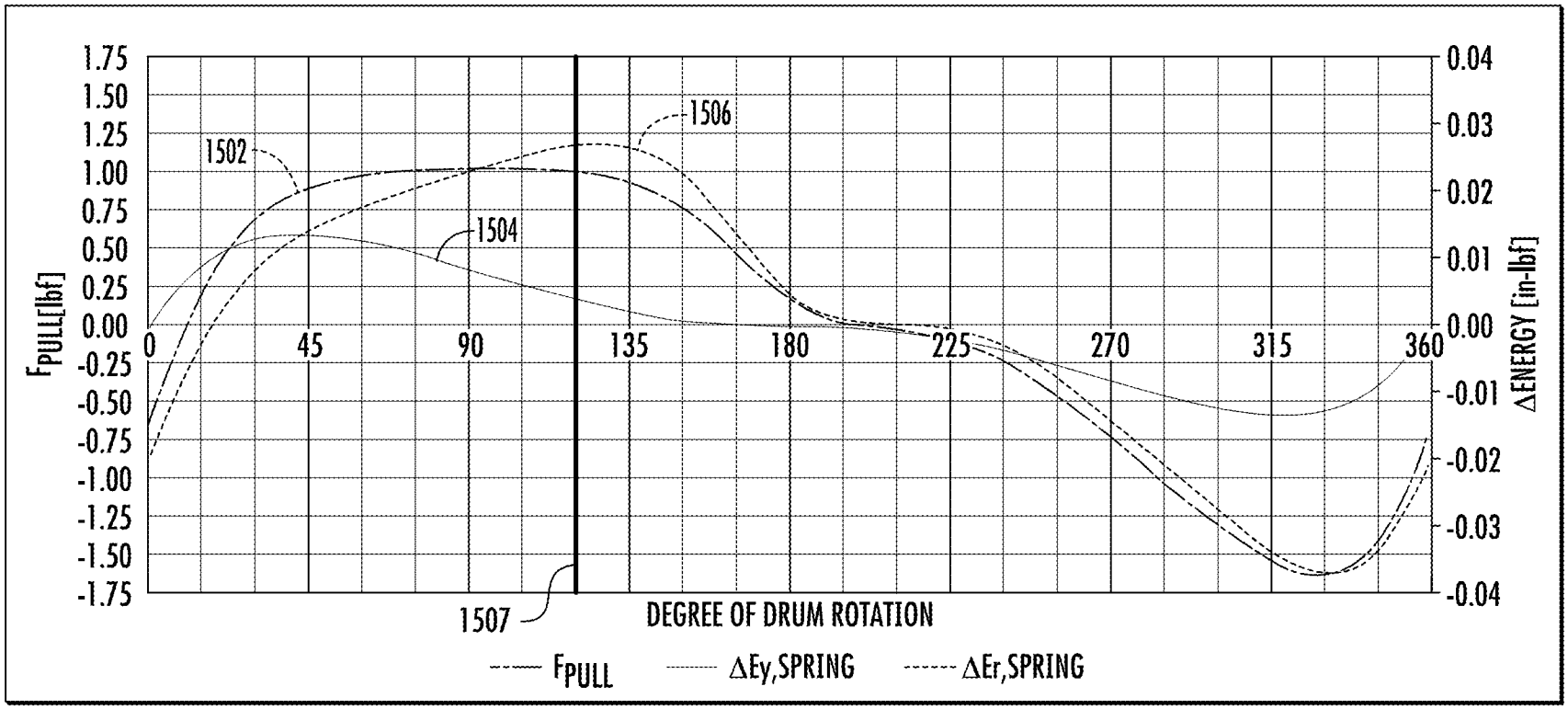

At 120 degrees, as depicted in FIGS. 17A and 17B, the second torsion spring 1310 may be near fully charged with a change in energy 1504 of the second torsion spring 1310 now reduced to approximately 0.004 in-lbf (as the second torsion spring 1310 is charging at a reduced rate) and the change in energy 1506 of the first torsion spring 1308 may increase to approximately 0.027 in-lbf (as the first torsion spring 1308 is now charging at an increased rate). The Fpull 1502 may remain stable at approximately 1.0 lbf. The line 1507 along the graph of FIG. 17B indicates the position of the spring assembly as depicted in FIG. 17A along the cutting cycle.

Figure 18A:
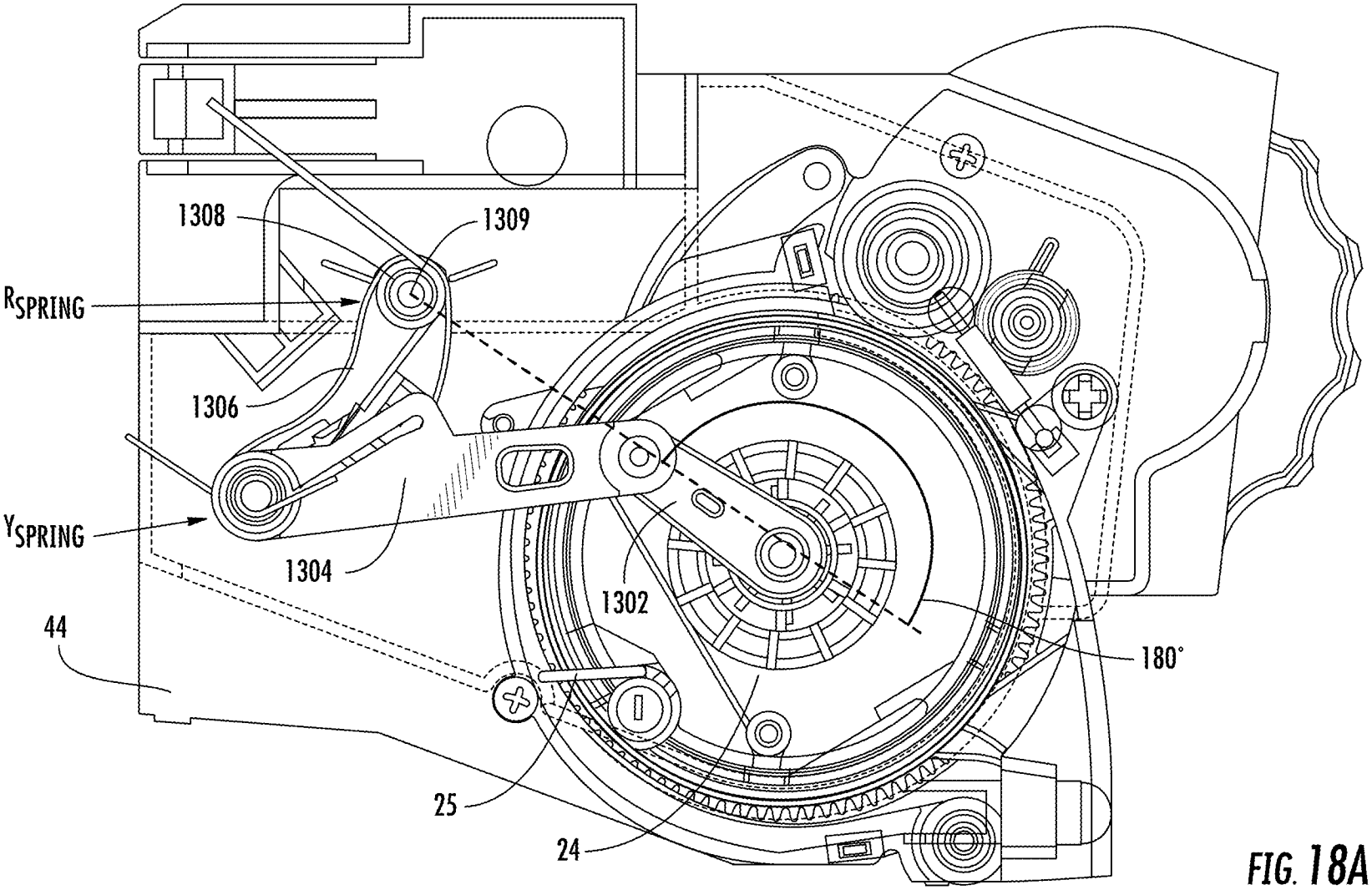
Figure 18B:
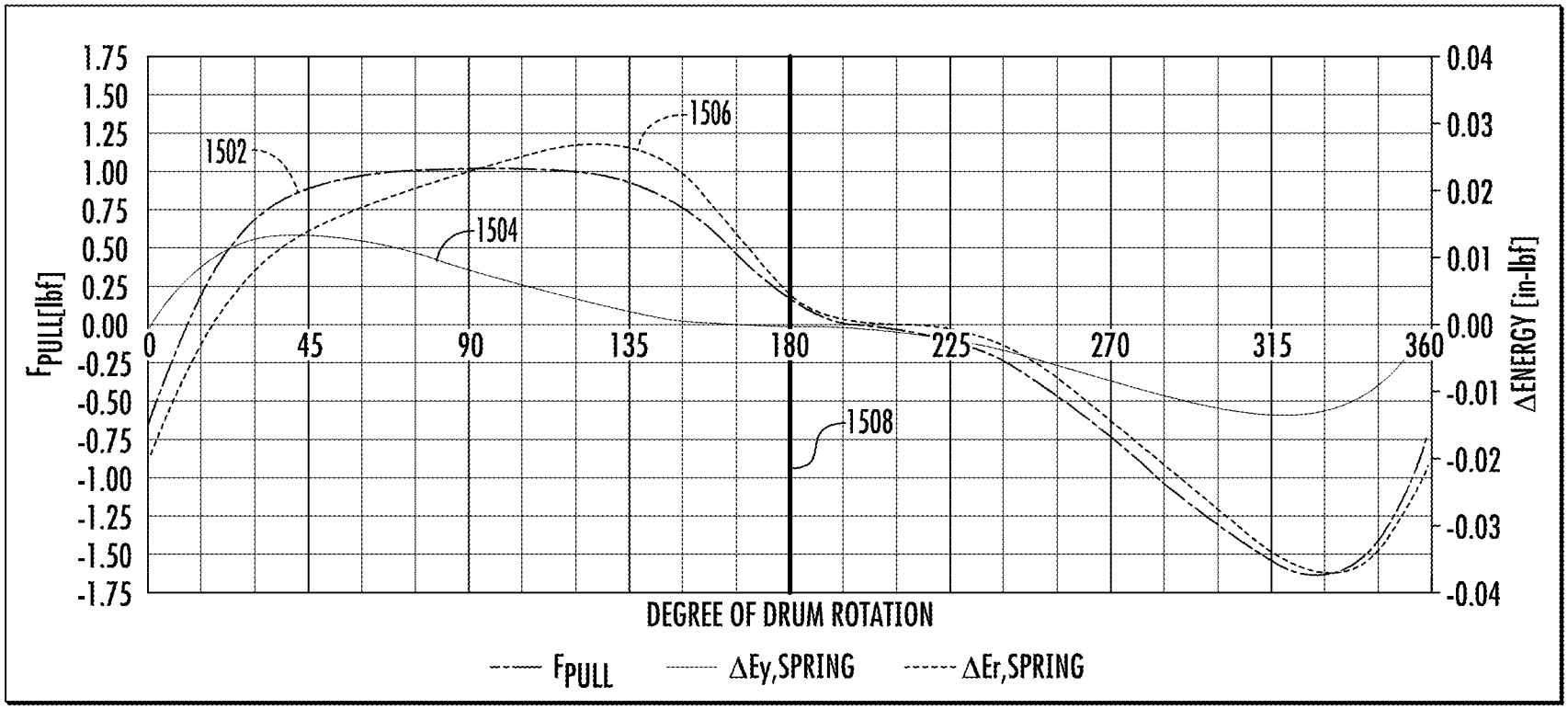

At approximately, 180 degrees the first torsion spring 1308 may be nearly-fully charged and the second torsion spring 1310 may be fully charged, as depicted in FIGS. 18A and 18B. In this regard, the change in energy 1504 of the second torsion spring 1310 may have decreased to approximately 0.0 in-lbf, and the change in energy 1506 of the first torsion spring 1308 may have decreased to approximately 0.005 in-lbf with Fpull 1502 of approximately 0.2 lbf. The line 1508 along the graph of FIG. 18B indicates the position of the spring assembly as depicted in FIG. 18A along the cutting cycle.

The cutting cycle may start to cut the sheet product 75 by rotating the knife drum 24 while extending the knife 25. The cutting cycle may be designed so that the pull force required to cut the paper is complementary to the pull force required to charge the torsion springs 1308, 1310. As such, the total pull force that a user feels in order to retrieve sheet product 75 is affected by cutting sheet product 75, charging and discharging torsion springs 1308, 1010, overcoming friction, etc., and may be designed so that the total pull force is smooth and pleasant for a user. The rotation of the knife drum 24 during the cutting of the sheet product 75 and presentation of the free end 62, 66 of the sheet product 75 may be due to the user pulling the free end 62, 66, and/or due to discharge of the first torsion spring 1302 and the second torsion spring.

Figure 19A:
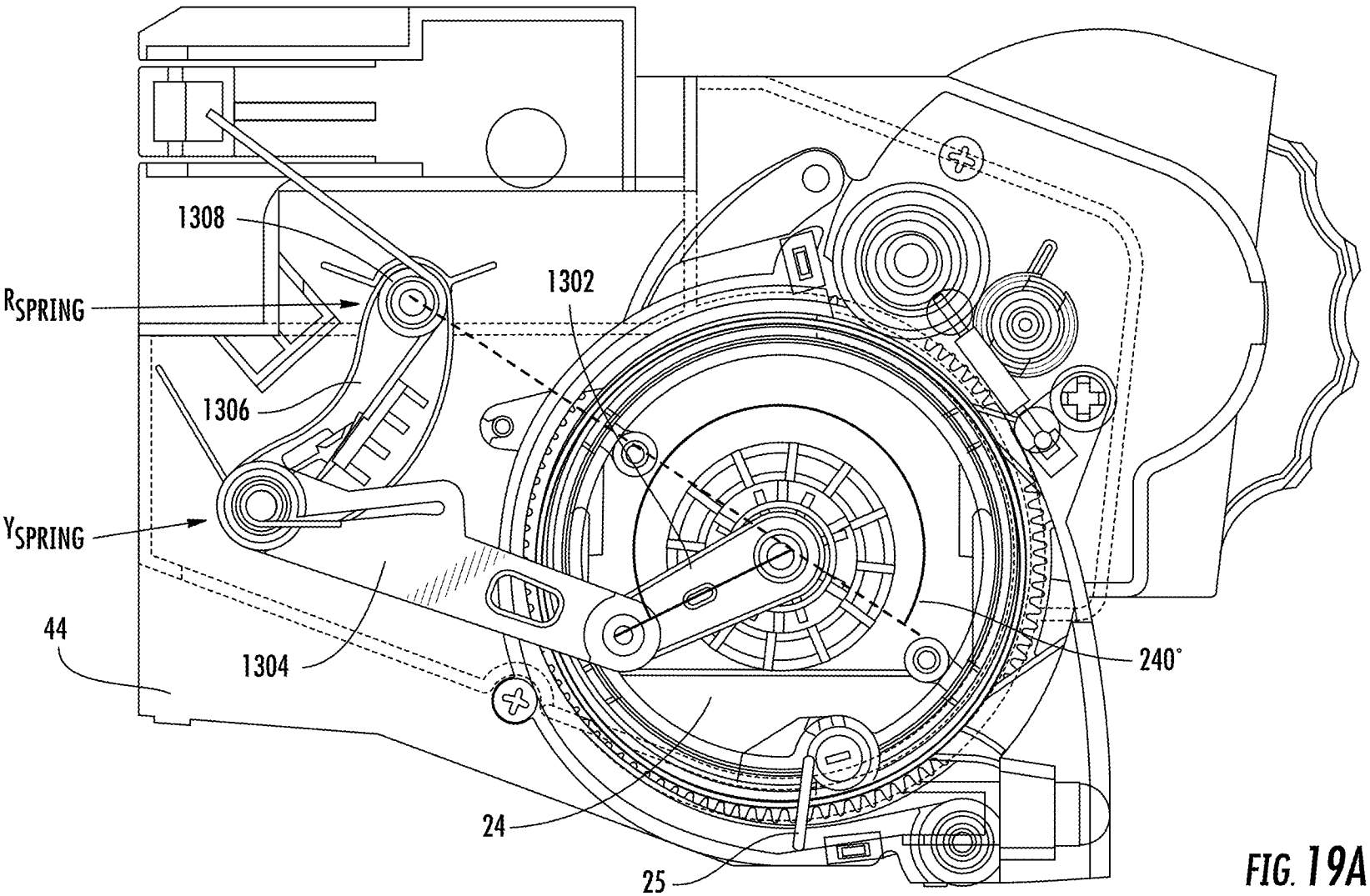
Figure 19B:
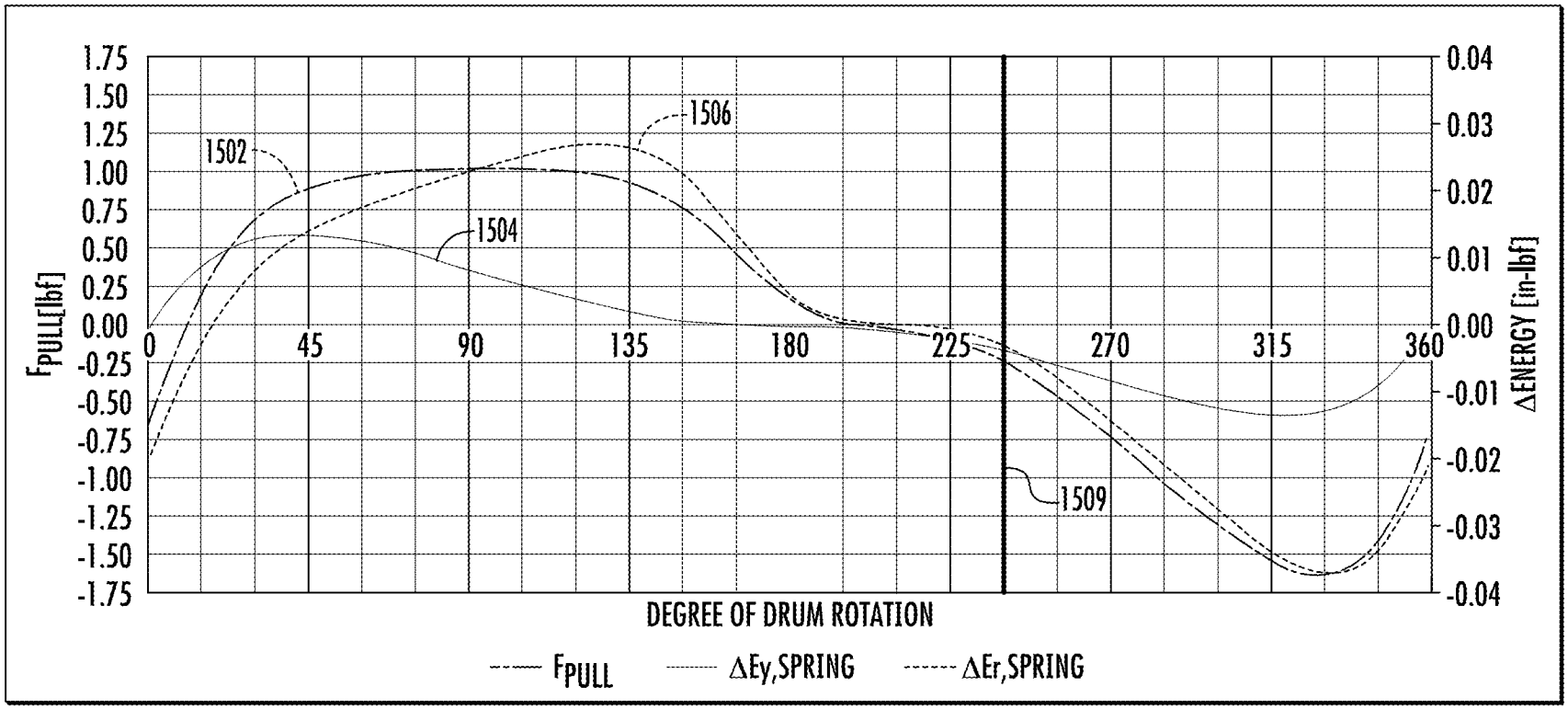

As depicted in FIGS. 19A and 19B, the first torsion spring 1308 and second torsion spring 1301 may be discharging as the knife drum 24 rotates in the feed direction to 240 degrees. The Fpull 1502 may be approximately −0.25 lbf and the change in energy 1506 of the first torsion spring 1308 may further decrease to approximately −0.004 in-lbf and the change in energy 1504 of the second torsion spring 1304 may decrease to approximately −0.004 in-lbf (e.g., the first and second torsion springs are discharging). The line 1509 along the graph of FIG. 19B indicates the position of the spring assembly as depicted in FIG. 19A along the cutting cycle.

Figure 20A:
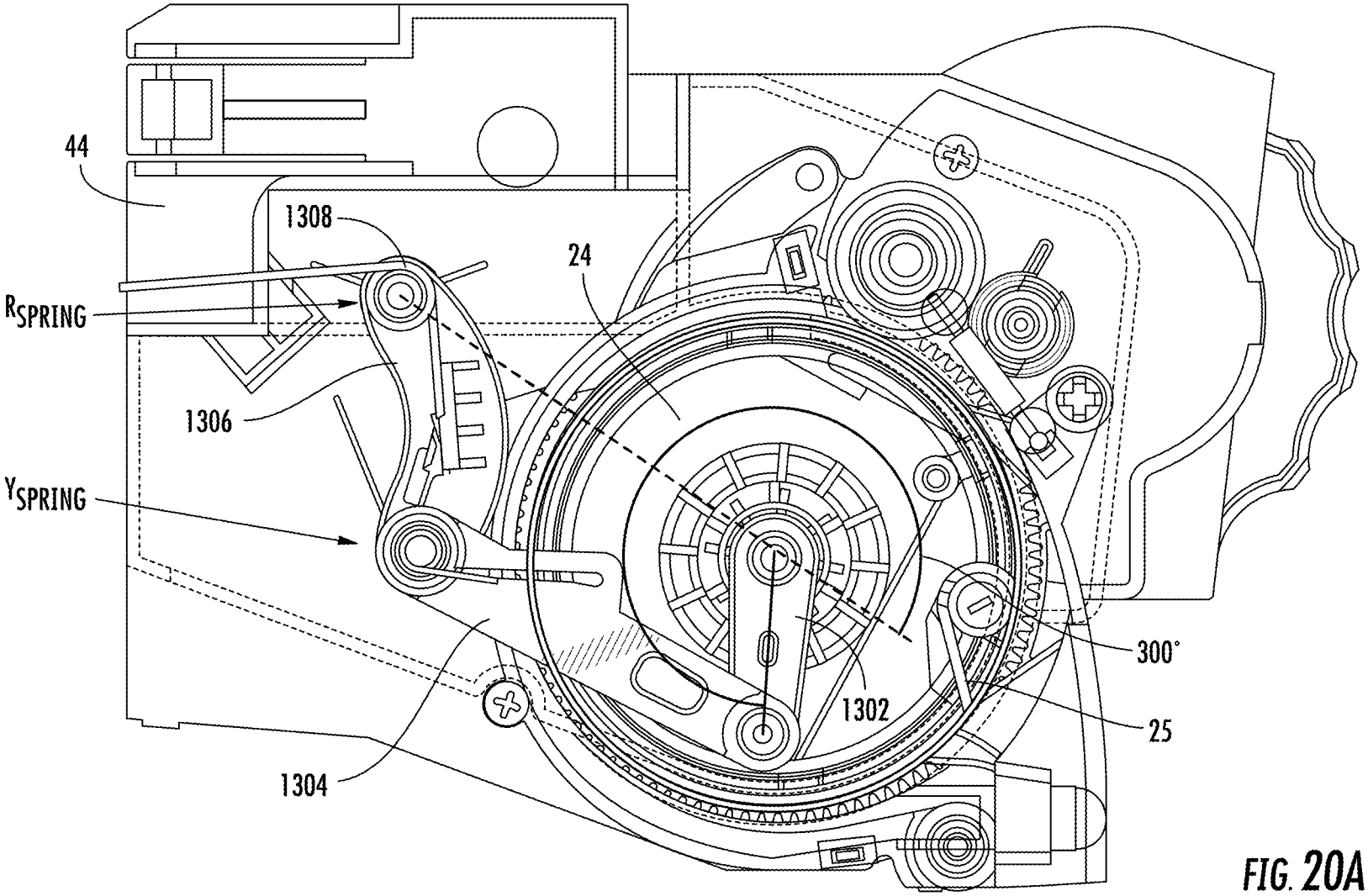
Figure 20B:
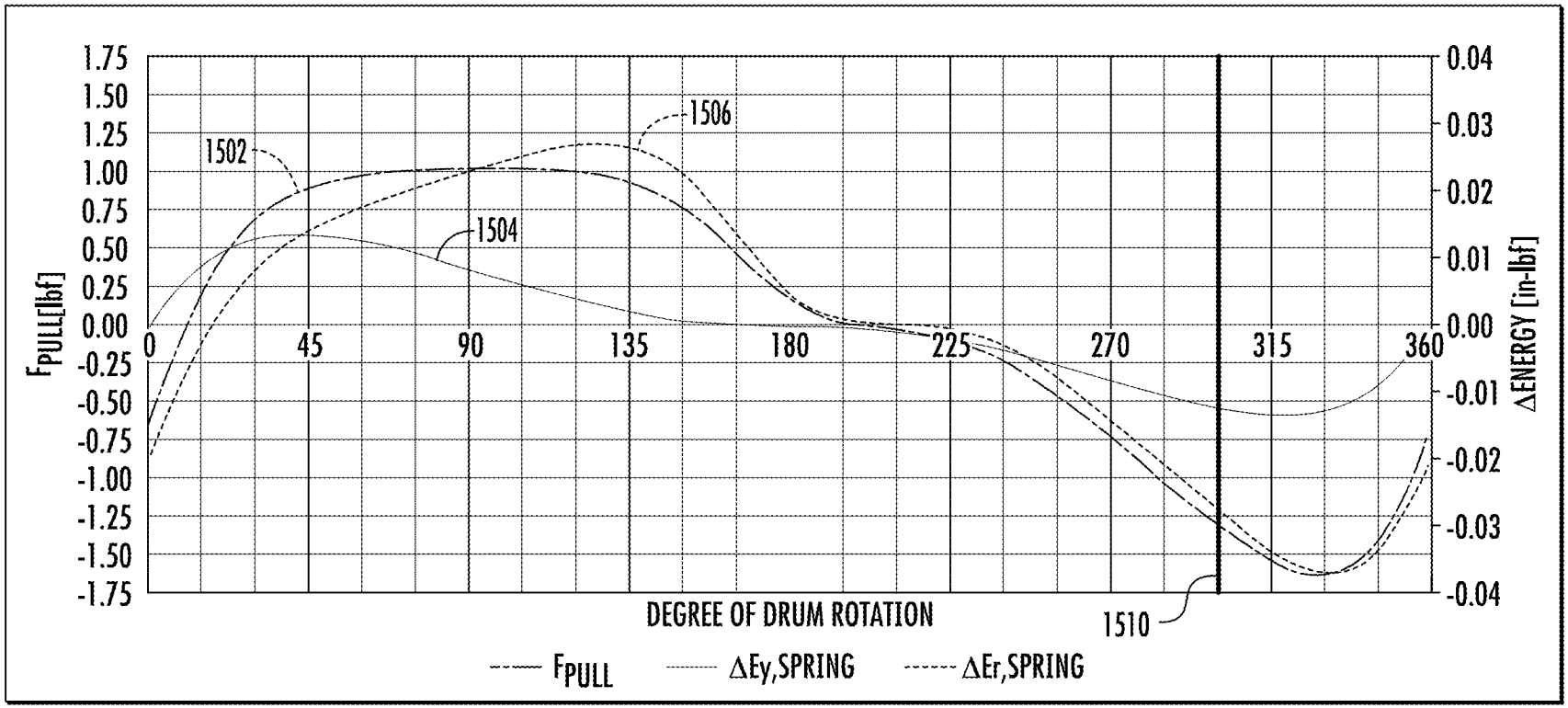

As depicted in FIGS. 20A and 20B the knife drum 24 may rotate to 300 degrees by further discharging of the first torsion spring 1308 and the second torsion spring 1310. The change in energy 1506 of the first torsion spring 1308 may further decrease to approximately −0.034 in-lbf and the change in energy 1504 of the second torsion spring 1304 may further decrease to approximately −0.014 in-lbf (e.g., the first and second torsion springs are discharging at a greater rate than before). The first torsion spring 1308 and second torsion spring 1310 may continue to discharge as the knife drum 24 rotates back to 0 degrees to present a free end 62, 66 of the sheet product 75 for the next user. The line 1510 along the graph of FIG. 20B indicates the position of the spring assembly as depicted in FIG. 20A along the cutting cycle.

The spring assembly may charge more quickly than traditional crank arm assemblies, e.g. over 113 degrees, and include a longer discharge, e.g. over 247 degrees. The reduction in charge rotation and limited dwell period may allow for discharge to occur earlier in the cutting cycle and thus reduce the pull force by approximately 0.8 lbf over traditional crank arm assemblies. The reduction in pull force may allow the user to dispense a sheet of sheet product with reduced pull time and/or reduced pull force. For example, some traditional assemblies may simply connect the crank arm 1302 to a coil spring coupled to the support block 44, which may limit the spring's contribution to pull force to approximately a sine wave. In contrast, the rocker link 1304, floater link 1306, and torsion springs 1308, 1310 may enable endless ways to tailor, shape, and customize the pull force to optimize dispensing. For example, the pull force may be tailored for a flatter and lower peak force than the traditional crank arm and coil spring. In some example embodiments, the pull force may be configured to complement the other force factors that may change during the dispense cycle, such as cutting, friction, momentum, or the like, which is not afforded by the traditional crank arm and coil spring.

Further, in some embodiments, the specific design of the components of the spring assembly can be varied or determined to achieve different cutting cycles that may be optimized for the specific dispenser. For example, shortening or lengthening of various components (e.g. the rocker arm) or changing the stiffness of the one or more biasing elements may affect the cutting cycle and/or pull force performance. Further, some embodiments may achieve acceptable dispensing results without requiring one of the torsion springs 1308, 1310. Further, one skilled in the art would be able to substitute the torsion spring 1308, 1310 with an equivalent biasing element, for example a tension spring, a compression spring, or any other suitable biasing element or energy-storage device. Further, while the preceding description may be categorized as a 4-bar linkage, equivalent linkages are considered within the scope of this invention, for example a bar linkage with a slider, as discussed below in reference to FIGS. 21A-21F. Some embodiments of the present invention seek to utilize this versatility to achieve desired cutting cycle arrangements for the spring assembly.

Figure 21B:
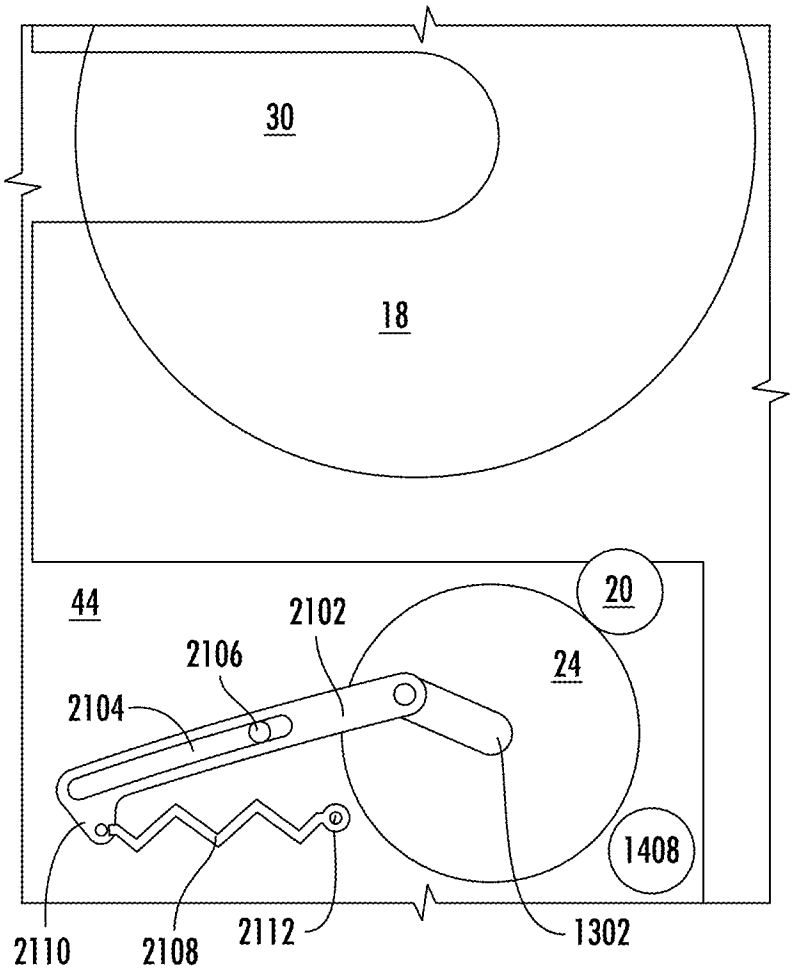
Figure 21A:
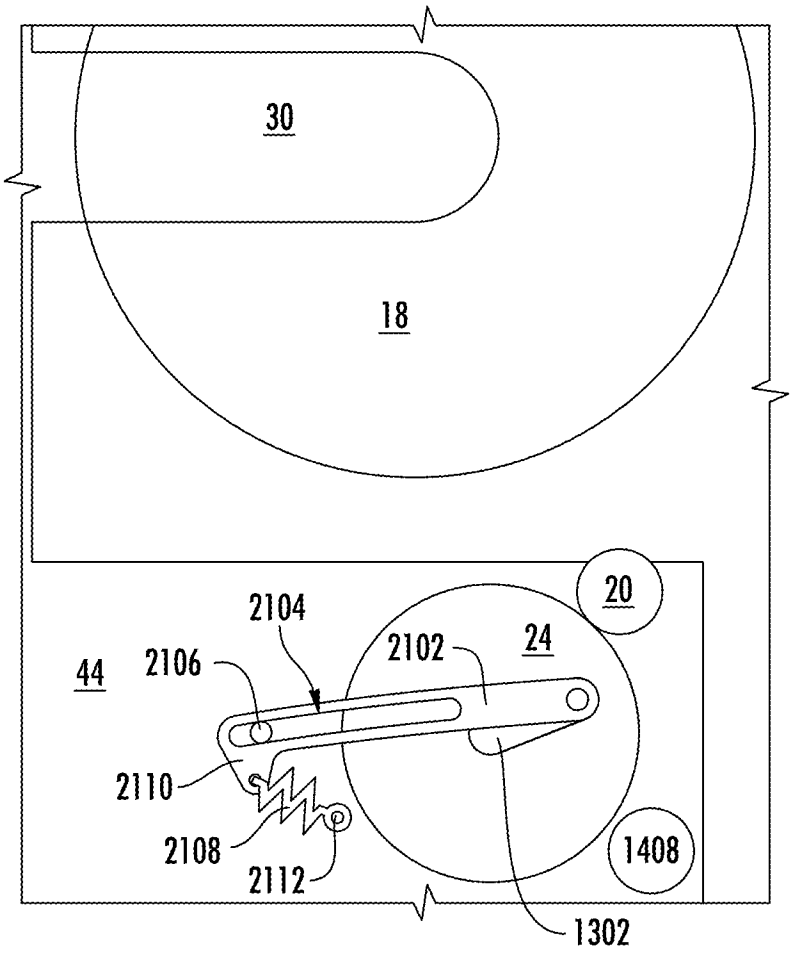

FIGS. 21A-21F illustrate example spring assemblies including a bar linkage with slider according to various example embodiments. The spring assemblies of FIGS. 21A-21F may include a knife drum 24 with a crank arm 1302, which may be substantially similar to the knife drum 24 and crank arm 1302 discussed above in reference to FIGS. 13 and 15A-20A. In an example embodiment, such as shown in FIGS. 21A-21B, the spring assembly may include a slide mechanism, such as a bar link with slot and pin, a sliding cylinder, a sliding piston, or the like. In the depicted example, the spring assembly includes a bar link 2102 with a straight slot 2104. The support block 44 or the housing 12 may include a slot pin 2106 that fits within the slot 2104. In other examples, the slot pin 2106 may be operably coupled to the bar link 2102 and the support block 44 may include the slot 2104.

The slot 2104 may translate along or about the slot pin 2106 during a cutting cycle. The spring assembly may also include a biasing element, such as tension spring 2108, operably coupled to the support block 44 and the bar link 2102. The tension spring 2108 may be operably coupled to the support block 44 by an anchor point 2112 at a first end and may be operably coupled to an end tab 2110 of the bar link 2102 at a second end, e.g. a distal end, of the bar link 2102. In an example embodiment, the end tab 2110 may extend in a direction substantially perpendicular to a longitudinal direction of extension of the bar link 2102. The bar link 2102 may be pivotally connected to the crank arm 1302 at the second end, e.g. the distal end, of the crank arm 1302.

In operation, the spring assembly may start in the position shown in FIG. 21A, where the biasing element is discharged. As the sheet product 75 is pulled by the user, the knife drum 24 may turn in a counter clockwise direction, e.g. the feed direction, causing the crank arm 1302 to push the first end of the bar link 2102 rearward and away from the knife drum 24. The slot 2104 of the bar link 2102 may slide on the slot pin 2106, such that the rotational force of the knife drum 24 and crank arm 1302 are transferred to linear motion of the bar link 2102. As the bar link 2102 translates linearly away from the knife drum 24, the tension spring 2108 is charged, as depicted in FIG. 21B. The force of the charged tension spring 2108 may cause the bar link 2102 to move towards the knife drum 24 completing the rotation of the crank arm 1302 and knife drum 24, and returning the tension spring 2108 to a discharged state.

Figure 21D:
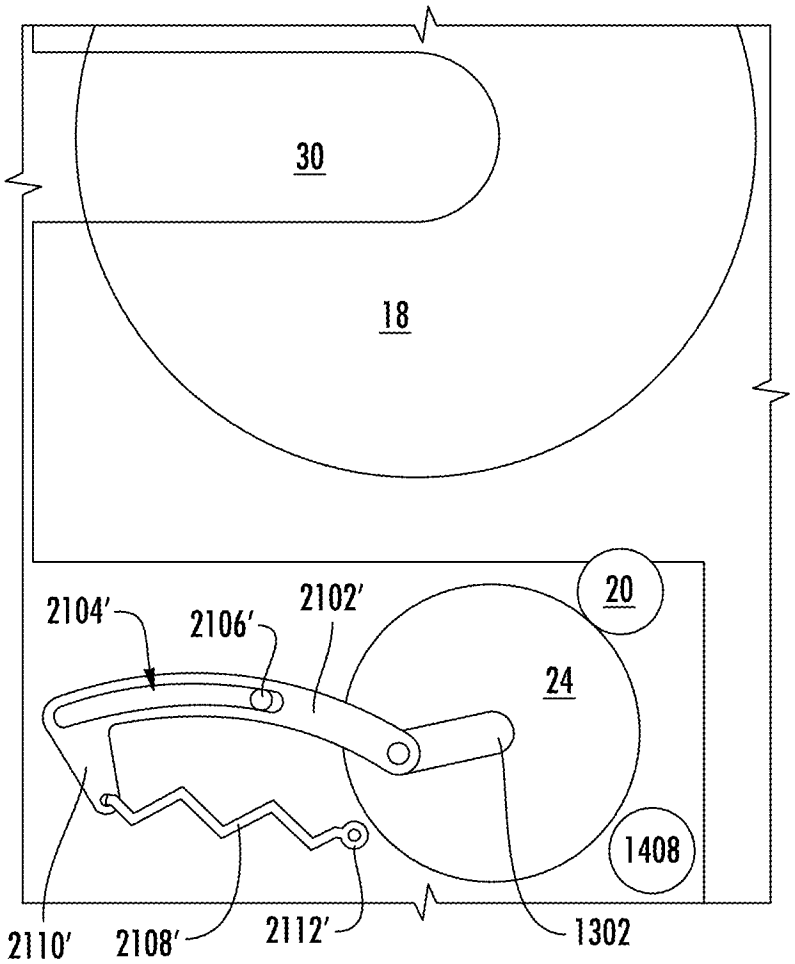
Figure 21C:
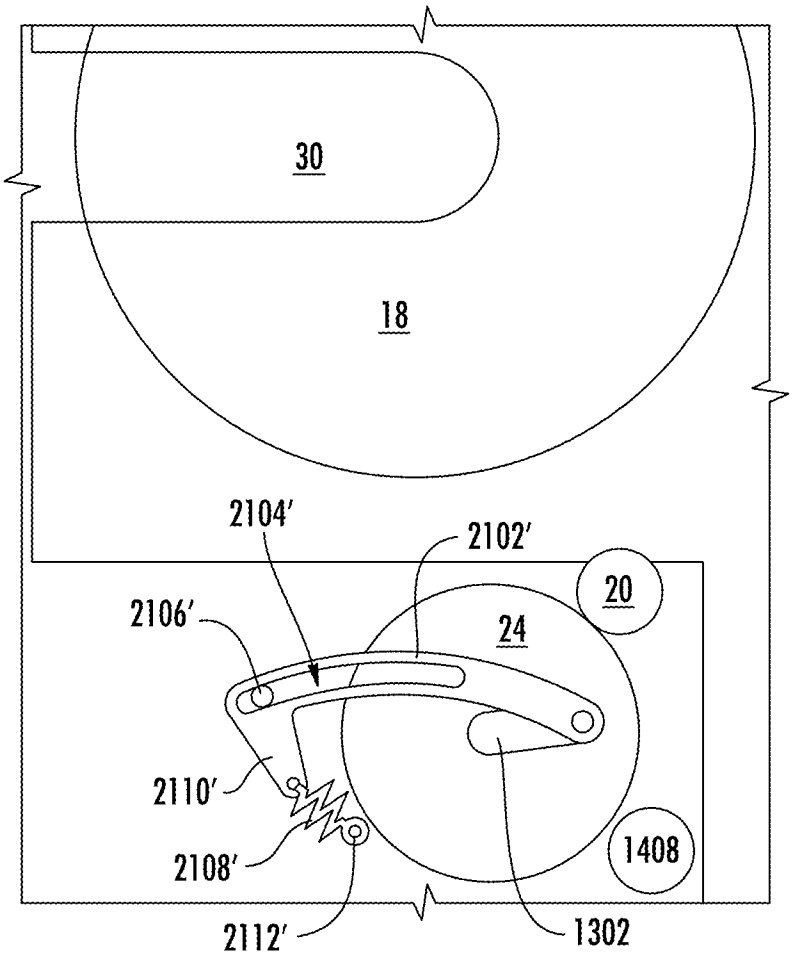

FIGS. 21C and 21D illustrate a spring assembly including a curved bar link 2102' and a curved slot 2104'. The curve of the slot 2104' may enable customization of the pull force, such as by varying the length or depth of the curve of the slot 2104'. Additionally, by varying the position and/or extension of the end tab 2110' the connection point of the tension spring 2108' may also be varied enabling further pull force customization.

Figure 21F:
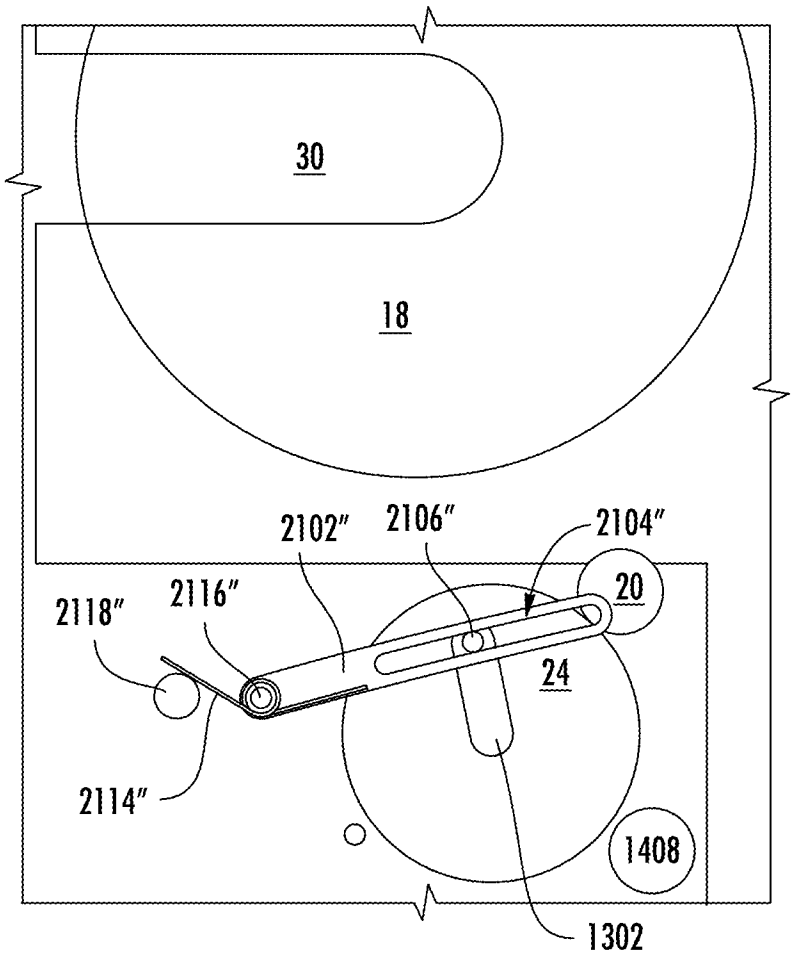
Figure 21E:
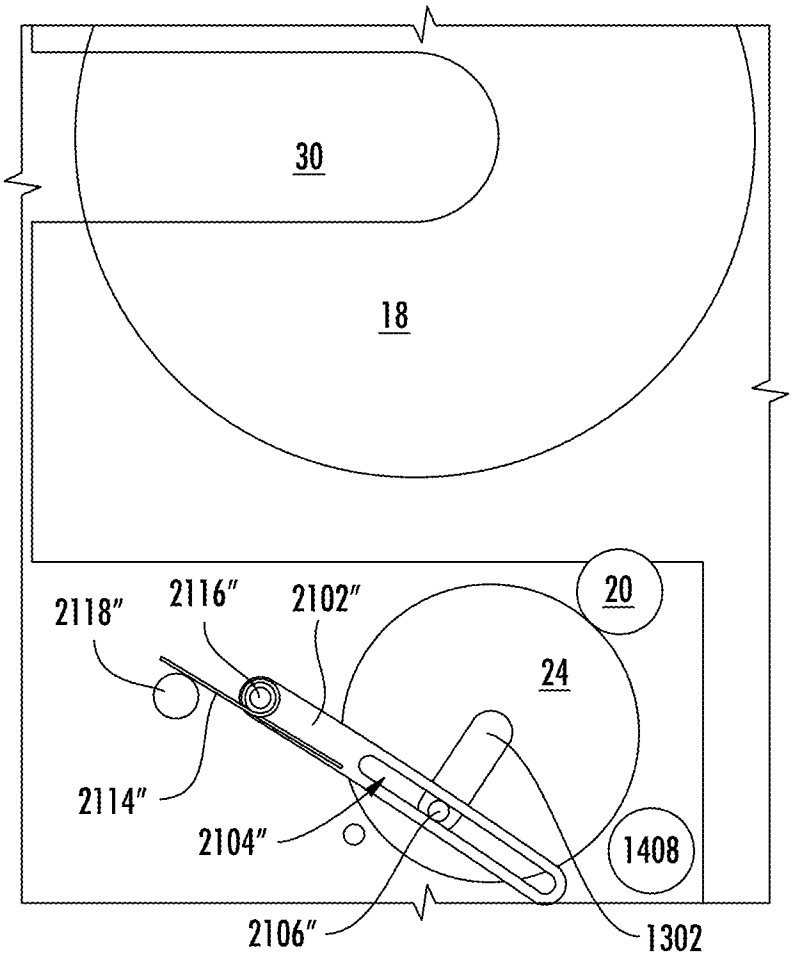

FIGS. 21E and 21F illustrate an example spring assembly in which the slot pin 2106" is operably coupled to the distal end of the crank arm 1302 and the bar link 2102" is pivotally connected to the support block 44 by a pivot 2116". The biasing element of an example embodiment of the spring assembly may be a torsion spring 2114", which may be operably coupled to the bar link 2102" at a first end and operably coupled to the support block 44 at a second end, such as by spring tab 2118". The torsion spring 2114" may be disposed about the pivot 2116". Rotation of the crank arm 1302 may cause the bar link 2102" to pivot upward about the pivot 2116" and cause the torsion spring 2114" to charge. The force of the charged torsion spring 2114" may cause the bar link 2102" to pivot downward causing the crank arm 1302 to complete the rotation of the knife drum 24 and return the torsion spring 2114" to a discharged state. Although the depicted slot 2102" is substantially straight, the slot 2104" may be curved, or any other shape suitable to customize and optimize the pull force of the spring assembly.

Example Feed Wheel and Torque Limiter

FIG. 22 illustrates the dispenser 10 with a cover 11 open (right side) and closed (left side). In the depicted embodiment, the feed wheel 56 is disposed on the right hand side of the dispenser 10 and operably coupled to the knife drum 24, as described below in reference to FIGS. 23-26.

FIG. 23 illustrates a perspective view of a feed wheel assembly. The feed wheel 56 may be operably coupled to a feed wheel gear 2204. The feed wheel gear 2204 may be operably coupled, such as through intermeshed gear teeth, to a knife drum gear 2202. The knife drum gear 2202 is operably coupled, such as by molding, retention tabs, adhesive, or the like, to an end of the knife drum 24. Rotation of the feed wheel 56 may cause the feed wheel gear 2204 to rotate, which in turn causes the knife drum gear 2202 and the knife drum 24 to rotate.

In an example embodiment, the feed wheel assembly may also include a pawl 2206. The pawl 2206 may be configured to allow the feed assembly to rotate in the feed direction and resist rotation in a direction opposite the feed direction, in a ratchet-type manner. The pawl 2206 may be a pivotable lever including one or more teeth. The teeth may be configured to engage the teeth of the feed wheel gear 2204 or the knife drum gear 2202. In an example embodiment, the angle of the teeth of the pawl 2206 may be configured to allow rotation of the knife drum gear 2202 or the feed wheel gear 2204 in the feed direction such that the teeth of the knife drum gear 2202 or the feed wheel gear 2204 push the pawl 2206 out of engagement. When the knife drum gear 2202 or the feed wheel gear 2204 are rotated in the direction opposite the feed direction, however, the angle of the teeth of the pawl 2206 cause the teeth to engage the teeth of the knife drum gear 2202 or the feed wheel gear 2204 and prevent rotation.

In some example embodiments the pawl 2206 may include a biasing element, such as a spring or flexible tab, configured to bias the pawl 2206 toward the knife drum gear 2202 or the feed wheel gear 2204. In an example embodiment, the pawl 2206 may be formed of a semi-rigid material, such as an elastomer. Forming the pawl 2206 from a semi-rigid material may enable the pawl 2206 to have sufficient structural strength to resist rotation in the direction opposite the feed direction and sufficient pliability to absorb vibration and reduce noise.

FIG. 24 illustrates a perspective view of the feed wheel 56 and an example torque limiter 2302. The feed wheel 56 may be rotatable about the torque limiter 2302, e.g. a torque plate or mechanical fuse. The torque limiter 2302 may be configured to limit the torque applied by the feed wheel 56 to the feed wheel gear 2204 when a feed force greater than a predetermined force is applied to the feed wheel 56 during rotation. For example, when the feed wheel 56 is rotated in the feed direction D1, the rotational feed force applied to the feed wheel 56 may be transferred to the torque limiter 2302, to the feed wheel gear 2204, and ultimately to the knife drum 24 with little resistance. However, when the feed wheel is rotated in the direction opposite the feed direction D2, the pawl 2206, or other back spin prevention, may engage, applying resistance to the rotation of the feed wheel 56. In such an instance, the torque limiter 2302 may limit or prevent transference of the rotational feed force to the feed wheel gear 2204 or other components of the feed wheel assembly, which may reduce or prevent damage to the feed wheel assembly components. Other examples of resistance to rotation may include mechanical binding, a jam of sheet product 75, or the like.

In an example embodiment, the feed wheel 56 may include a plurality of tabs or bosses 2304, e.g. raised projections, disposed around an inner periphery of the feed wheel 56. The torque limiter 2302 may include one or more ribs or ramps 2306. The ramps 2306 may be configured to engage the bosses 2304 to transfer the rotational feed force from the feed wheel 56 to the feed wheel gear 2204. Additionally, the ramps 2306 may be configured to detent, or flex, past the bosses 2306 if the feed force is greater than a predetermined force, e.g. a flex resistance of the ramp 2306, which may be determined by design of the ramp 2306. The predetermined force may be designed, such that the transferred rotational feed force is less than a force which would cause damage to the feed wheel components, such as gear teeth, spring assembly links, or the like. In another example embodiment, the bosses 2304 may be disposed on the torque limiter 2302 and the ramps 2306 may be disposed on the feed wheel 56. The torque limiter 2302 may allow for the teeth of the feed wheel gear 2304 and knife drum gear 2302 to maintain engagement, since over torque is addressed by the torque limiter 2302, and not by disengagement of feed wheel gear 2304 and knife drum gear 2302.

FIG. 25 illustrates a side view of the feed wheel 56. In the depicted embodiment, the feed wheel 56 includes a plurality of bosses 2304 around the inner periphery of the feed wheel 56. The torque limiter 2302 may include a central portion configured to transfer the torque to the feed wheel gear 2204 and two half circles extending from the central portion, each including a ramp 2306. The ramps 2306 may engage a leading edge of the bosses 2304 as the feed wheel 56 is rotated, applying the rotational feed force of the feed wheel 56 to the ramps 2306 and torque limiter 2302. When the feed force is greater than the predetermined force, the ramps 2306 and/or portions of the half circles may detent, e.g. deflect, flex, or deform inward, allowing the ramps 2306 to pass the bosses 2304. The ramps 2306 may return to an extended position, e.g. self-reset, and engage with the leading edge of the next bosses 2304. In some example embodiments, the ramps 2306 may slightly flex at all points relative to the feed wheel 56, such that the ramps 2306 are always engaged with the bosses 2304. Since the ramps are flexible at all points, there is little to no rattle or travel before engagement of the feed wheel 56 during operation. The torque limiter 2302 may have a high torsional stiffness allowing little rotation above the predetermined force prior to detenting.

FIG. 26 illustrates a cross-sectional view of the feed wheel 56 and feed wheel gear 2204. A feed wheel gear shaft may extend from the feed wheel gear 2204 through bushings 2502 in the housing 12. The torque limiter 2302 may be affixed, e.g. such as by clips, screws, adhesive, or the like, to the feed wheel gear shaft, such that rotation of the torque limiter 2302 causes rotation of the feed wheel gear 2204.

The feed wheel 56 may include first portion 56A including the portion actuated by the user and a second portion 56B including the bosses 2304. The first portion 56A and second portion 56B of the feed wheel 56 may be operably coupled, such as by screws, tabs, adhesive, or the like, such that rotation of the first portion 56A causes rotation of the second portion 56B. In some example embodiments, the first portion 56A and second portion 56B of the feed wheel 56 may be configured for concentric engagement, such that at least a portion of the first portion 56A or second portion 56B is inserted within the other of the first portion 56A or second portion 56B. The torque limiter 2302 may be disposed within the first portion 56A and second portion 56B. In an example embodiment, the first portion 56A and second portion 56B of the feed wheel 56 may rotate relative to the torque limiter 2302.

FIG. 27 illustrates a perspective view of a support block 44. The support block 44 may include the cam track 1402, such as molded into the support block 44. The cam track 1402 may be formed in a recess for the knife drum gear 2202. The support block 44 may also include a pivot for pawl 2206, which may also be recessed in the support block 44. As discussed above, the pawl 2206 may include a biasing element 2602 configured to bias the pawl toward the knife drum gear 2202 or feed wheel gear 2204.

Example Overspin Bar

FIGS. 28 and 29 illustrate an example dispenser 10 including an overspin bar 2702. The overspin bar 2702 may be configured to rest on the roll of sheet product 75 and prevent sheet product from building up due to continued rotational momentum of the product roll after completion of dispensing. The overspin bar 2702 may be pivotally connected to the housing 12. For example, the overspin bar 2702 may include tabs 2704 which pivot within recesses formed in the housing 12. Alternatively, the overspin bar 2702 may include the recesses and the tabs 2704 may be formed in the housing 12.

During normal operation, the sheet product may unroll from the back of the second source 18, over the dispensing roller 20 and around the knife drum 24. In an instance in which the second source 18 experiences excessive rotational momentum, the cohesive force of the sheet product 75 may allow for some sheet product to remain unrolled as the second source 18 continues to rotate, thereby forming a fold over 2709 on top of or behind the second source 18 (shown in FIG. 29). This may cause sheet product 75 to issue from the front of the second sheet source 18, as depicted by 2705, until the fold over 2709 is depleted causing normal operations to continue. The overspin bar 2702 may limit the fold over 2709 from hanging down within the dispenser (e.g. behind the second source 18) where the fold over 2709 may get caught in the knife drum 24 and the dispensing roller 20, which may cause the fold over and/or the sheet product 75 to jam the dispenser 10, such as due to excess sheet product being fed through the knife drum 24. For example, the overspin bar may provide a safety zone 2703 for build-up of excess sheet product, e.g. the fold over 2709. With the fold over 2709 in the safety zone 2703, it will not fall within other parts of the dispenser, which may otherwise lead to a jamming scenario. Additionally, the weight of the overspin bar 2702 may provide drag resistance to the rotation of the roll in the feed direction, which may further limit overspin due to momentum carried by the roll of sheet product after dispensing occurs.

Example Knife Slot Bridge

FIG. 30 illustrates the knife drum 24 with a knife slot bridge 2904. The knife drum 24 may include a knife slot 2902 from which the knife 25 may extend from and retract into, as discussed above. In some dispensers, the length of the dispensing roller 20 may enable the springs 46 or weight of the dispensing roller 20 to pull the dispensing roller 20 partially into a knife slot 2902, resulting in jerkiness and/or operating noise. In an example embodiment of the dispenser 10, the knife drum 24 may include a knife slot bridge 2904 at one or both ends of the knife drum 24. The knife slot bridge 2904 may comprise a piece of material which is formed to continue the outer circumference of the knife drum 24, such that the travel of the dispensing roller 20 is not interrupted (e.g. so the dispensing roller 20 does not fall or dip into the knife slot 2902). In some example embodiments, the dispensing roller 20 may be formed with a length sufficient to contact both of the knife slot bridges 2904. As the knife drum 24 rotates the knife slot 2904 relative to the dispensing roller 20, the dispensing roller 20 may ride on the knife slot bridges 2904, which may prevent the dispensing roller 20 from being pulled into the knife slot 2902. The knife slot bridges 2904 may enable smoother and/or quieter operation. In some example embodiments where the discharge roller 1406 is positioned to contact the knife drum 24, the discharge roller 1406 may also be configured with adequate length and radius to enable the knife slot bridges 2904 to prevent the discharge roller 1406 from moving into the knife slot 2902.

In some embodiments, the knife slot bridge 2904 may have a different radius than the outer circumference of the knife drum 24. Accordingly, the radius of the portion of the dispensing roller 20 that contacts the knife slot bridge 2904 may be different than the portion of the dispensing roller 20 that contacts the surface 40 of the knife drum 24, such that the axis of the dispensing roller 20 is substantially the same distance from the axis of the knife drum 24 whether the dispensing roller 20 is supported by the surface 40 of the knife drum 24 or by the knife slot bridge 2904.

Example Knife Cutting Ribs

FIGS. 31 and 32 illustrate a dispenser 10 including knife cutting ribs 3002. In the example depicted in FIGS. 30 and 31, the knife drum 24 may be rotated to the point that the motion prescribed by the cam track 1402 has begun to extend the knife 25 out of the knife drum 24. As the knife 25 extends, the knife 25 may force against the sheet product 75 that is wrapped around the knife drum 24. The force of the knife 25 against the sheet product 75 may cause the sheet product 75 to lift off the surface of the knife drum 24, which may preclude the knife 25 from cutting all the way through the sheet product 75.

The example embodiment depicted in FIGS. 31 and 32 may enable restraint of the sheet product 75 adequately to the surface of the knife drum 24, without requiring large pinch roller forces and without limiting the range of rotation over which the knife 25 may extend. The oval 3004, depicted by the dashed line 3004 in FIG. 31, shows a region of the ribs 3002 in which the curvature of the ribs 3002 is approximately the same as the curvature of the knife drum 24. In FIG. 31, the knife 25 is depicted as beginning to extend from the knife drum 24, and the ribs 3002 are closer to the surface of the knife drum 24 than the tips of the knife 25. As such, the ribs 3002 may assist in restraining the sheet product 75 to the knife drum 24, such that the tips of the knife 25 may begin to pierce and cut the sheet product 75 early in a cutting cycle without excessive pinch force being required. FIG. 32 illustrates a front view of the knife drum 24 in the position depicted in FIG. 31, and shows that seven ribs 3002 may hold or restrain the sheet product 75 close to the surface of the knife drum 24, thereby enabling the tips of the knife 25 to begin piercing the sheet product 75. In an example embodiment, some of the tips of the knife 25 may be closely adjacent to the seven ribs 3002, and cutting may occur at these tips first. In some example embodiments, the knife 25 may include additional tips that are shorter, and/or further from the ribs 3002, which may begin to pierce the sheet product 75 at some time after the longer tips of the knife 25 adjacent to the ribs 3002. In some example embodiments, the ribs 3002 may extend into recesses formed in the surface of the knife drum 24.

In some example embodiments, as knife drum 24 rotates and the knife 25 extends, the knife 25 may extend far enough that the surface of the ribs 3002 may be formed further from the knife drum 24 to avoid contact with the extending knife 25, as depicted in FIG. 31.

Example Knife and Slot Guards

FIGS. 33 and 34 illustrate an example knife drum 24 including slot guards 3202 and knife guards 3204. FIG. 33 illustrates a perspective view of the knife drum 24 with the knife 25 extended. In an example embodiment, the knife slot 2902 may have a larger width than the knife 25, which may, in some undesirable cases, allow the knife 25 to draw the leading edge of the sheet product 75 into the knife slot 2902 after the knife 25 cuts the sheet product 75. FIG. 34 depicts a side view of the knife drum 24 with the sheet product 75 cut by the knife 25. In an example embodiment, the knife slot 2902 may include slot guards 3202 and the knife 25 may include knife guards 3204, which may be configured to limit or prevent the knife 25 from drawing the sheet product 75 into the knife slot 2902. The knife guards 3204 may be affixed to the top side of the knife 25, and the slot guards 2302 may be affixed to the surface of the knife drum 24. The surface profiles of the knife guards 3204 and the slot guards 3202 may overlap, such that there is no direct path for the sheet product 75 to enter the knife slot 2902. In an example embodiment, the slot guards 3202 may extend through gaps between the knife 25, which may further prevent the sheet product from being pulled into the knife slot 2902.

Example Cantilevered Fingers

FIGS. 35 and 36 illustrate an example knife drum shroud 3502 in accordance with an example embodiment. In an example embodiment, the ribs 3503 may be disposed on the knife drum shroud 3502 which may extend about a periphery of the knife drum 24. In some example embodiments, the ribs 3503 may terminate at a predetermined distance from the knife drum 24, which may reduce drag or friction associated with rotation of the knife drum 24 (which may otherwise be caused by contact between the ribs and the sheet product 75 on the outer circumference of the knife drum). The knife drum shroud 3502 may also include one or more cantilevered fingers 3504. The cantilevered fingers 3504 may extend from the knife drum shroud 3502 toward the knife drum 24. The cantilevered fingers 3504 may terminate proximate to, or in contact with, the knife drum 24. The cantilevered fingers 3504 may limit or prevent the sheet product 75 from moving away from the surface of the knife drum 24 by providing a biasing force on the sheet product 75 toward the outer circumference of the knife drum 24. Otherwise, in some cases, the knife drum 24 may fail to contact the sheet product 75 and, thus, fail to push the free end 62 of the sheet product 75 through the outlet 14, while in other cases, the sheet product 75 may pull away from the surface of the knife drum 24, and thus, lose tension that may be required to successfully cut the sheet product 75. In some embodiments, the cantilevered fingers 3504 may allow for larger engineering tolerances and may contribute negligible drag to the knife drum 24 rotation.

Method of Manufacturing

Associated systems and methods for manufacturing example product dispensers described herein are also contemplated by some embodiments of the present invention.

Conclusion

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A dispenser for dispensing sheet product, the dispenser comprising:

a housing that defines an interior, the interior configured to accommodate at least one source of sheet product, wherein the housing further defines an outlet through which the sheet product is dispensed;

a knife drum that is rotatable with respect to the housing;

a knife that is movable between a retracted position within the knife drum and an extended position, wherein, when in the extended position, at least a portion of the knife protrudes outside of the knife drum, wherein the knife is operable to cut the sheet product;

a cam follower surface that is fixed with respect to the housing;

a cam follower attached to the knife and operable to engage the cam follower surface and travel along the cam follower surface to transition the knife between the retracted position and the extended position as the knife drum rotates; and a spring assembly configured to bias the knife drum during rotation of the knife drum toward a predetermined position, wherein the spring assembly comprises a first spring and a second spring, wherein the spring assembly is attached to the housing via a single housing-attached mount, the single housing-attached mount at a single mount position, wherein the single housing-attached mount is fixed with respect to the housing, wherein the first spring provides a first force during rotation of the knife drum, wherein the second spring provides a second force during rotation of the knife drum.

2. The dispenser of claim 1, wherein the spring assembly does not comprise another mount that is fixed with respect to the housing.

3. The dispenser of claim 1, wherein the spring assembly is further attached to the knife drum.

4. The dispenser of claim 1, wherein at least a portion of the spring assembly pivots about the single mount position.

5. The dispenser of claim 1, wherein the spring assembly comprises a first movable pivot point and a second movable pivot point, wherein both the first movable pivot point and the second movable pivot point are movable with respect to the cam follower surface as the knife drum rotates.

6. The dispenser of claim 1, wherein the spring assembly comprises at least one movable pivot point that enables the first spring and the second spring to begin releasing charge at the same time during rotation of the knife drum.

7. The dispenser of claim 1, wherein the spring assembly is designed to enable a user to only need to provide approximately 1 lbf of pull force to achieve a dispense of sheet product.

8. A dispenser for dispensing sheet product, the dispenser comprising:

a housing that defines an interior, the interior configured to accommodate at least one source of sheet product, wherein the housing further defines an outlet through which the sheet product is dispensed;

a knife drum that is rotatable with respect to the housing;

a knife that is movable between a retracted position within the knife drum and an extended position, wherein, when in the extended position, at least a portion of the knife protrudes outside of the knife drum, wherein the knife is operable to cut the sheet product;

a cam follower surface that is fixed with respect to the housing;

a cam follower attached to the knife and operable to engage the cam follower surface and travel along the cam follower surface to transition the knife between the retracted position and the extended position as the knife drum rotates; and a spring assembly configured to bias the knife drum during rotation of the knife drum toward a predetermined position so as to provide a force to cause the cam follower to travel along the cam follower surface, wherein the spring assembly comprises a first spring and a second spring, wherein the spring assembly comprises a single housing-fixed mount and at least one movable mount, the single housing-fixed mount at a single mounting position, wherein the single housing fixed mount is fixed with respect to the housing, wherein the at least one movable mount is movable with respect to the housing.

9. The dispenser of claim 8, wherein at least one of the at least one movable mount is fixed with respect to the knife drum.

10. The dispenser of claim 8, wherein the spring assembly does not comprise another mount that is fixed with respect to the housing.

11. The dispenser of claim 8, wherein at least a portion of the spring assembly pivots about the housing-fixed mount.

12. The dispenser of claim 8, wherein the spring assembly comprises two movable mounts that are each movable with respect to the cam follower surface as the knife drum rotates.

13. A dispenser for dispensing sheet product, the dispenser comprising:

a housing that defines an interior, the interior configured to accommodate at least one source of sheet product, wherein the housing further defines an outlet through which the sheet product is dispensed;

a knife drum that is rotatable with respect to the housing;

a knife that is movable between a retracted position within the knife drum and an extended position, wherein, when in the extended position, at least a portion of the knife protrudes outside of the knife drum, wherein the knife is operable to cut the sheet product;

a cam plate positioned within the housing and defining a cam follower surface, wherein the cam plate is fixed with respect to the housing;

a cam follower attached to the knife and operable to engage the cam follower surface and travel along the cam follower surface to transition the knife between the retracted position and the extended position as the knife drum rotates; and a spring assembly configured to bias the knife drum during rotation of the knife drum toward a predetermined position, wherein the spring assembly comprises a first spring and a second spring, wherein the spring assembly is attached at a first end to a housing-fixed mount at a single mount position with respect to the cam plate so as to provide a single fixed connection to the housing for both the first spring and the second spring, wherein the first spring provides a first force during rotation of the knife drum, wherein the second spring provides a second force during rotation of the knife drum.

14. The dispenser of claim 13, wherein the spring assembly is attached at a second end that is movable with respect to the housing, wherein the second end moves with the knife drum.

15. The dispenser of claim 13, wherein the spring assembly does not comprise another fixed connection with respect to the housing.

16. The dispenser of claim 13, wherein at least a portion of the spring assembly pivots about the single mount position.

17. The dispenser of claim 13, wherein the spring assembly comprises a first movable pivot point and a second movable pivot point, wherein both the first movable pivot point and the second movable pivot point are movable with respect to the cam follower surface as the knife drum rotates.

* * * * *